US012497788B2

(12) United States Patent
Libani et al.

(10) Patent No.: US 12,497,788 B2
(45) Date of Patent: Dec. 16, 2025

(54) SIDEWALK SHED

(71) Applicant: SHED Innovations Inc., New York, NY (US)

(72) Inventors: Marco Libani, New York, NY (US); Steven Manocherian, New York, NY (US); Avner Sadot, Tel Aviv (IL); Ori Jacobi, Tel Aviv (IL); Guy Dvir, Ramat-Gan (IL)

(73) Assignee: SHED Innovations Inc., New York, NY (US)

( * ) Notice: Subject to any disclaimer, the term of this patent is extended or adjusted under 35 U.S.C. 154(b) by 434 days.

(21) Appl. No.: 18/298,517

(22) Filed: Apr. 11, 2023

(65) Prior Publication Data

US 2023/0323680 A1 Oct. 12, 2023

Related U.S. Application Data

(60) Provisional application No. 63/362,771, filed on Apr. 11, 2022.

(51) Int. Cl.
*E04G 1/04* (2006.01)
*E04G 5/14* (2006.01)

(52) U.S. Cl.
CPC ..... *E04G 1/04* (2013.01); *E04G 5/14* (2013.01); *E04G 2005/148* (2013.01)

(58) Field of Classification Search
CPC ..... E04G 1/04; E04G 5/14; E04G 2005/148; E04G 2001/157; E04G 21/3209
USPC ..... 182/222
See application file for complete search history.

(56) References Cited

U.S. PATENT DOCUMENTS 2,249,658 A 7/1941 Kemner
3,382,949 A * 5/1968 Bloch ..... E04G 5/14 182/113
3,752,262 A * 8/1973 Helms ..... E04G 5/14 182/178.1
4,263,984 A 4/1981 Masuda et al.
4,301,627 A * 11/1981 Wilson ..... E04H 3/28 52/6
4,340,130 A 7/1982 Payne et al.
4,732,234 A * 3/1988 Brickman ..... E04G 21/3266 182/138
4,805,735 A * 2/1989 Anderson ..... E04G 5/001 182/138
5,070,965 A * 12/1991 Jordan, III ..... E04G 5/14 182/178.1

(Continued)

FOREIGN PATENT DOCUMENTS

KR 20-0491378 3/2020

OTHER PUBLICATIONS

PCT International Application No. PCT/US23/65607, International Search Report and Written Opinion of the International Searching Authority, dated Aug. 28, 2023, 10 pages.

*Primary Examiner* — Muhammad Ijaz
(74) *Attorney, Agent, or Firm* — DLA Piper LLP (US)

(57) ABSTRACT

According to one aspect of the present disclosure, a sidewalk shed section can include a first and second pair of leg sections, wherein at least a portion of each leg section is plus-shaped, and each leg section can include a rod header located at a top end of the plus-shaped portion; at least one hole located at a bottom end of the plus-shaped portion; and a bracket configuration.

17 Claims, 99 Drawing Sheets

(56) References Cited

U.S. PATENT DOCUMENTS

| | | | | |
|---|---|---|---|---|
| 5,145,030 | A * | 9/1992 | Pavlescak | E04G 5/14 182/113 |
| 11,976,483 | B2 * | 5/2024 | Chevis | E04G 25/065 |
| 2006/0022186 | A1 * | 2/2006 | Melic | E04G 21/3233 256/24 |
| 2007/0045048 | A1 * | 3/2007 | Wyse | E04G 1/24 182/178.1 |
| 2011/0209945 | A1 * | 9/2011 | Gealy | E04G 5/00 182/222 |
| 2014/0318891 | A1 * | 10/2014 | Crothers | E04G 5/067 182/113 |
| 2014/0360813 | A1 * | 12/2014 | McClendon | E06C 1/34 52/745.16 |
| 2019/0127996 | A1 * | 5/2019 | Chevis | E21D 11/10 |
| 2022/0056713 | A1 | 2/2022 | Bains | |
| 2022/0170278 | A1 * | 6/2022 | Barnard | E04G 1/22 |
| 2022/0282500 | A1 * | 9/2022 | Evans | E04G 5/14 |
| 2023/0323680 | A1 * | 10/2023 | Libani | E04G 1/04 182/222 |
| 2024/0052649 | A1 * | 2/2024 | Steck | E04G 7/301 |
| 2025/0233549 | A1 * | 7/2025 | Tung | H02S 20/30 |

* cited by examiner

SIDEWALK SHED

CROSS REFERENCE TO RELATED APPLICATIONS

This application claims priority to U.S. Provisional Application No. 63/362,771, filed Apr. 11, 2022, which is herein incorporated by reference in its entirety.

BACKGROUND OF THE DISCLOSURE

Sidewalk shed systems are frequently used to support workers during construction, repairs, inspection, and maintenance of buildings and other large structures, usually manmade. For buildings greater than six floor, construction workers are provided with platforms in which they can stand, move around, inspect the building's facade, etc. at heights above ground level. In addition, such sidewalk shed systems should be portable and able to be constructed and deconstructed in a reasonably quick fashion. Typical sidewalk shed systems utilize horizontal bracings and rely on H- or I-shaped parts for connections. The connections are then secured with various clamps and tightened with screws.

SUMMARY OF THE DISCLOSURE

According to one aspect of the present disclosure, a sidewalk shed section can include a first and second pair of leg sections, wherein at least a portion of each leg section is plus-shaped, and each leg section can include a rod header located at a top end of the plus-shaped portion; at least one hole located at a bottom end of the plus-shaped portion; and a bracket configuration. The sidewalk shed section can also include a first header beam connected to each of the first pair of leg sections via a first and second header beam hole, each hole configured to receive the respective rod headers; a second header beam connected to each of the second pair of leg sections via a third and fourth header beam hole, each hole configured to receive the respective rod headers; a first senior beam connected to a first bracket configuration of the first pair of leg sections and a first bracket configuration of the second pair of leg sections; a second senior beam connected to a second bracket configuration of the first pair of leg sections and a second bracket configuration of the second pair of leg sections; a plurality of braces, each brace being connected to a plus-shaped portion of a leg section and one of the first senior beam, the second senior beam, the first header beam, or the second header beam; a platform section supported by the first senior beam and the second senior beam; and a barrier supported by the first header beam and the second header beam.

In some embodiments, each leg section further can include a header plate, wherein the respective header beam rests on the header plate. In some embodiments, each leg section can a center rod; a base connected to a bottom end of the center rod; and a plus part connected to the top end of the center rod, the plus part comprising the plus-shaped portion. In some embodiments, the base can include a threaded rod and is configured to screw into the bottom end of the center rod. In some embodiments, each leg section is connected to two braces of the plurality of braces. In some embodiments, one of the two braces is connected to either the first header beam or the second header beam and another of the two braces is connected to either the first senior beam or the second senior beam.

In some embodiments, each of the plurality of braces is connected via a bracing cap and pin. In some embodiments, the sidewalk shed can further include a plurality of junior beams, each junior beam residing in a slot of the first header beam and a slot of the second header beam and spanning a width of the sidewalk shed section. In some embodiments, the platform section is further supported by the plurality of junior beams. In some embodiments, the platform section can include a corrugated sheet configured to reside on the plurality of junior beams and the first and second senior beams; and one or more planks configured to reside on the corrugated sheet.

In some embodiments, the barrier can include a first parapet rod received by a first parapet bar bracket connected to a first plank of the one or more planks; and a second parapet rod received by a second parapet bar bracket connected to a second plank of the one or more planks. In some embodiments, the parapet is perforated. In some embodiments, the bracket configuration comprises a bracket and a bracket mirror, wherein the bracket and the bracket mirror are coupled to the plus-shaped portion. In some embodiments, each of the first header beam and the second header beam comprise a first plurality of holes located at a first end and a second plurality of holes located at a second end. In some embodiments, the sidewalk shed section is configured to be connected horizontally to a second sidewalk shed section. In some embodiments, the sidewalk shed section is configured to be connected vertically to a second sidewalk shed section.

DESCRIPTION

The following detailed description is merely exemplary in nature and is not intended to limit the invention or the applications of its use.

Embodiments of the present disclosure relate to a sidewalk shed system that offers structural advantages, easier and faster assembly, and flexibility in determining the height and width between levels and sections. More efficient assembly thus can allow for more efficient construction as a whole and result in cost savings. The disclosed sidewalk shed system can use a plus shape rod as its base legs that allows for multiple connections, both to other parts of the system and even walls for added stability. In addition, the sidewalk shed system herein can use horizontal beams (i.e., "header beams" as described herein) that have various holes, enabling flexibility for customization, and pin plates for quick and easy assembly and disassembly.

Figure 1:
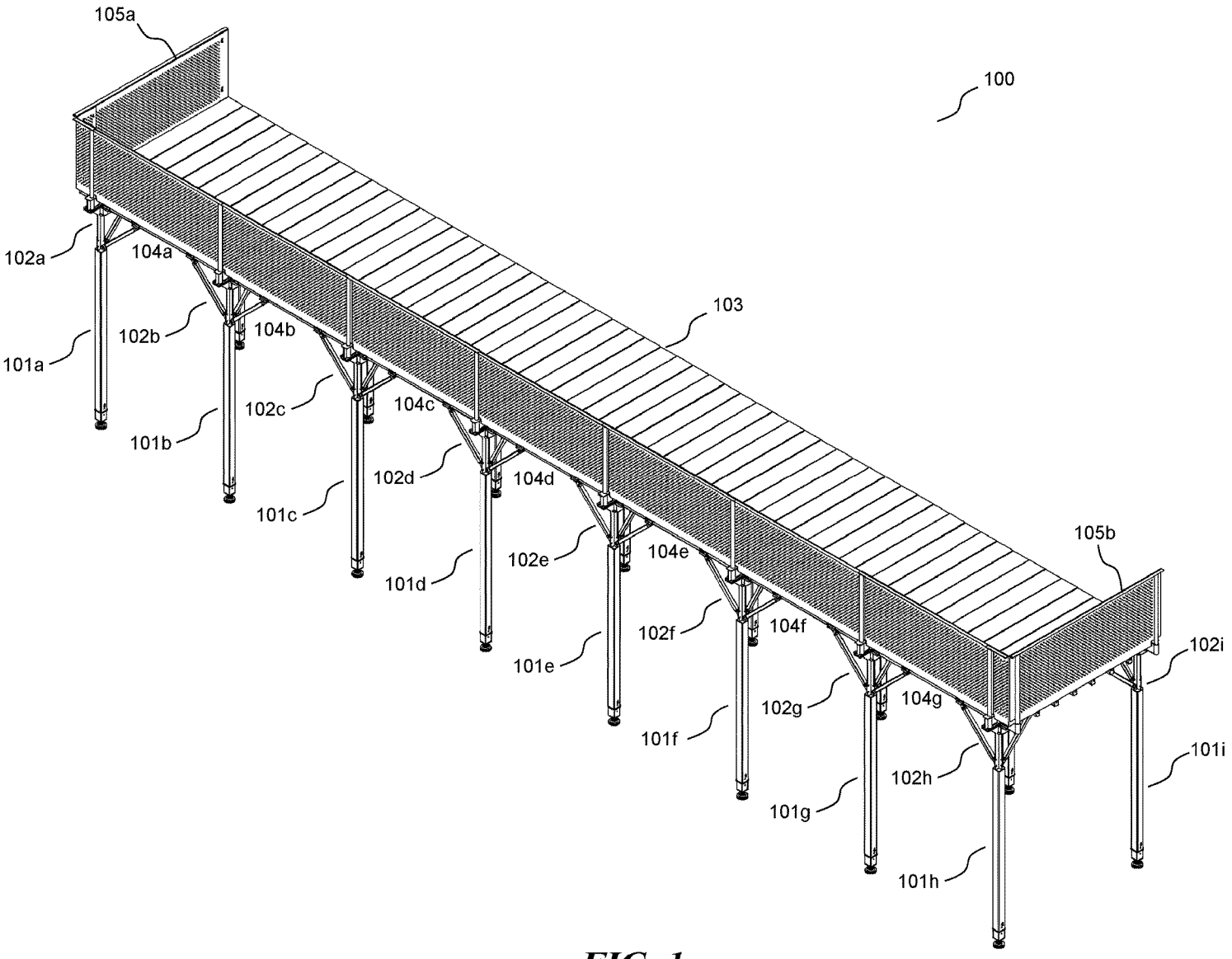
FIG. 1 shows a perspective view of a sidewalk shed system according to some embodiments of the present disclosure.

FIG. 1 shows a perspective view of a sidewalk shed system 100 according to some embodiments of the present disclosure. Sidewalk shed system 100 includes various sections. Each section is defined by the center rods 101*a-i* and the front parapets 104*a-h*. For example, the left-most section includes center rods 101*a* and 101*b*. Each of the center rods 101*a* and 101*b* are connected to plus parts 102*a* and 102*b*, respectively. The plus parts 102*a-b* provide bracing and stability to the platform 103 with various parts that will be described in more detail in later figures. In addition, the section includes a front parapet 104*a* and a side parapet 105*a*. Various sections share center rods and plus parts. Sidewalk shed system 100 is configured to support a person (e.g., maintenance or construction worker) walking on platform 103, such as to work on the side of a building or other structure. Furthermore, while the sidewalk shed system 100 of FIG. 1 only has one level (i.e., vertical level or "story"), multiple levels are possible and can be built on top of each other.

Figure 2:
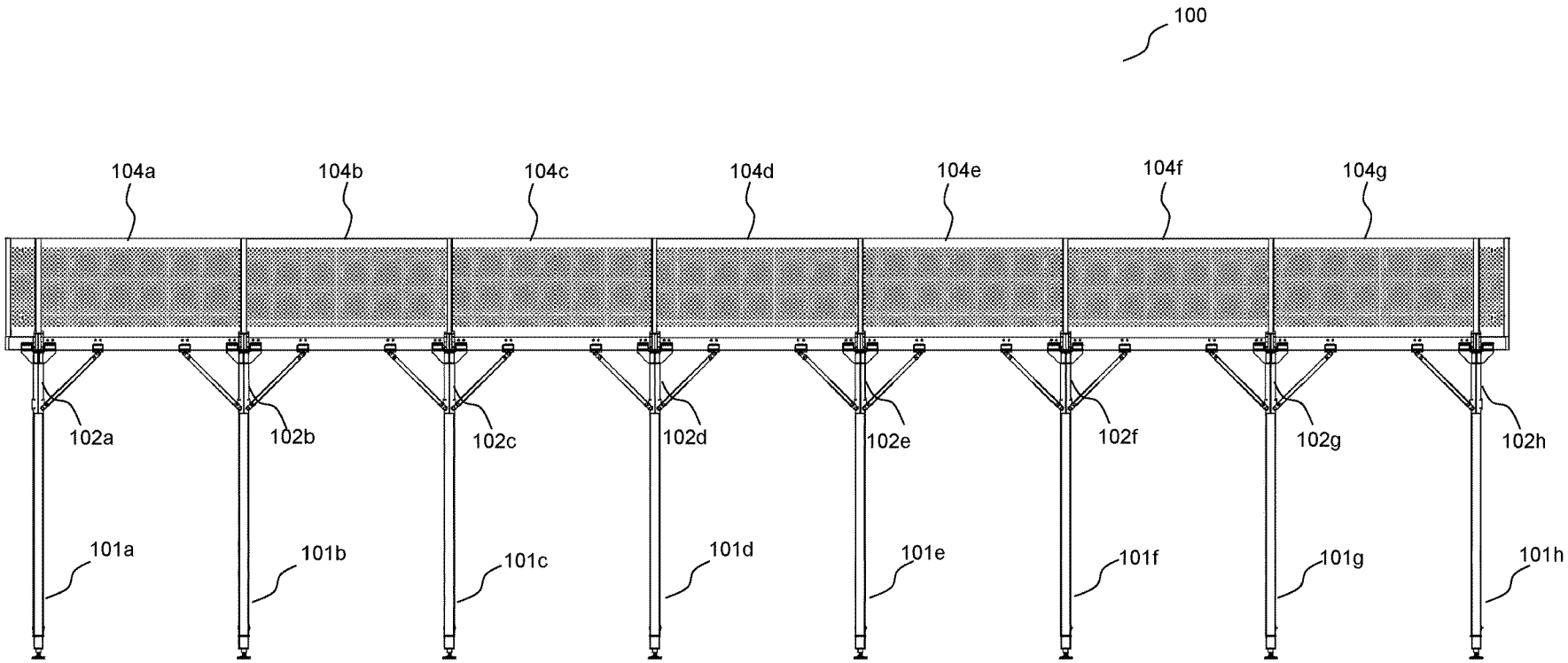
FIG. 2 shows a front view of a sidewalk shed system according to some embodiments of the present disclosure.

FIG. 2 shows a front view of the sidewalk shed system 100 according to some embodiments of the present disclosure. Each section includes a parapet 104 which is configured to operate as a safety fence or barrier to prevent construction workers from falling off the platform 103 (not shown). The platform is held up by center rods 101, which are connected to various plus parts 102. While the sidewalk shed system 100 as shown in FIGS. 1 and 2 has seven sections, the disclosed system is not limited to seven sections and can have greater of fewer sections depending on the particular application.

Figure 3:
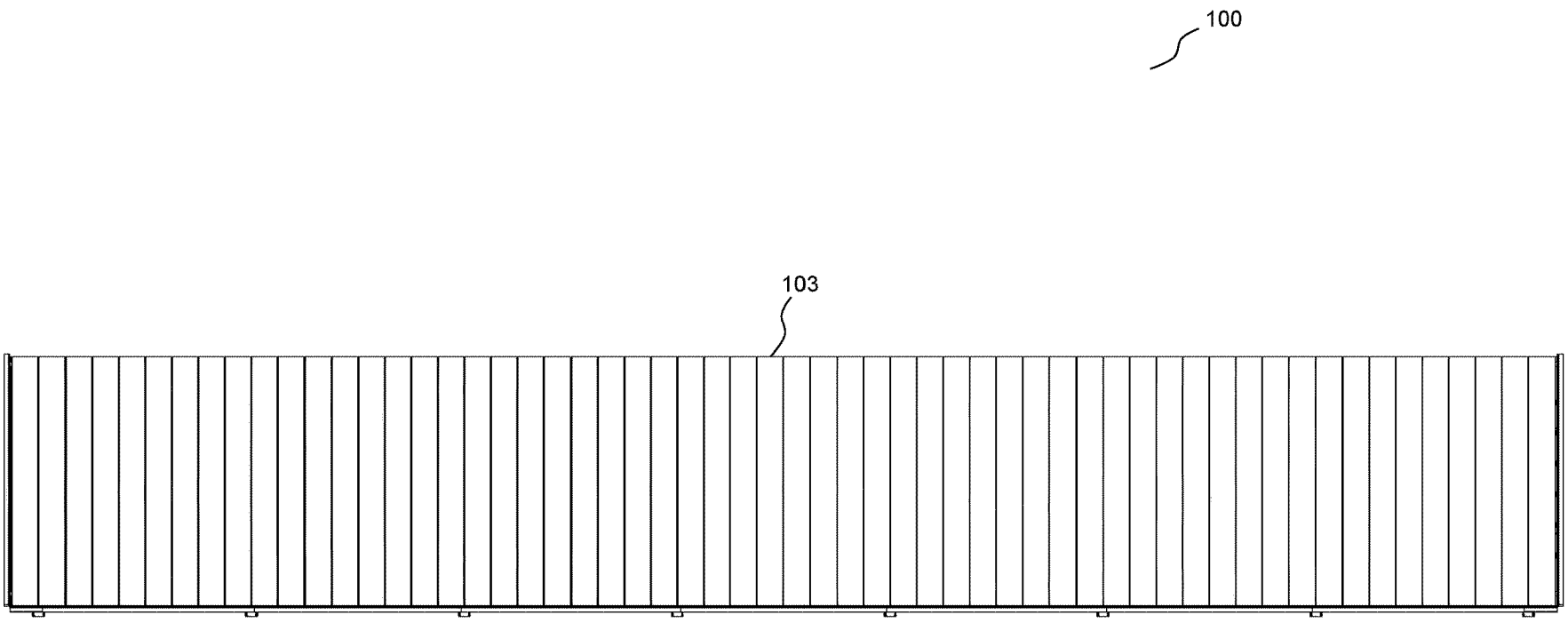
FIG. 3 shows a top view of a sidewalk shed system according to some embodiments of the present disclosure.

FIG. 3 shows a top view of the sidewalk shed system 100 according to some embodiments of the present disclosure. The platform 103 includes various planks. In some embodiments, the planks can be wooden.

Figure 4:
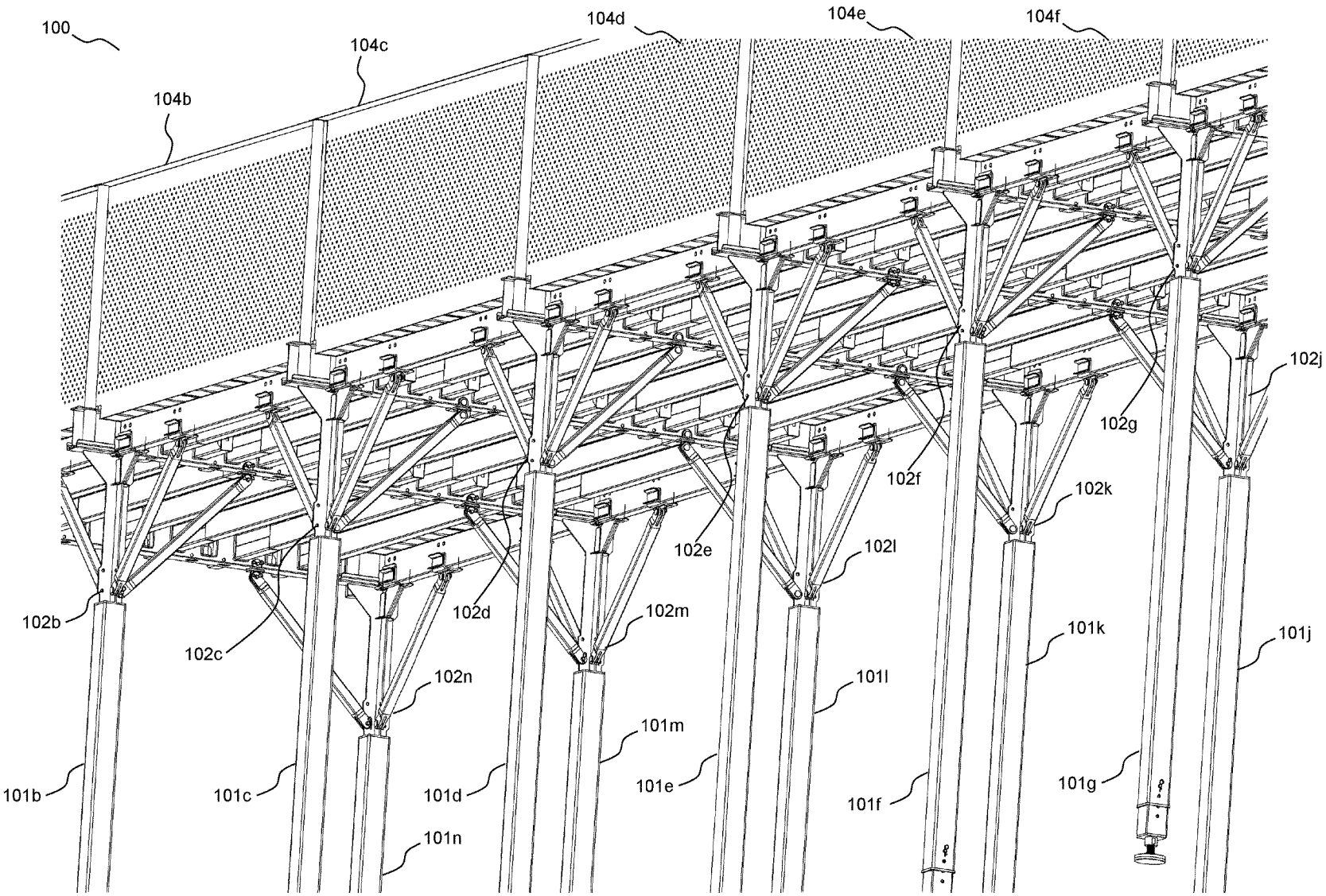
FIG. 4 shows another perspective view of a sidewalk shed system according to some embodiments of the present disclosure.

FIG. 4 shows another perspective view of the sidewalk shed system 100 according to some embodiments of the present disclosure. In the view shown in FIG. 4, both rows of center rods 101 and plus parts 102 are shown, as the platform 103 (not shown) is supported both in the front by a row of center rods 101*b-g* and plus parts 102*b-g* and in the back by a second row of center rods 101*j-n* and plus parts 102*j-n*.

Figure 5A:
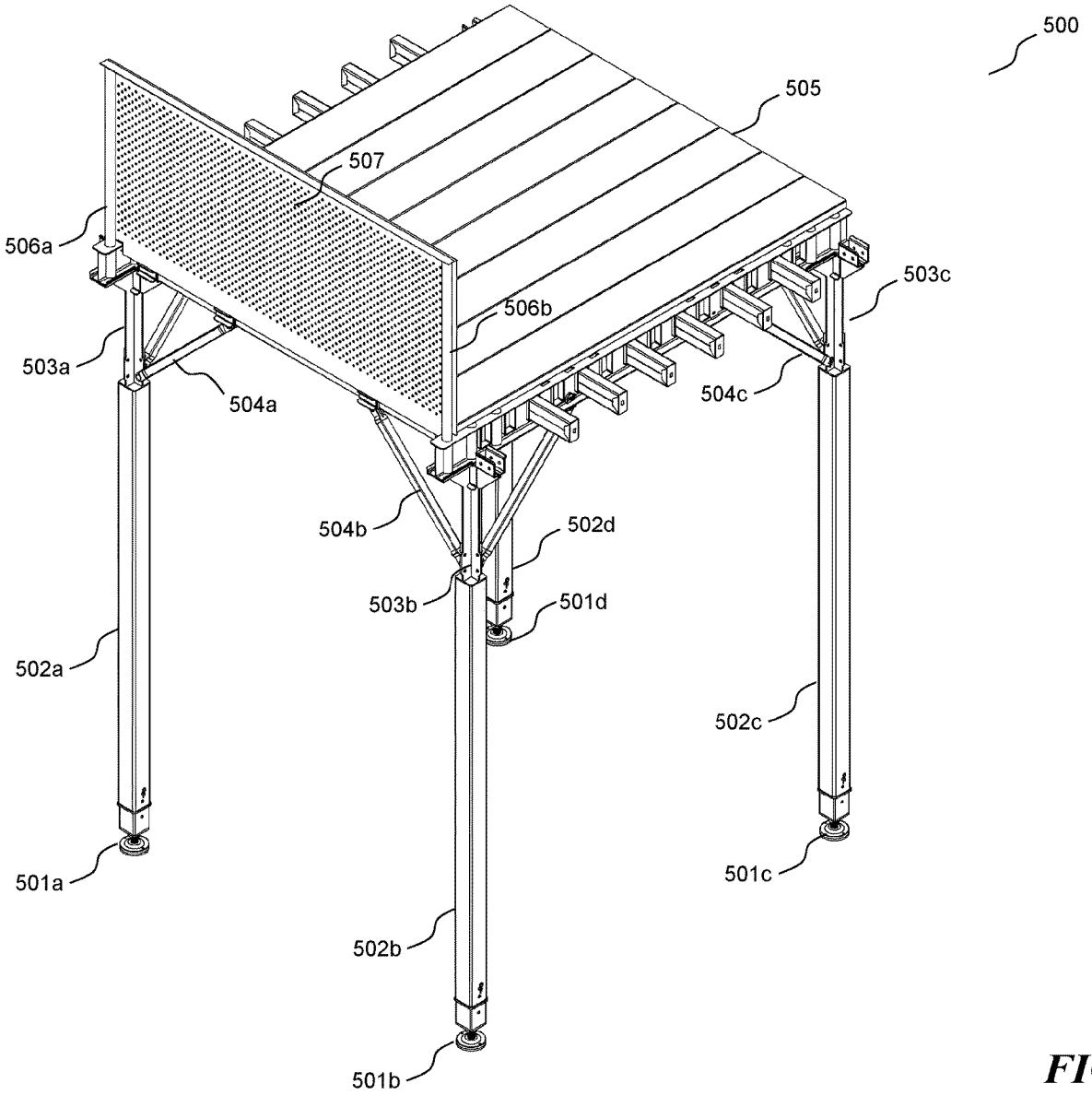
FIG. 5A shows a perspective view of sidewalk shed section according to some embodiments of the present disclosure.
Figure 5B:
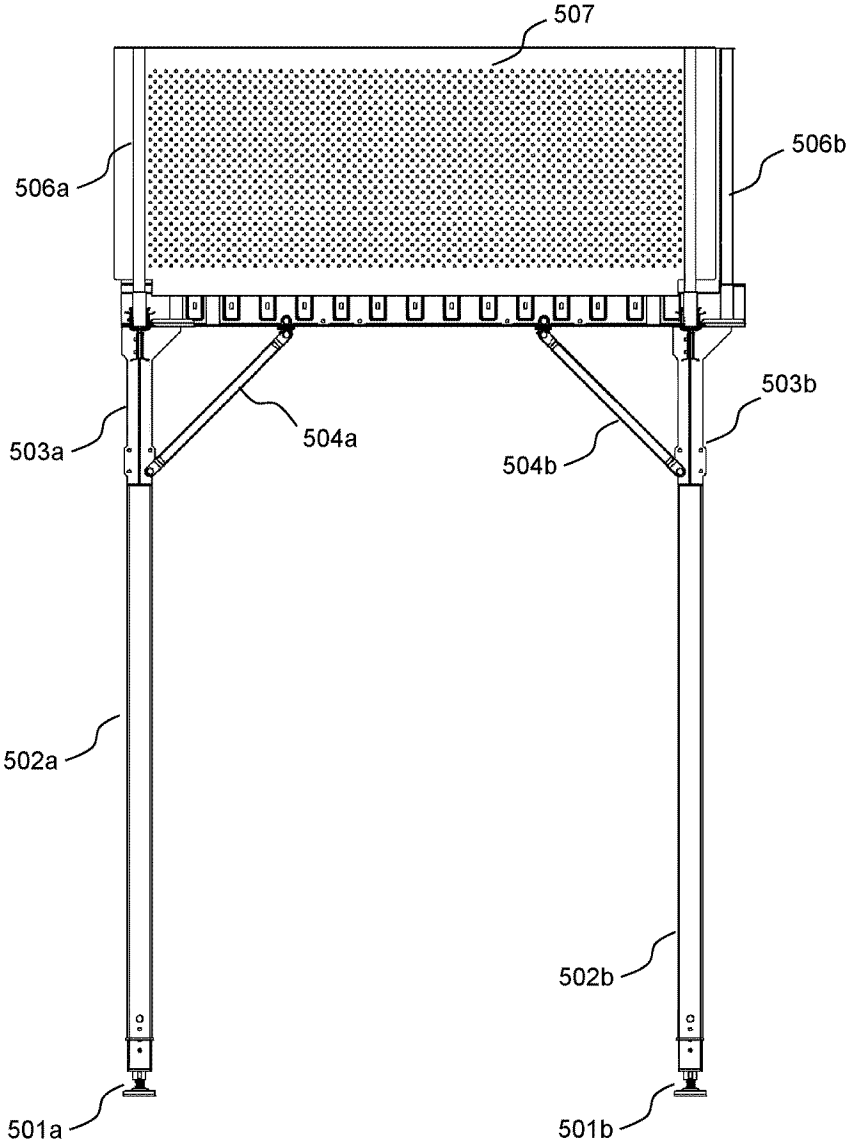
FIG. 5B shows a front view of a sidewalk shed section according to some embodiments of the present disclosure.

FIG. 5A shows a perspective view of sidewalk shed section 500 according to some embodiments of the present disclosure. FIG. 5B shows a front view of the sidewalk shed section 500 according to some embodiments of the present disclosure. The sidewalk shed section 500 four supporting "legs", one at each corner. Each "leg" includes a base 501 (501*a*-501*d*) and a center rod 502 (502*a-d*) attached to the base 501. In some embodiments, a base 501 can be a threaded rod (e.g., screw) and base, where the rod can screw into a receiving slot in the center rod 502. In addition, a center rod 502 is connected to a plus part 503 (503*a-c*). Various braces 504 can connect to the bottom portion of each plus part 503 and the underside of header beams and senior beams, which will be described in greater detail with respect to FIG. 21E. The braces 504 provide support to the platform 505 for functioning as a walking surface for workers. In addition, the sidewalk shed section 500 includes a parapet 507 that is connected to and supported by parapet rods 506*a* and 506*b*. There are additional components in the sidewalk shed section 500 that will be discussed in subsequent figures.

Figure 6:
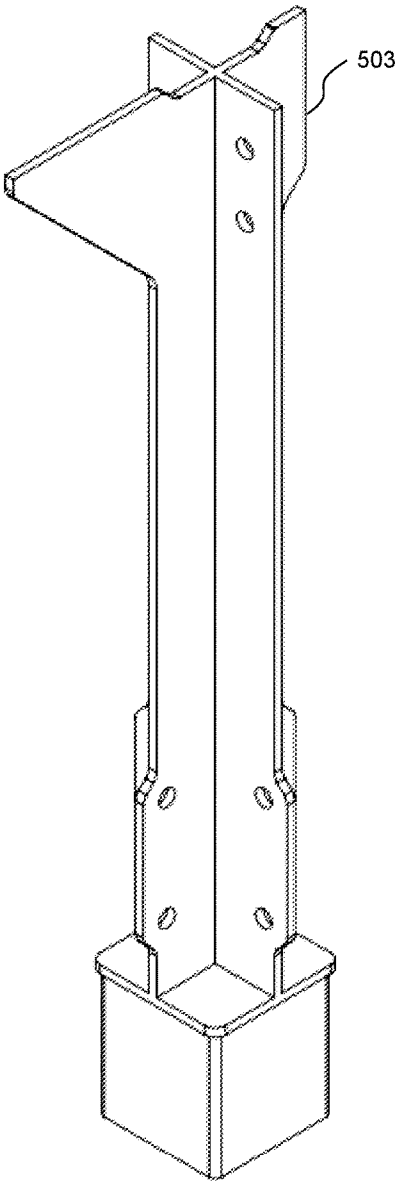
FIG. 6 shows an example plus part according to some embodiments of the present disclosure.

FIG. 6 shows an example plus part 503 according to some embodiments of the present disclosure. In some embodiments, at least a portion of the plus part 503 is rectangular/square in shape. The rectangular/square portion enables the plus part 503 to be connected to a center rod 502. It is important to note that this portion may not necessarily be rectangular or square but may just be the same shape as the connecting center rod 502. The other portion of the plus part 503 is plus-shaped. In some embodiments, the plus-shaped portion of the plus part 503 can be about ⅔ of the length of the part. The plus-shaped portion can include various flanges on the top of bottom with holes to receive pins and facilitate connections to various other components.

Figure 7:
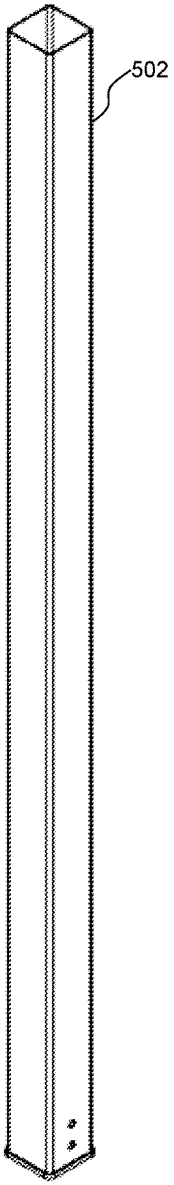
FIG. 7 shows an example center rod according to some embodiments of the present disclosure.

FIG. 7 shows an example center rod 502 according to some embodiments of the present disclosure. At one end (the bottom), the center rod 502 is configured to receive a base 501 (e.g., via a threaded slot) and includes one or more holes (e.g., two holes) to secure connection to the base 501, such as via a pin. The top portion of the center rod 502 is configured to receive a similarly shaped end of a plus part 503.

Figure 8:
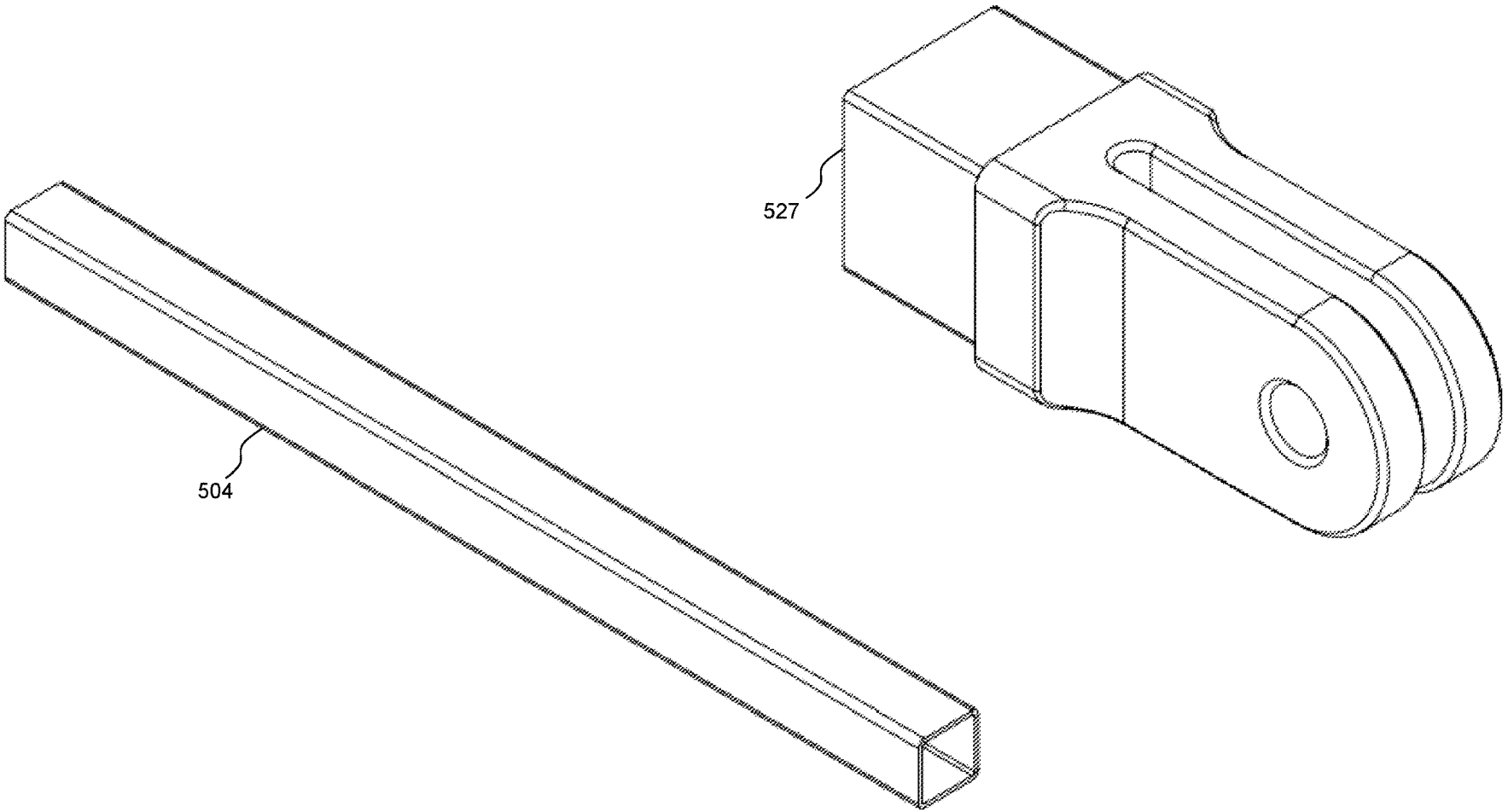
FIG. 8 shows an example brace and bracing cap according to some embodiments of the present disclosure.

FIG. 8 shows an example brace 504 and a bracing cap 527 according to some embodiments of the present disclosure. A brace 504 is configured to be connected to a plus part 503 at one end and a header beam or senior beam at the other end. The connections can be via a bracing cap 527. For example, one square-shaped end of the bracing cap is received by the brace 504 and the other end can be connected to a hole of the plus part 503 via a pin.

Figure 9:
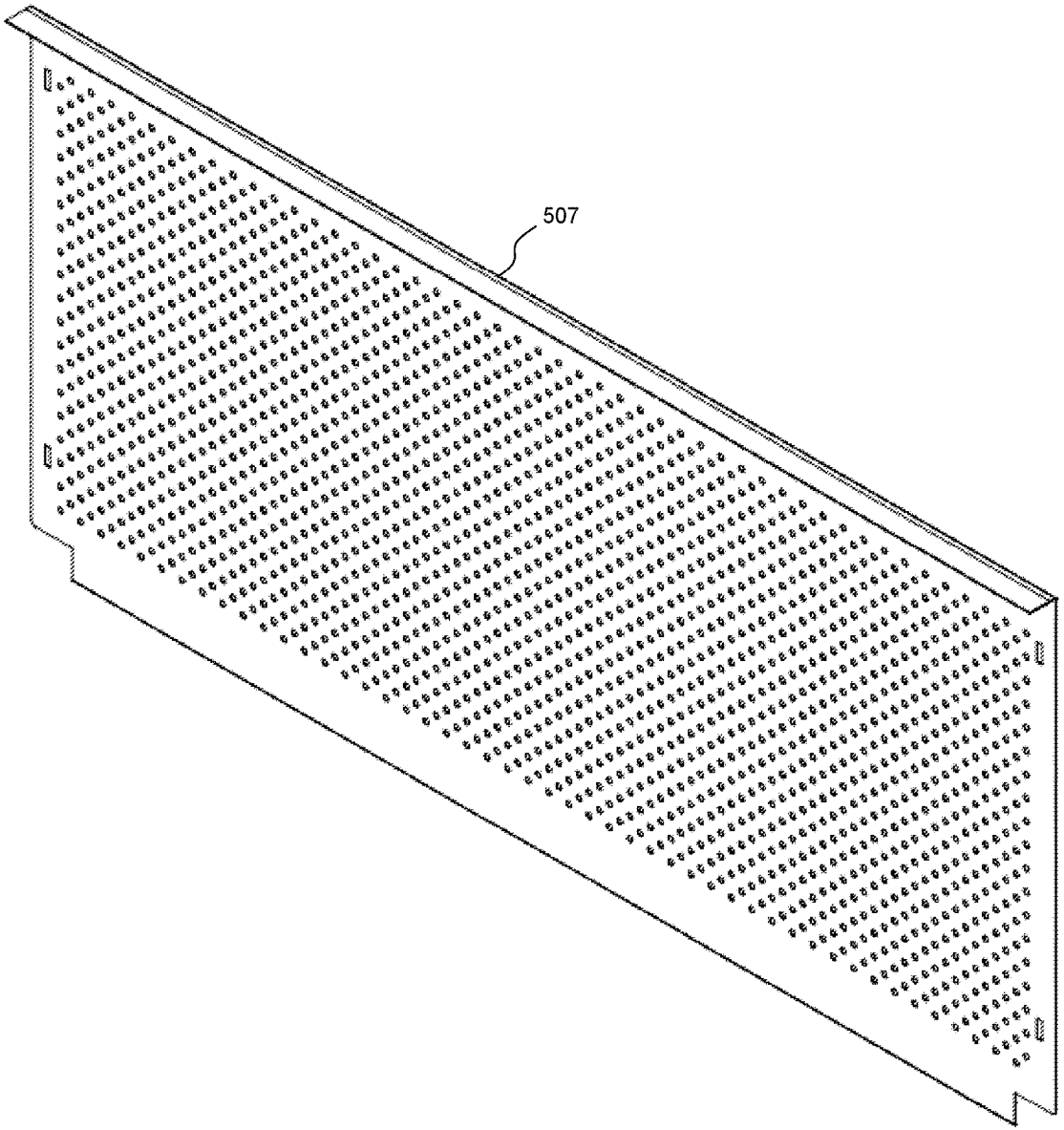
FIG. 9 shows an example parapet according to some embodiments of the present disclosure.
Figure 10:
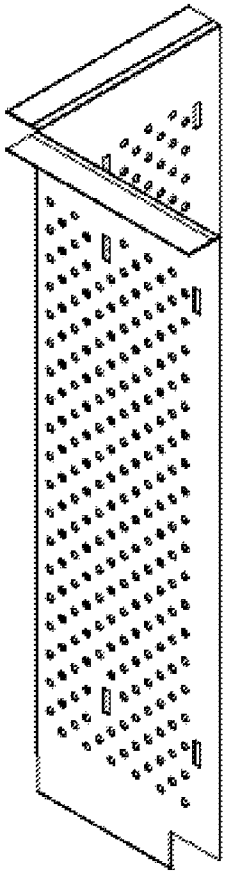
FIG. 10 shows an example corner parapet according to some embodiments of the present disclosure.
Figure 11:
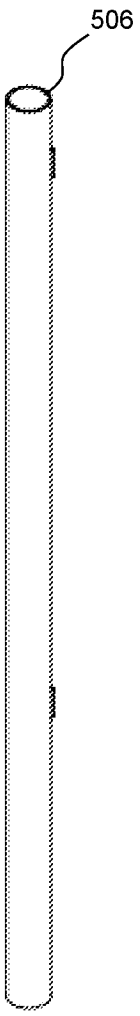
FIG. 11 shows an example parapet rod according to some embodiments of the present disclosure.

FIG. 9 shows an example parapet 507 according to some embodiments of the present disclosure. In some embodiments, the parapet 507 is made of metal such as aluminum. In addition, as shown in FIG. 9, the parapet 507 can be perforated, although this is not required. The parapet 507 can be used as either a front barrier or a side barrier and is connectable to parapet rods on either side via two or more slots. FIG. 10 shows an example corner parapet according to some embodiments of the present disclosure. A corner parapet can connect to a front parapet and side parapet to close gaps in the corner of the disclosed sidewalk shed systems. In some embodiments, a corner parapet can also be perforated. FIG. 11 shows an example parapet rod 506 according to some embodiments of the present disclosure. A parapet rod 506 is configured to attach to a header beam by insertion into a header beam hole (details to be discussed in subsequent figures). Additionally, a parapet rod 506 is configured to receive and attach to a parapet, such as via a small flange to receive a parapet slot. Such a connection creates a protection barrier for employees on the platform of the sidewalk shed section 500.

Figure 12A:
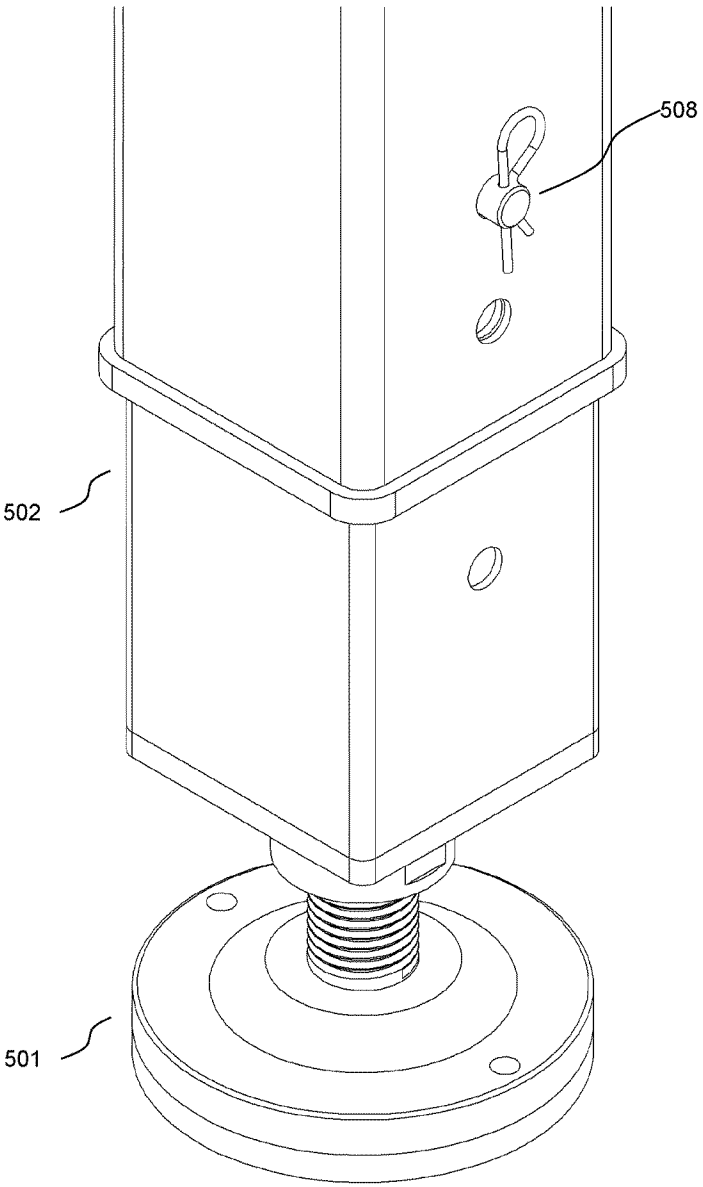
FIGS. 12A-12B shows the bottom of a center rod according to some embodiments of the present disclosure.
Figure 12B:
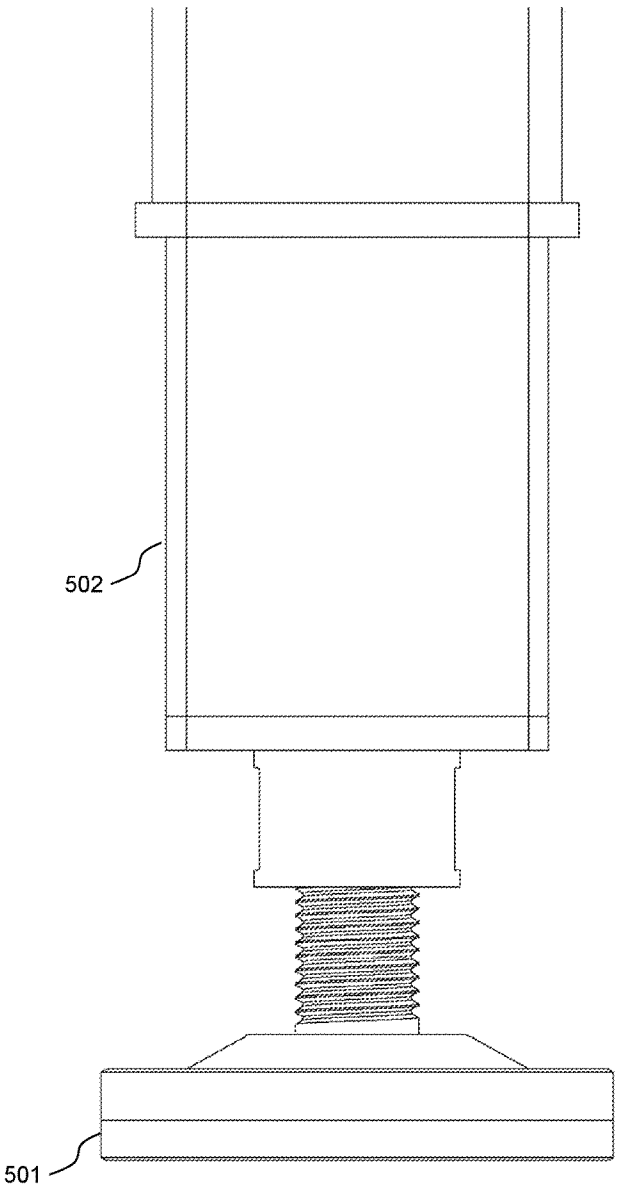

FIGS. 12A-12B shows the bottom of a center rod 502 according to some embodiments of the present disclosure. FIG. 12A shows a perspective view, while FIG. 12B shows a side view. As discussed above, the center rod 502 is configured to receive a base 501, such as via a threaded rod and threaded receiving slot. In other words, the base 501 can be screwed into the center rod 502. In some embodiments, the end of the base 501 (the end that resides within the center rod 502) can include a hole in which a pin 508 can be received. The pin 508 can further secure the base 501 to the center rod 502.

Figure 13:
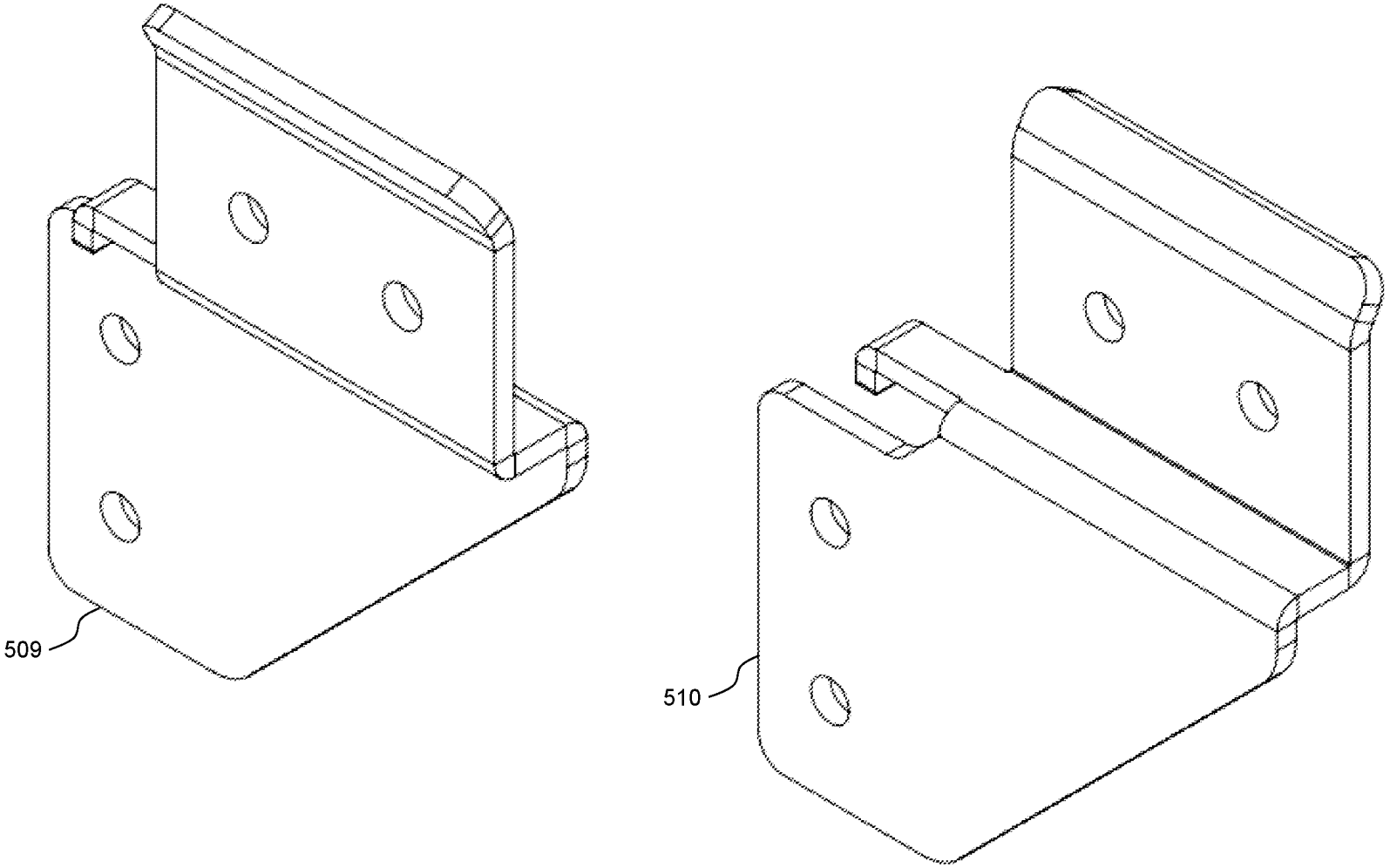
FIG. 13 shows various brackets for use with the sidewalk shed system of FIG. 1 according to some embodiments of the present disclosure.

FIG. 13 shows various brackets 509 and 510 for use with the sidewalk shed system of FIG. 1 according to some embodiments of the present disclosure. In some embodiments, bracket 509 and bracket mirror 510 can be attached on either side of a flange of a plus part 503 and secured via two pins. For example, the left-side sets of two holes in the bracket 509 and bracket mirror 510 can be aligned with a set of two holes on the plus part 503. A pin can be inserted through each set of aligned holes. The pin can then be secured by various means described herein. Such a connection provides a new connection point for additional components (see FIGS. 18-20).

Figure 14:
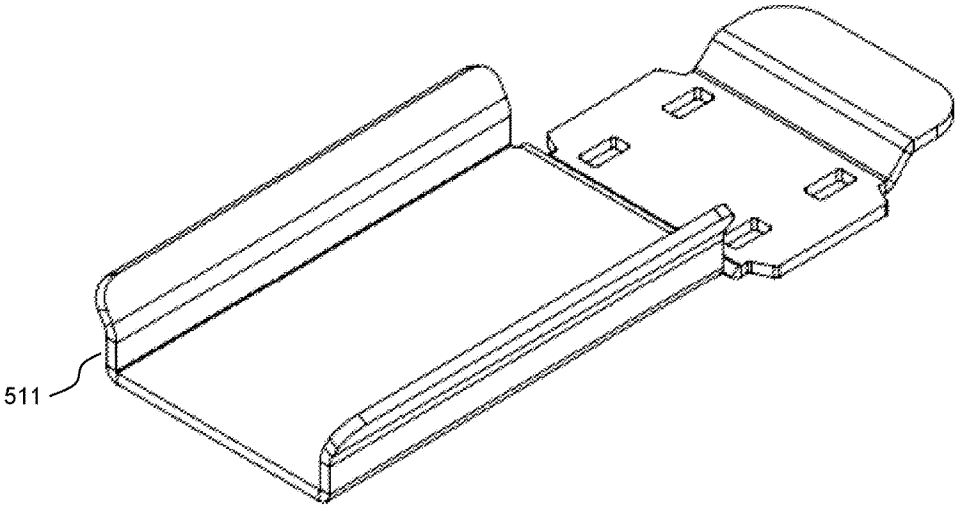
FIG. 14 shows a header plate for use with the sidewalk shed system of FIG. 1 according to some embodiments of the present disclosure.
Figure 15:
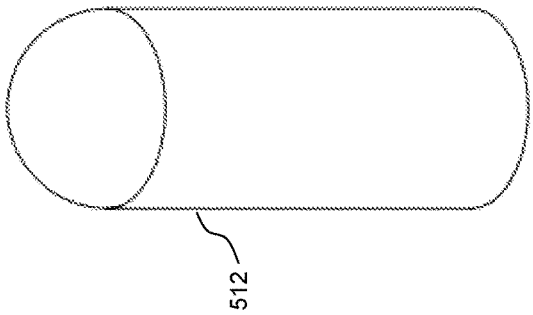
FIG. 15 shows a rod header for use with the sidewalk shed system of FIG. 1 according to some embodiments of the present disclosure.

FIG. 14 shows a header plate 511 for use with the sidewalk shed system of FIG. 1 according to some embodiments of the present disclosure. FIG. 15 shows a rod header 512 for use with the sidewalk shed system of FIG. 1 according to some embodiments of the present disclosure. In some embodiments, a header plate 511 can be configured to connect to a plus part 503. The header plate 511 can then receive and serve as a supporting member for the rod header 512. Additional details with respect to the header plate 511 and the rod header 512 are discussed in FIGS. 18-20.

Figure 17:
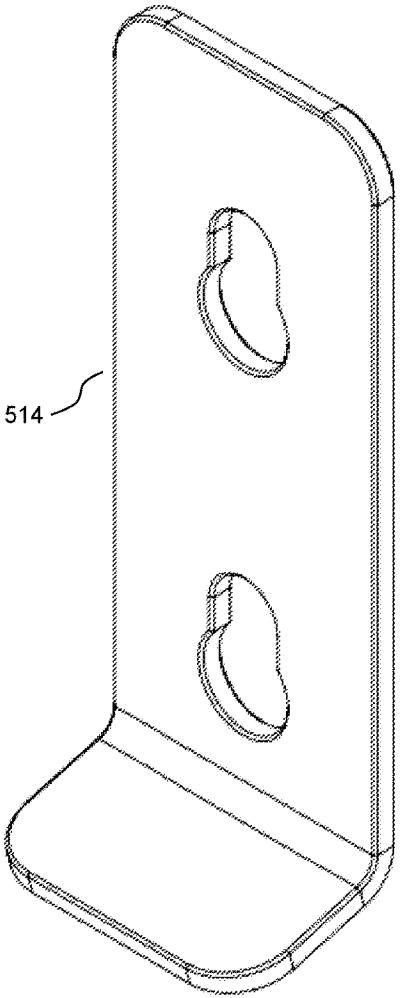
FIG. 17 shows a locker for use with the sidewalk shed system of FIG. 1 according to some embodiments of the present disclosure.
Figure 16:
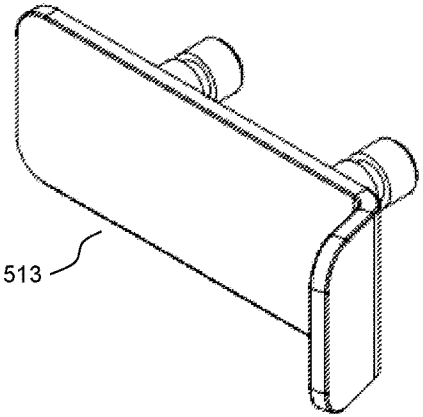
FIG. 16 shows a pin plate for use with the sidewalk shed system of FIG. 1 according to some embodiments of the present disclosure.

FIG. 16 shows a pin plate 513 for use with the sidewalk shed system of FIG. 1 according to some embodiments of the present disclosure. FIG. 17 shows a locker 514 for use with the sidewalk shed system of FIG. 1 according to some embodiments of the present disclosure. A pin plate 513 and a pin locker 514 combination can be used to connect various components to each other if they have a corresponding set of two holes. The pins of the pin plate 513 can be inserted through holes in one or more components and through holes of the pin locker 514 to secure the connection.

Figure 18A:
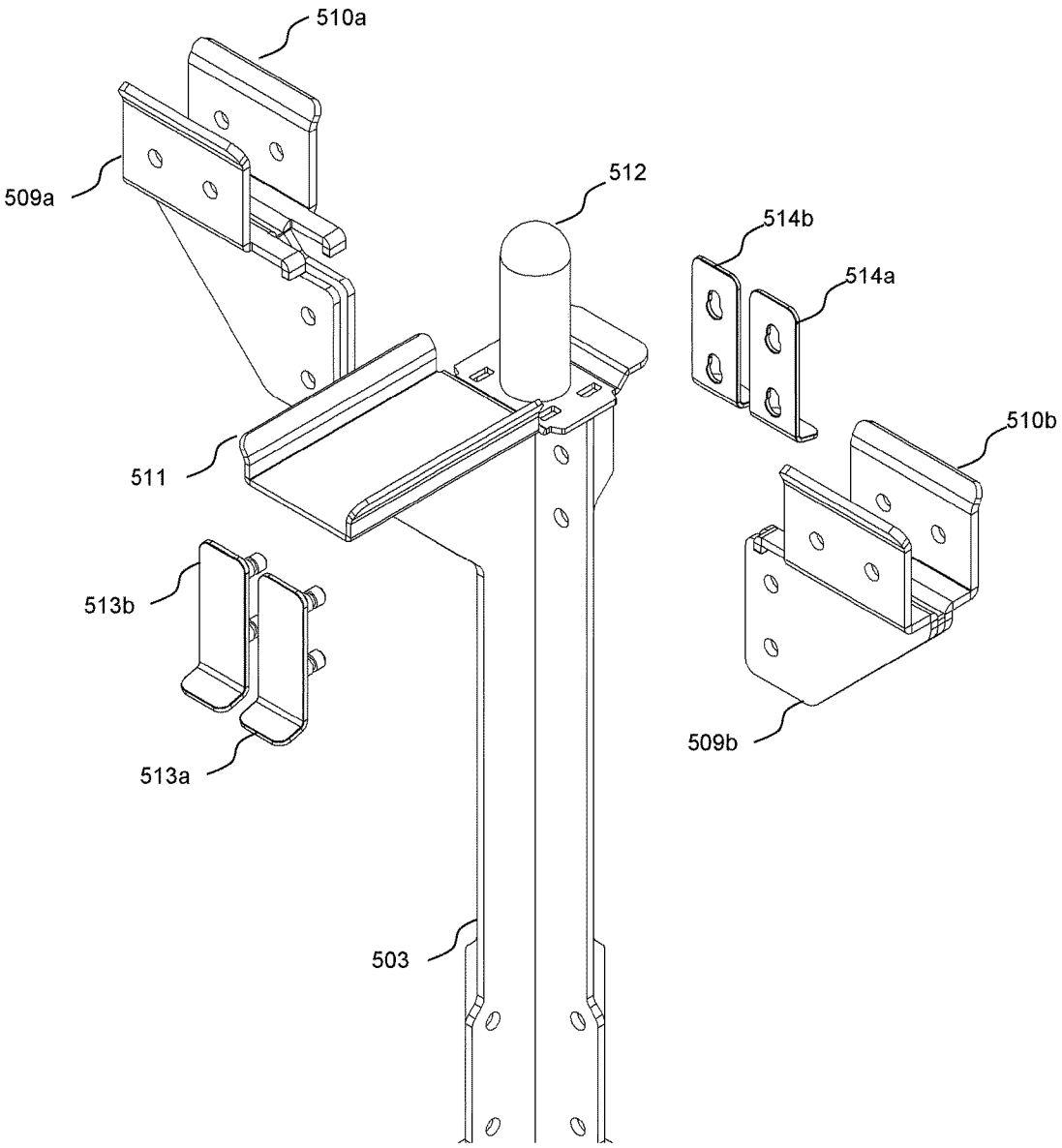
FIGS. 18A-18B show various parts being attached to a plus part according to some embodiments of the present disclosure.
Figure 18B:
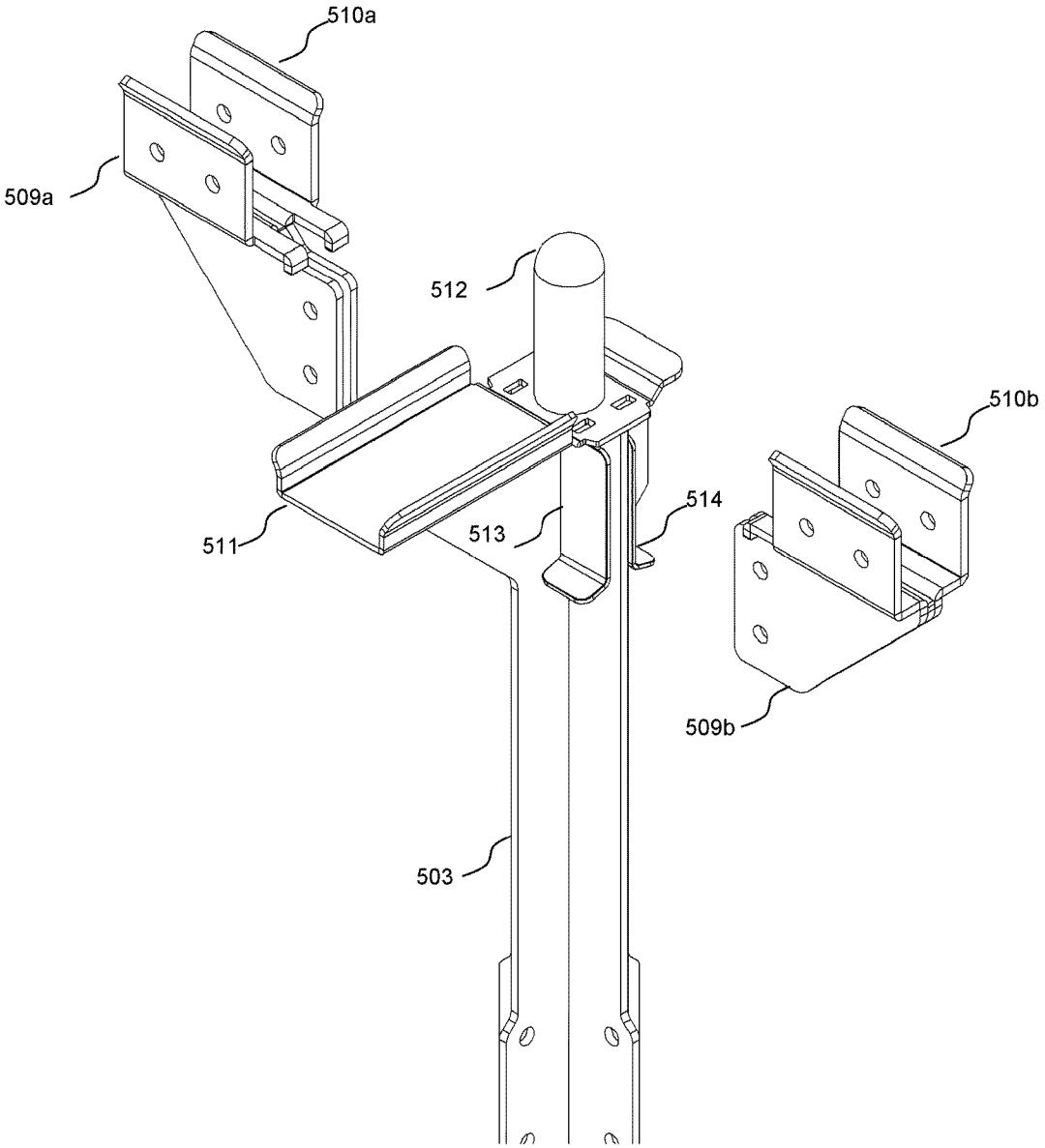

FIGS. 18A-18B shows various parts being attached to a plus part 503 according to some embodiments of the present disclosure (herein referred to as a "leg section"). First, the plus part 503 has a header plate 511 and rod header 512 attached, such as via welding. In addition, the plus part 503 has pin plates 513 and lockers 514 secured to each other through two holes in the plus part 503. The pin plate 513 and locker 514 combination can be used to secure the bracket 509 and bracket mirror 510 to the plus part 503.

Figure 19A:
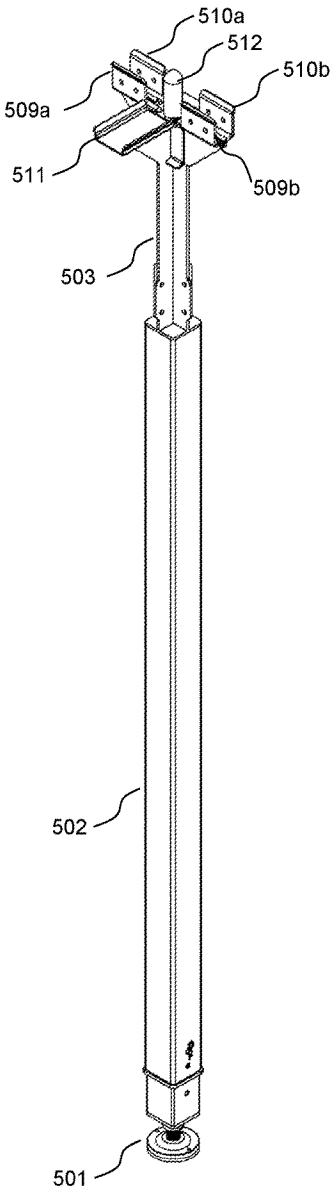
FIG. 19A shows a perspective view of a vertical according to some embodiments of the present disclosure.
Figure 19B:
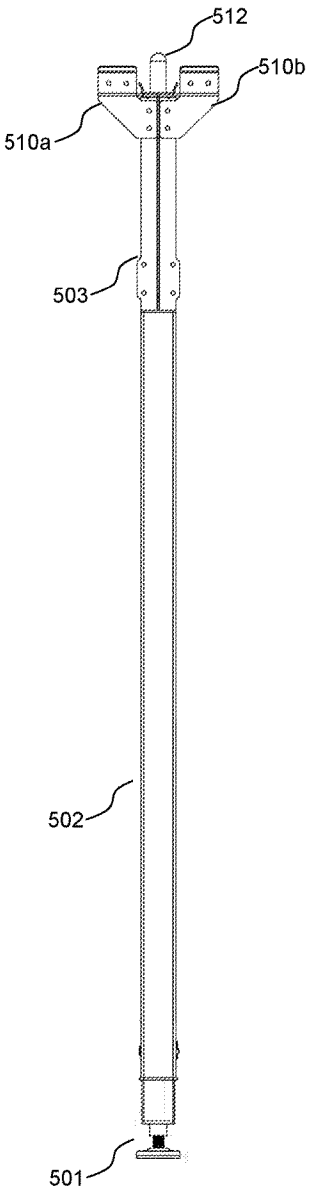
FIG. 19B shows a front view of a vertical according to some embodiments of the present disclosure.

FIG. 19A shows a perspective view of a vertical (herein referred to as a "vertical") according to some embodiments of the present disclosure. FIG. 19B shows a front view of a vertical according to some embodiments of the present disclosure. As shown in the figures, the center rod 502 has a base plot 501 connected to one side and a plus part 503 connected to its opposite side. As discussed in relation to FIGS. 18A-18B, the top, plus-shaped section of the plus part 503 has a set of bracket 509 and bracket mirror 510 combinations attached to either side, each being secured by a pin plate 513 and locker 514 (not shown). In addition, the plus part 503 has a header plate 511 and rod header 512 attached at the top end.

Figure 20A:
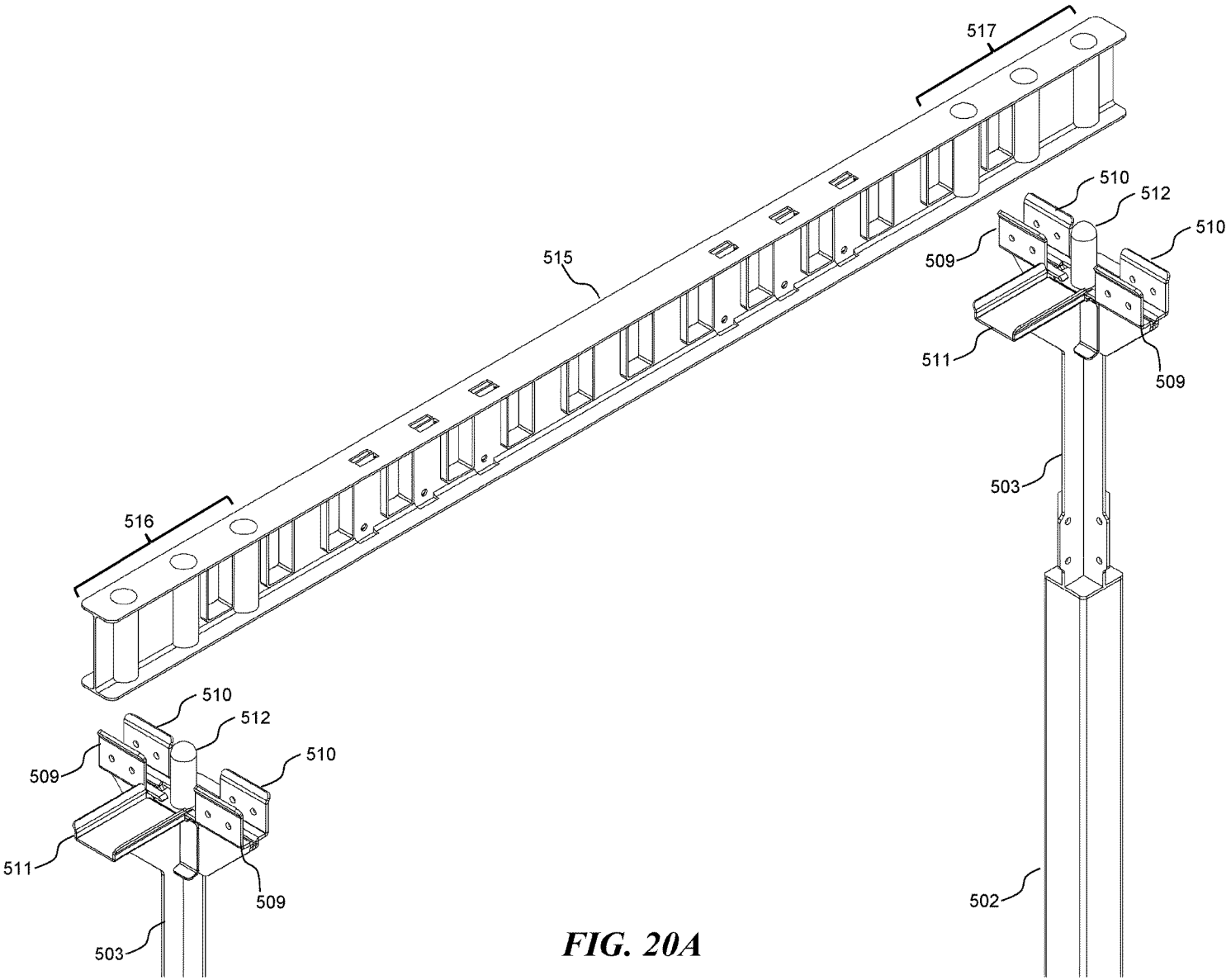
FIG. 20A shows a header beam being connected to two verticals according to some embodiments of the present disclosure.
Figure 20B:
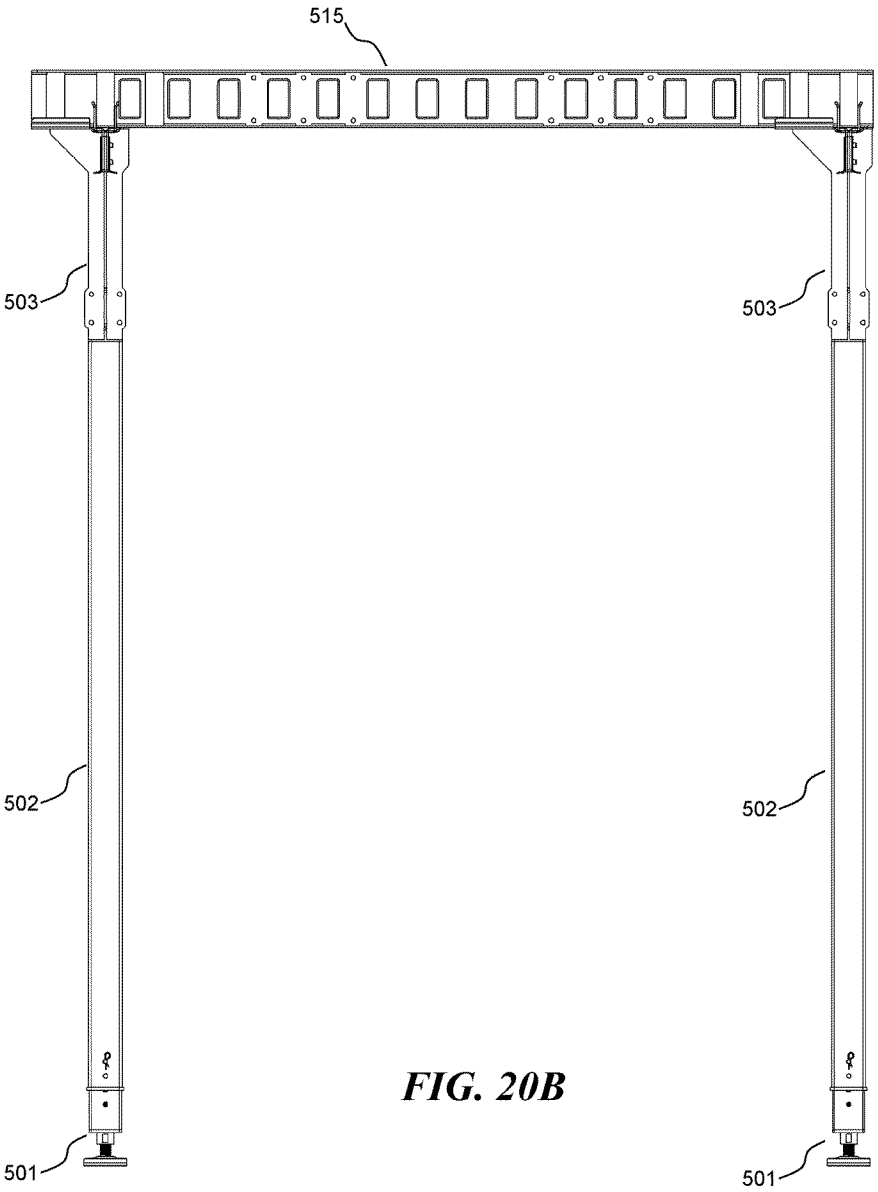
FIG. 20B shows a front view of the header beam connected to two verticals according to some embodiments of the present disclosure.

FIG. 20A shows a header beam 515 being connected to two plus part 503 and center rod 502 combinations (i.e., two "leg sections") according to some embodiments of the present disclosure. FIG. 20B shows a front view of the header beam 515 connected to the two plus part 503 and center rod 502 combinations according to some embodiments of the present disclosure. Each of the plus part 503 and center rod 502 combinations is the same as the setup from FIGS. 19A-19B and contains two sets of brackets 509 and bracket mirrors 510 connected on left and right sides of the plus part 503. In addition, there is a header plate 511 and rod header 512. Essentially, FIG. 20A shows how two of the combinations are used to continue constructing a sidewalk shed section 500. The header beam 515 includes sets of holes 516 and 517 on either side. In some embodiments, each set 516 and 517 includes three holes, although this is not intended to be limiting and any number of holes could be used. Each of the holes is sized to receive a rod header 512. With this in mind, the plus part 503 and center rod 502 combinations can be spaced from each other such that the header beam 515 can be placed onto said combinations and each rod header 512 is received by a hole of 516 and 517, respectively, securing the header beam 515. In some embodiments, the rod header 512 is substantially the same length as the holes (and thus the height of the header beam 515). In addition, as shown in FIG. 20B, the header beam 515 rests on each of the header plates 511 for additional support, both in the vertical and horizontal directions. In addition, the bracket 509 and bracket mirror 510 protrude substantially perpendicularly from the header beam 515, defining a corner and allowing for connections to additional configurations (discussed below in relation to FIGS. 21A-21F).

Figure 21A:
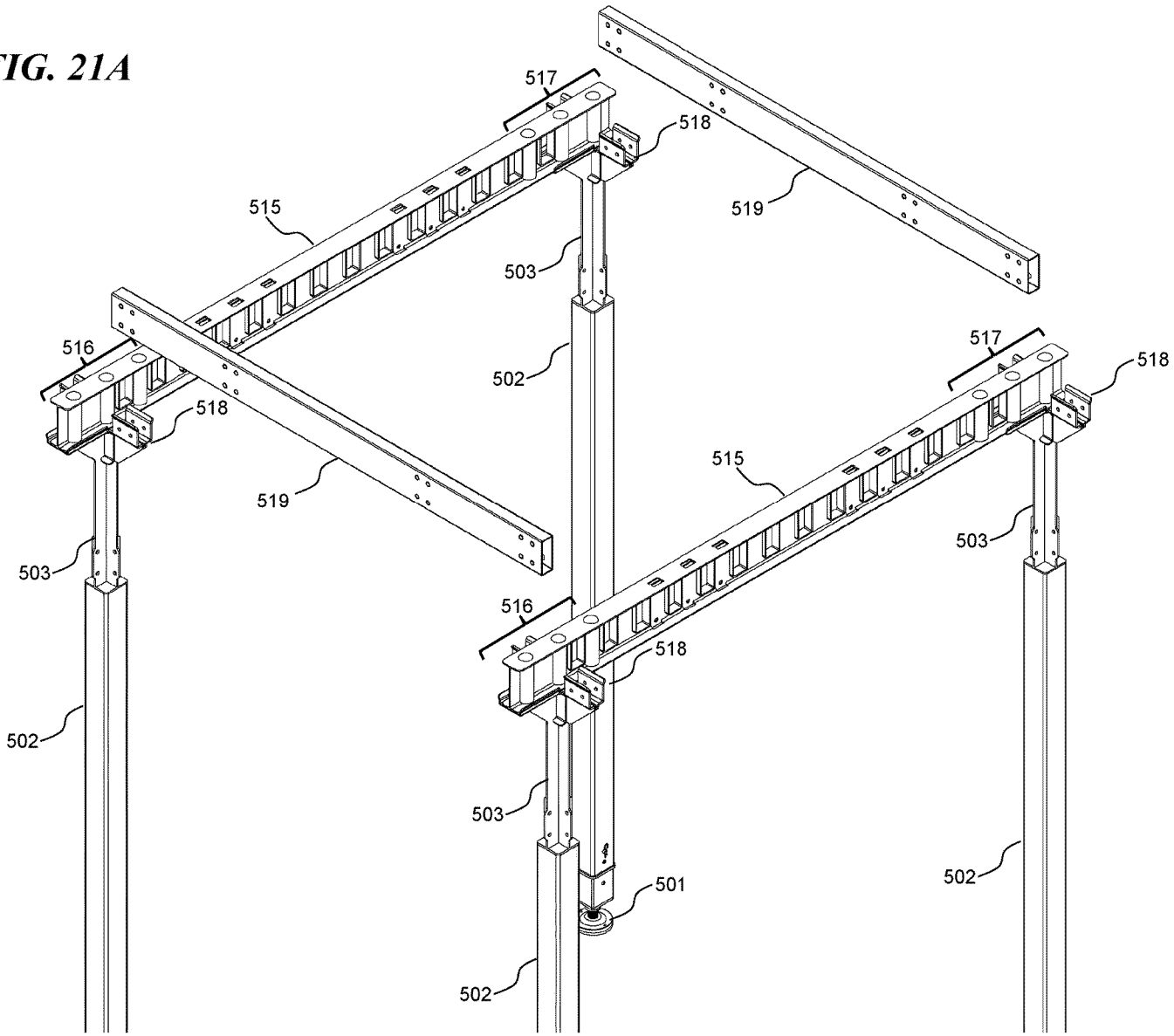
FIGS. 21A-21F shows two senior beams being connected to various verticals according to some embodiments of the present disclosure.
Figure 21B:
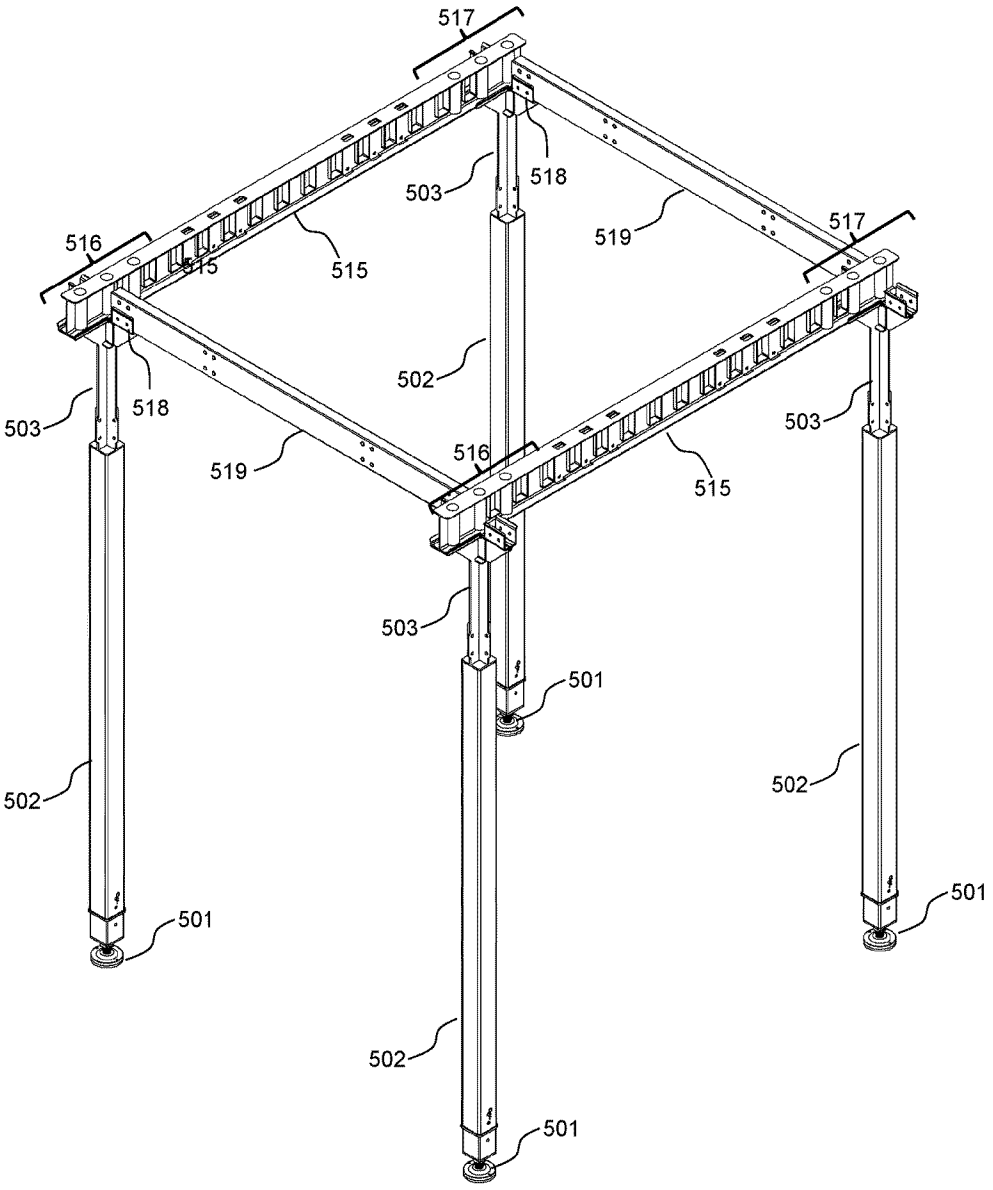
Figure 21C:
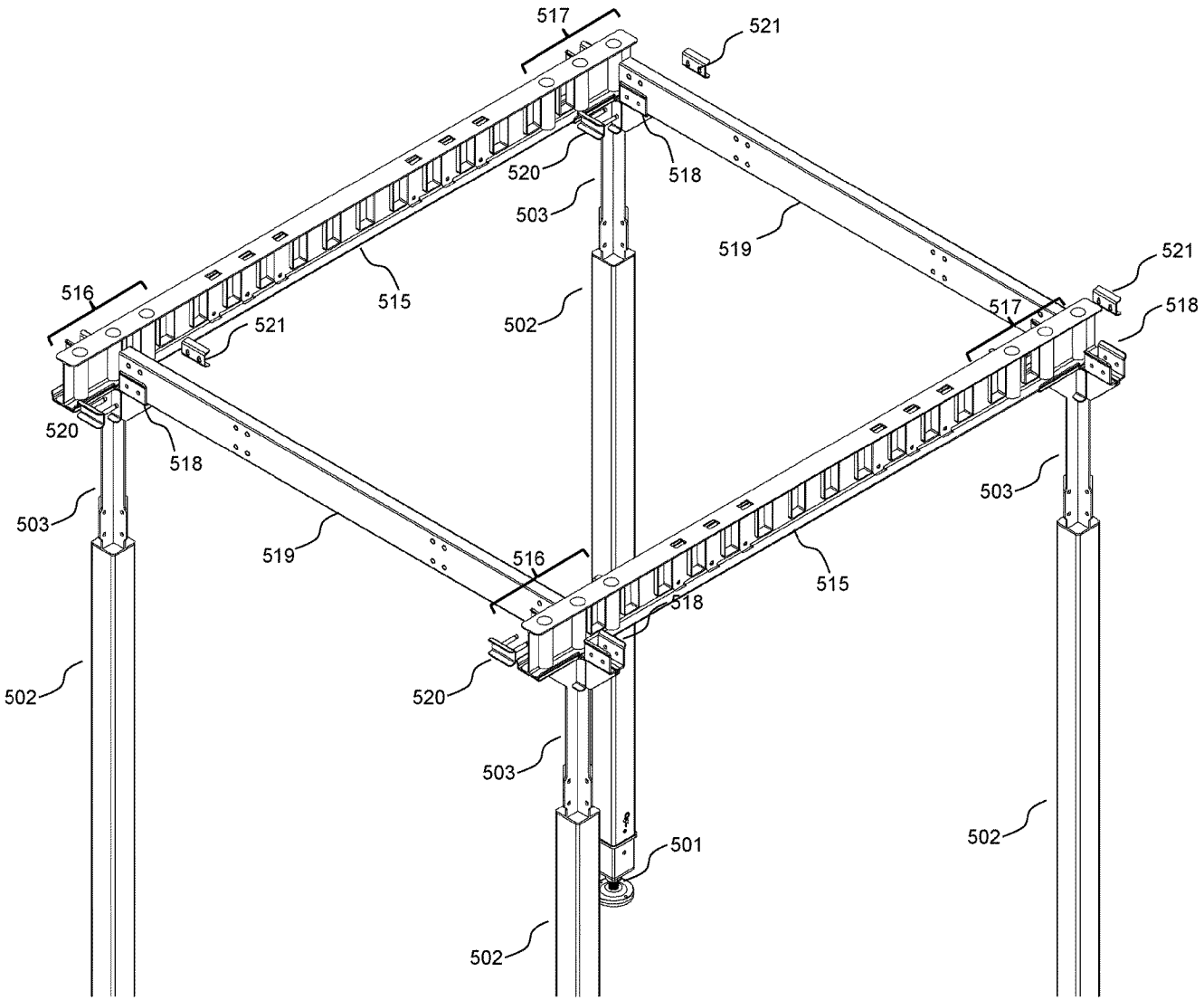
Figure 21D:
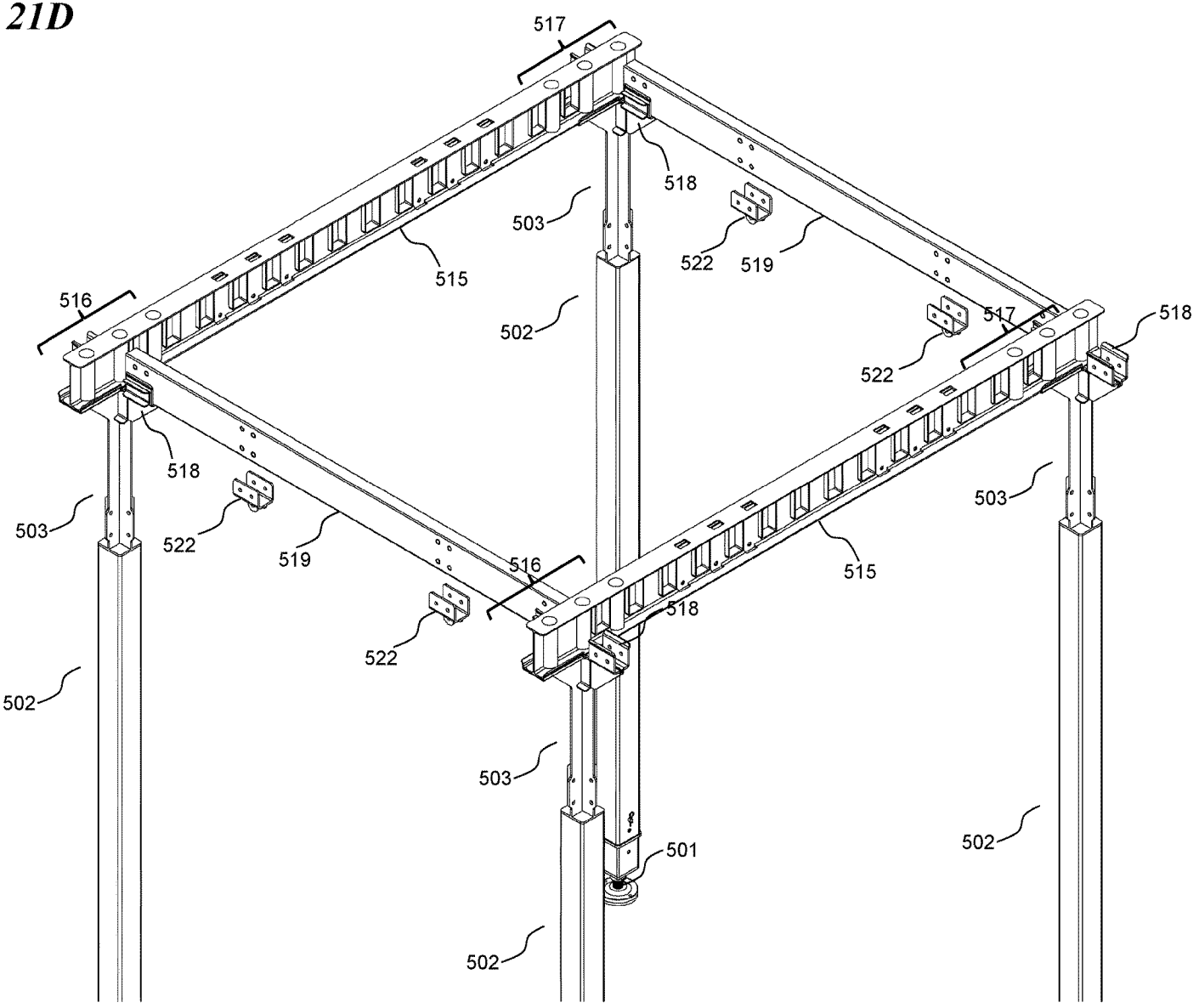
Figure 21E:
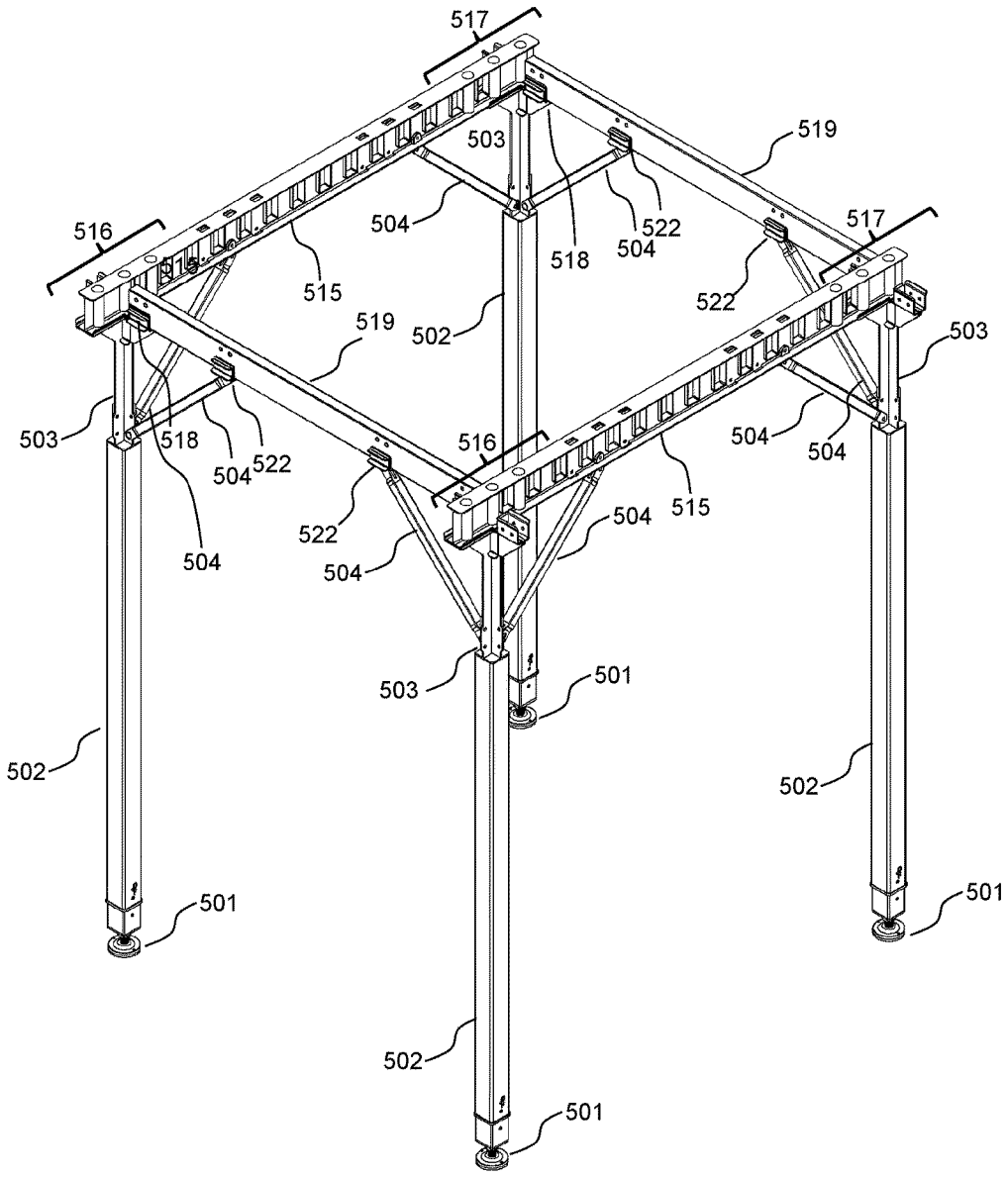
Figure 21F:
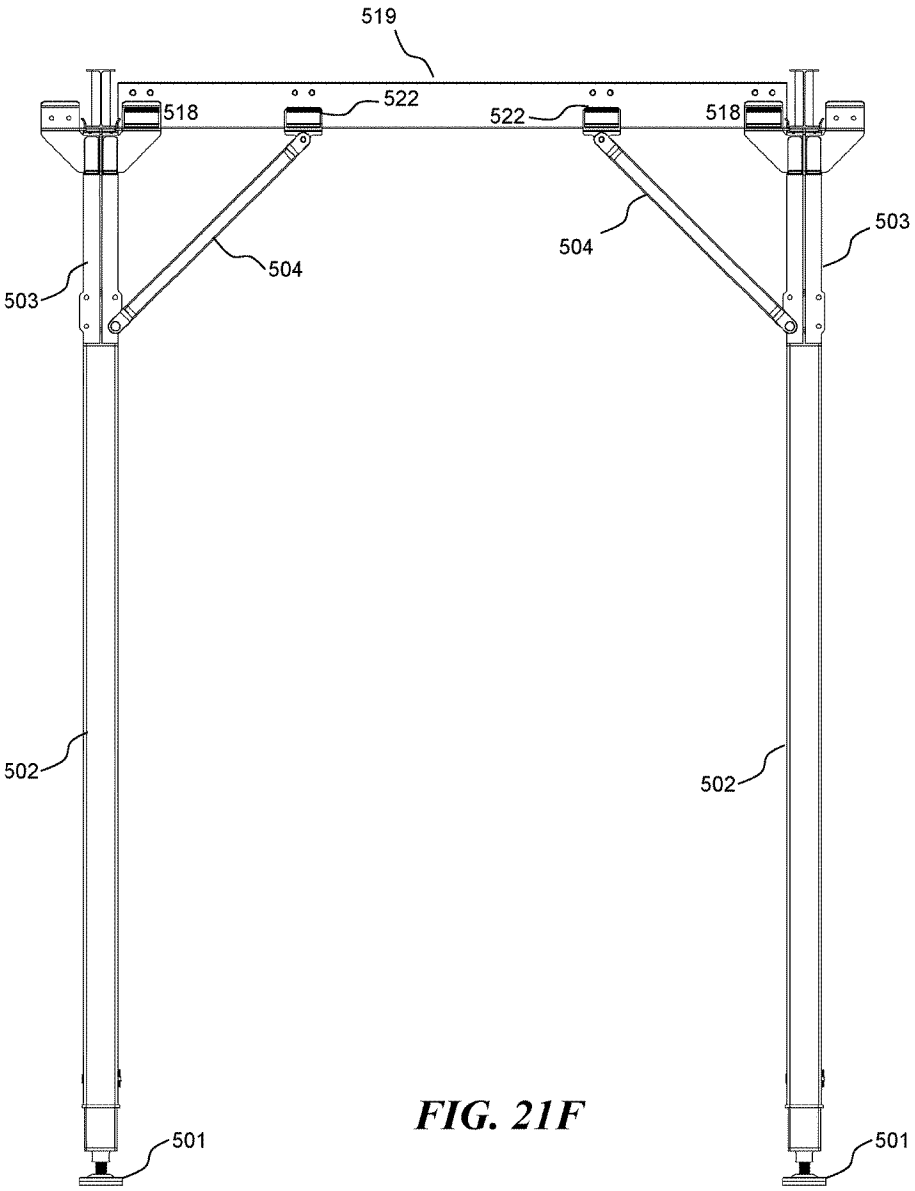

FIGS. 21A-21F shows two senior beams 519 being connected to various plus part 503 and center rod 502 combinations according to some embodiments of the present disclosure. Senior beams 519 are used to connect two of the configurations shown in FIGS. 20A and 20B above. As discussed above, the bracket configuration 518, which is comprised of a bracket 509 and a bracket mirror 510, protrudes substantially perpendicularly from the header beam 515, defining a corner. Multiple corners can thus be connected via a senior beam 519. Each bracket configuration 518 is configured to receive a senior beam 519. In some embodiments, the width of the bracket configuration 518 is slightly larger than the senior beam 519 to allow for a snug fit. In addition, various holes on either side of the senior beam 519 can align with the set of two holes on either side of the bracket configuration 518 (see FIG. 21B). The senior beams 519 can then be secured to the bracket configurations 518 via a senior pin plate 520 and locker 521 (see FIG. 21C). Pins from the senior pin plate 520 are inserted through the aligned holes of the bracket configuration 518 and senior beam 519 and secured via the locker 521. In FIG. 21D, various clamps 522 are attached to the underside of the senior beams 519 (e.g., two clamps 522 are attached to each senior beam 519). Each of the clamps 522 includes two holes that can align with sets of two holes on the senior beam 519. Then, as shown in FIG. 21E, a brace 504 can be connected to the plus part 503 at one end and the clamp 522 at an opposite end. In some embodiments, the brace 504 connections can be made via a bracing cap 527, as discussed in relation to FIG. 8. A bracing cap 527 can be received at each end of the brace 504, and the free ends of the bracing cap 527 can be attached to a hole on the plus part 503 and the clamp 522, respectively. The attachments can then be secured via a pin. In addition, in the adjacent side, the brace 504 is connected (similarly, via a bracing cap 527) to the underside of the header beam 515. FIG. 21F shows a front view of the configuration. Each brace 504 is connected via bracing caps 527 to the clamp 522 of the senior beam 519 at one end and the plus part 503 at an opposite end, providing support to the senior beam 519.

Figure 22:
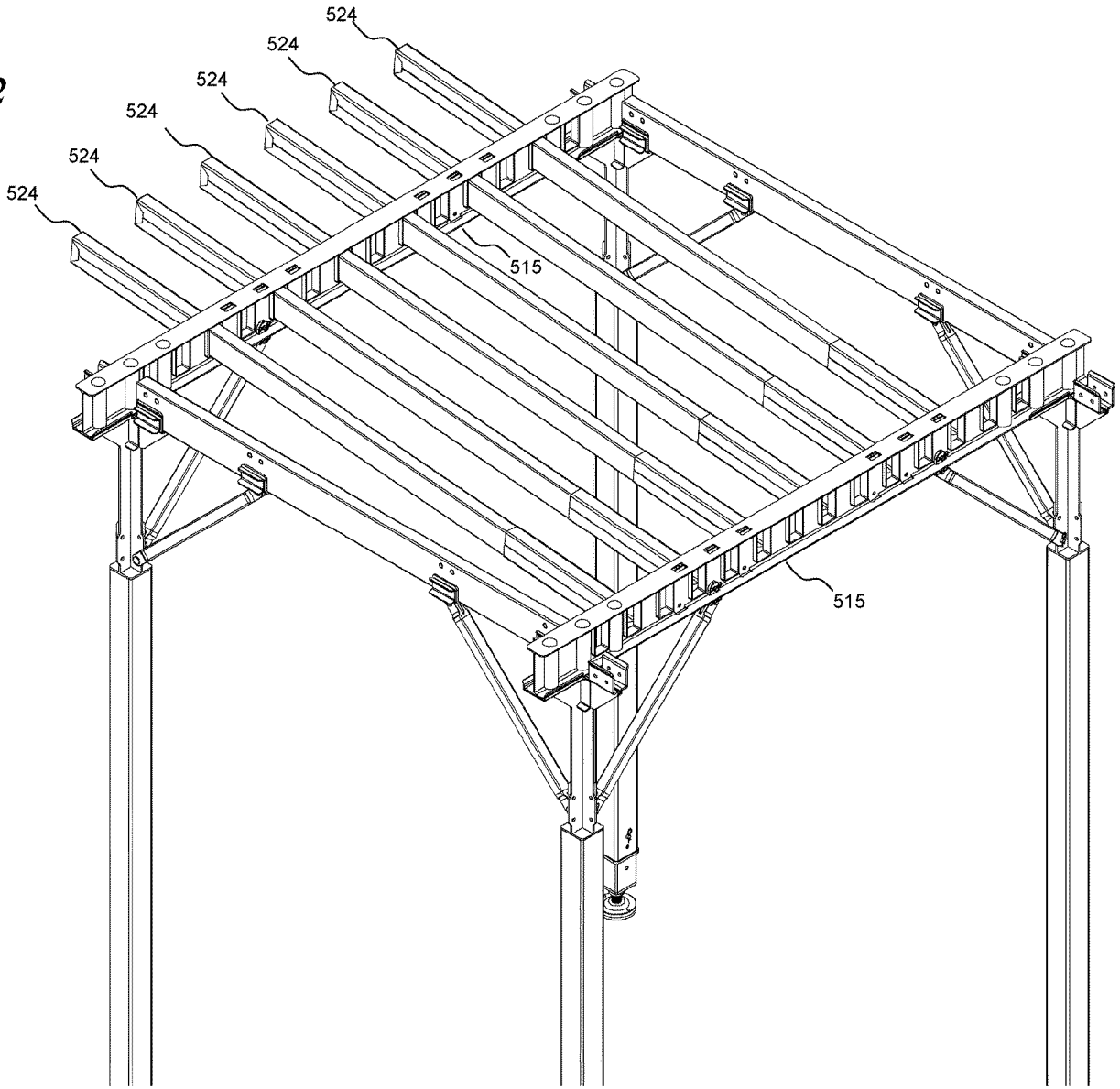
FIG. 22 shows various junior beams being connected to various header beams according to some embodiments of the present disclosure.
Figure 23:
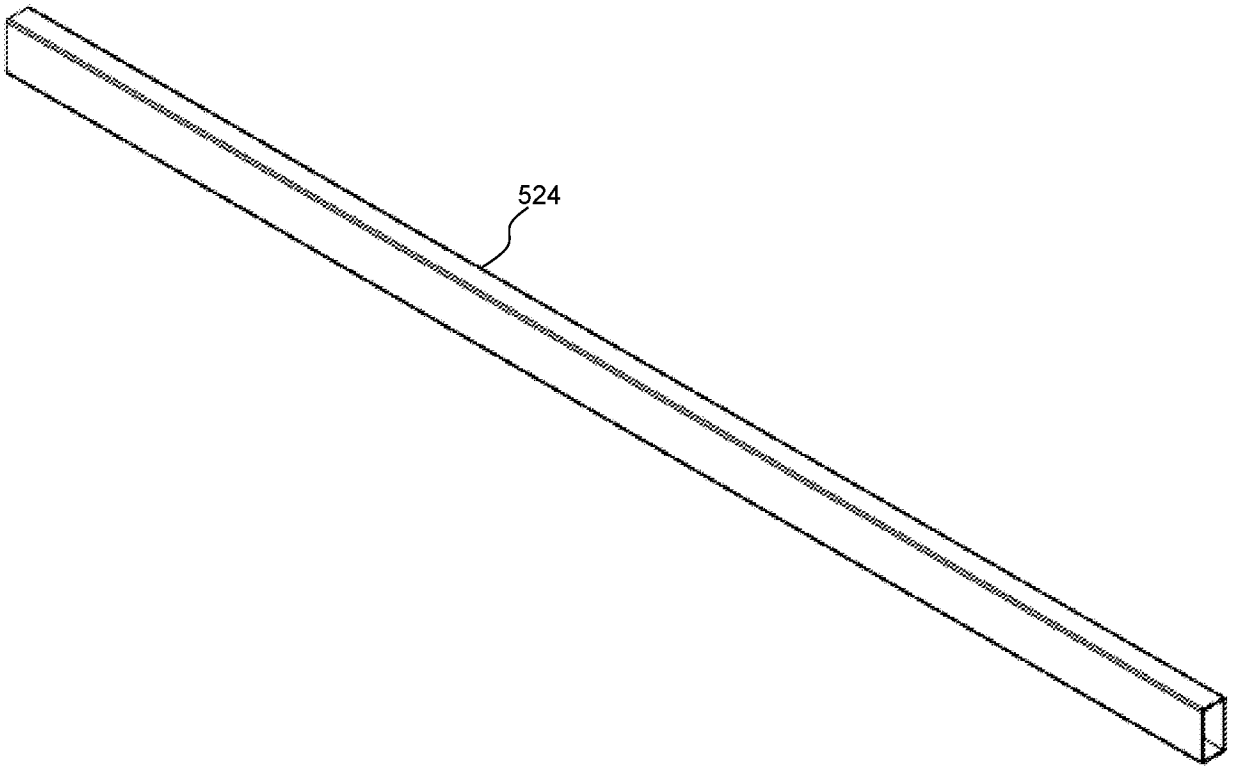
FIG. 23 shows a junior beam according to some embodiments of the present disclosure.
Figure 24:
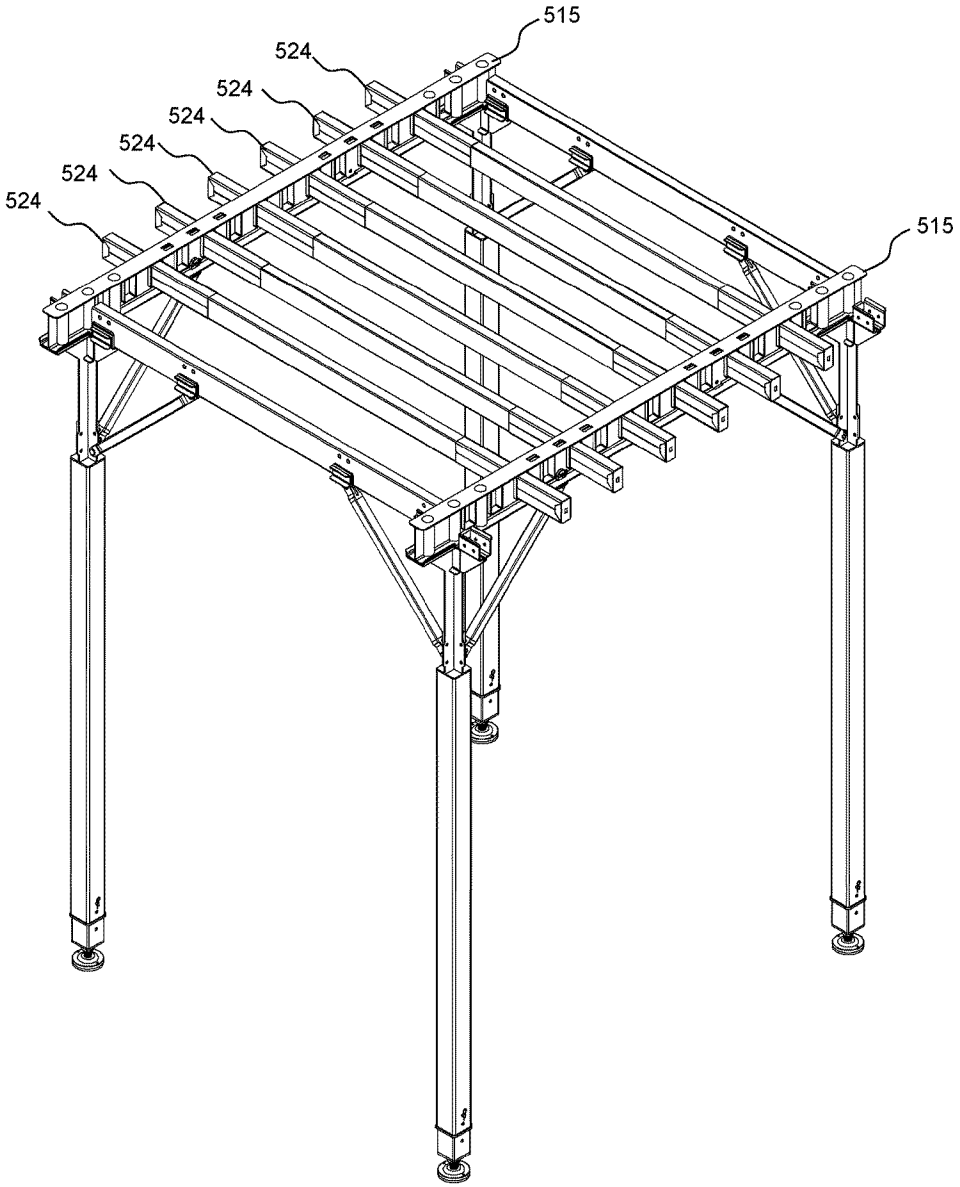
FIG. 24 shows various junior beams connected to various header beams according to some embodiments of the present disclosure.

FIG. 22 shows various junior beams 524 being connected to various header beams 515 according to some embodiments of the present disclosure. FIG. 23 shows a junior beam according to some embodiments of the present disclosure. As shown in FIG. 22 (and other figures in which there is a header beam 515), each header beam 515 has a plurality of slots. A potentially helpful visual comparison could be to a ladder that has "slots" between each rung. The slots of the header beam 515 can be configured to receive a junior beam 524 and may have a slightly larger area than the cross-sectional area of the junior beams 524. A junior beam 524 is long enough such that it can be inserted into opposite slots of each header beam 515 and rest on the header beam 515 (see FIG. 24, which shows various junior beams 524 connected to various header beams according to some embodiments of the present disclosure).

Figure 25:
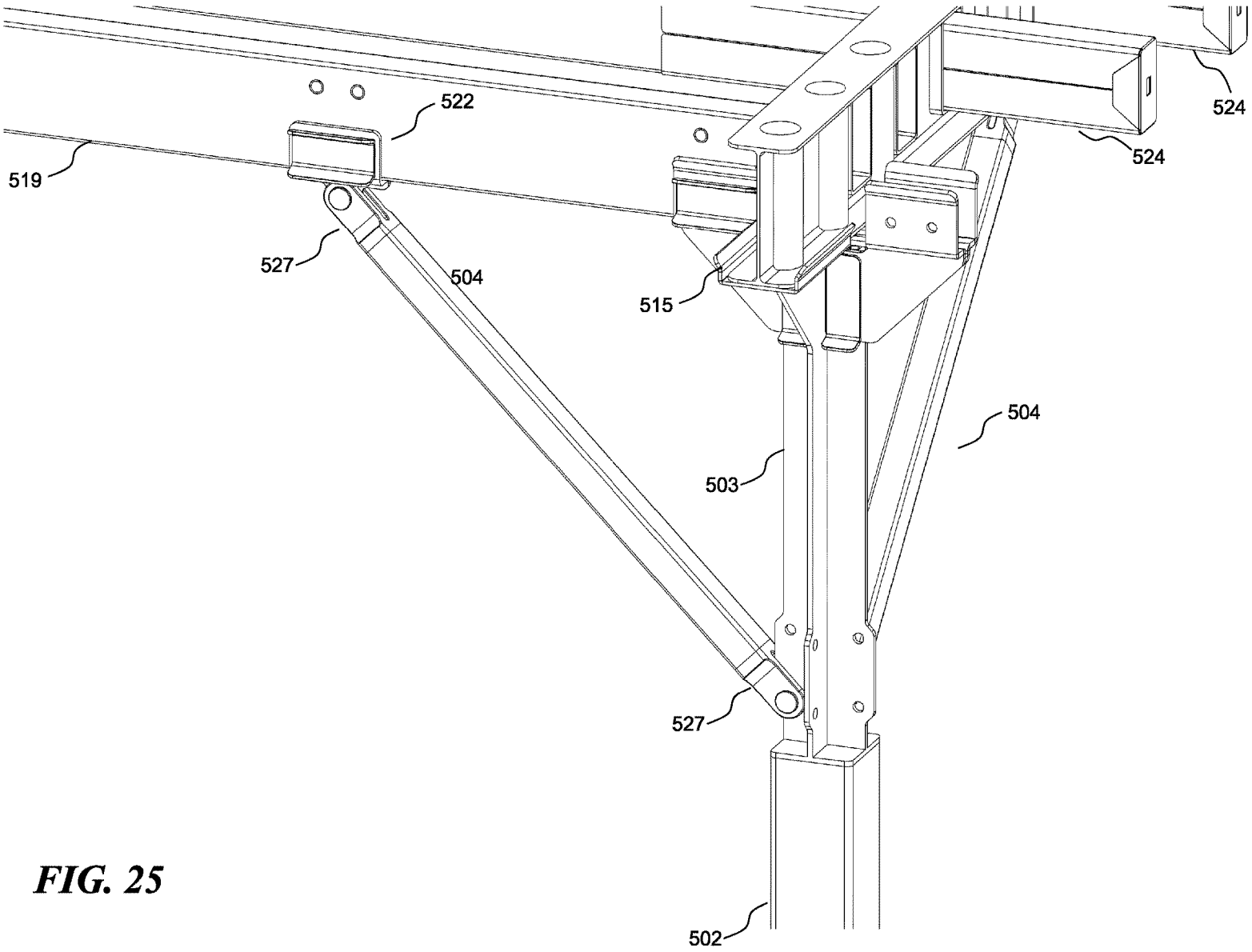
FIG. 25 shows a zoomed view of a corner of a sidewalk shed section according to some embodiments of the present disclosure.

FIG. 25 shows a zoomed view of a corner of a sidewalk shed section 500 according to some embodiments of the present disclosure. A plus part 503 is inserted into and connected to a center rod 502. The plus part 503 has various flanges on its bottom portion with holes facilitating connections. The brace 504 has a bracing cap 527 connected to either side. The hole of one bracing cap 527 is aligned with a hole in clamp 522 (which is connected to the senior beam 519 via a senior pin plate 520 and locker 521) and secured via a pin. The hole of the other bracing cap 527 is aligned with a hole in plus part 503 and also secured via a pin.

Figure 26:
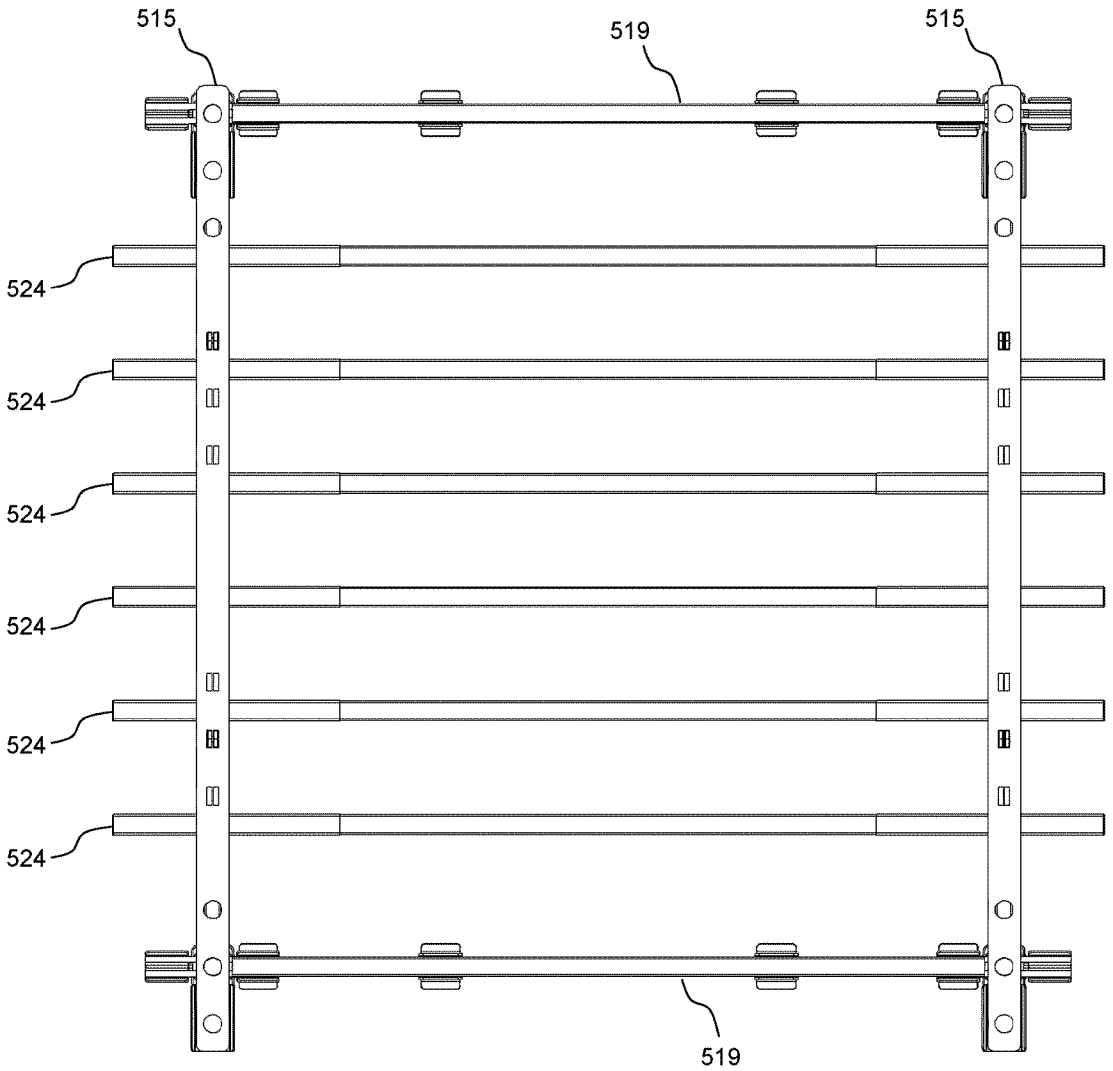
FIG. 26 shows a top view of a sidewalk shed section according to some embodiments of the present disclosure.

FIG. 26 shows a top view of a sidewalk shed section 500 according to some embodiments of the present disclosure. Here, the various junior beams 524 span the width of the sidewalk shed section 500 and rest on the header beams 515.

Figure 27:
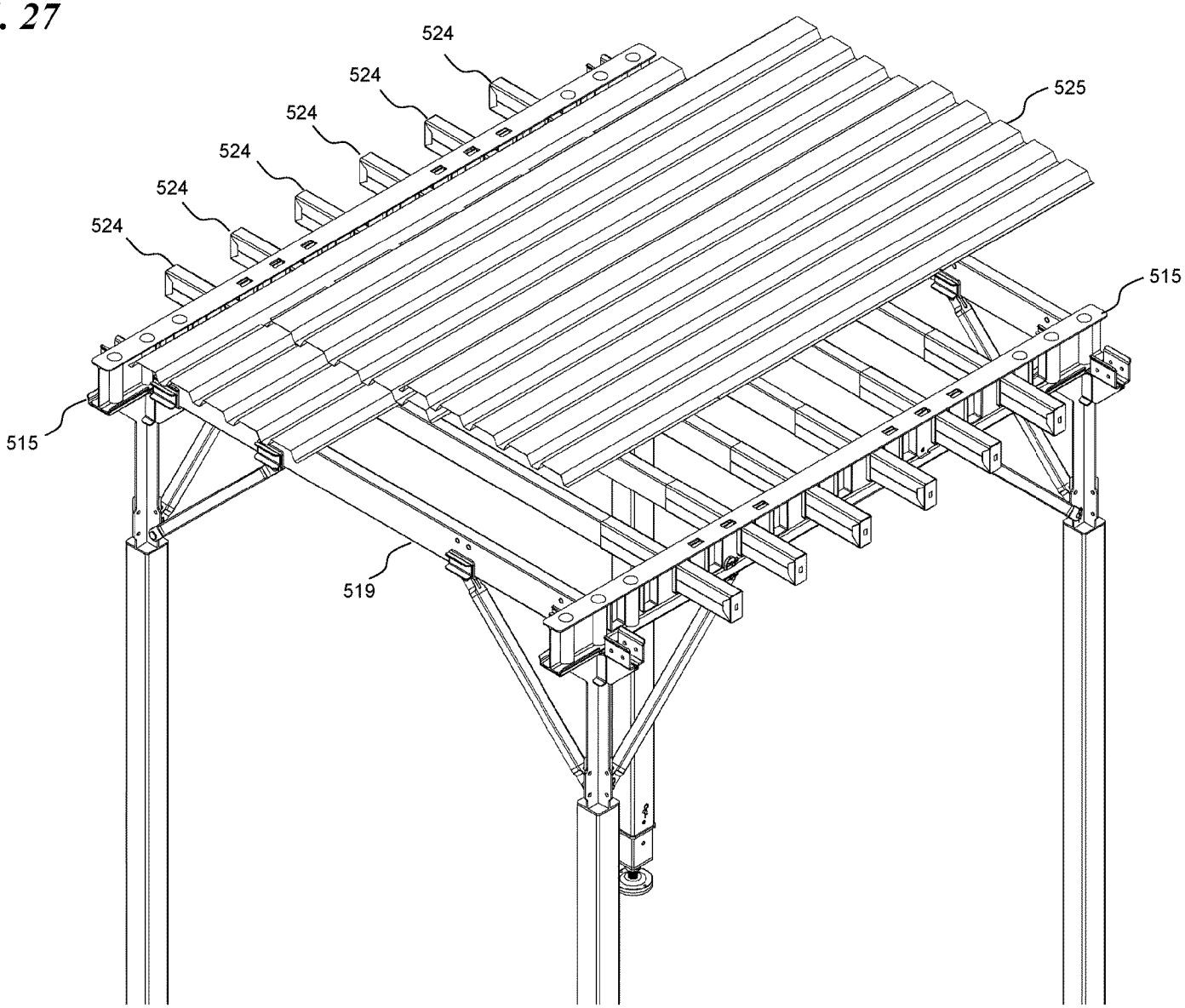
FIG. 27 shows corrugated sheets being added to the sidewalk shed section according to some embodiments of the present disclosure.
Figure 28:
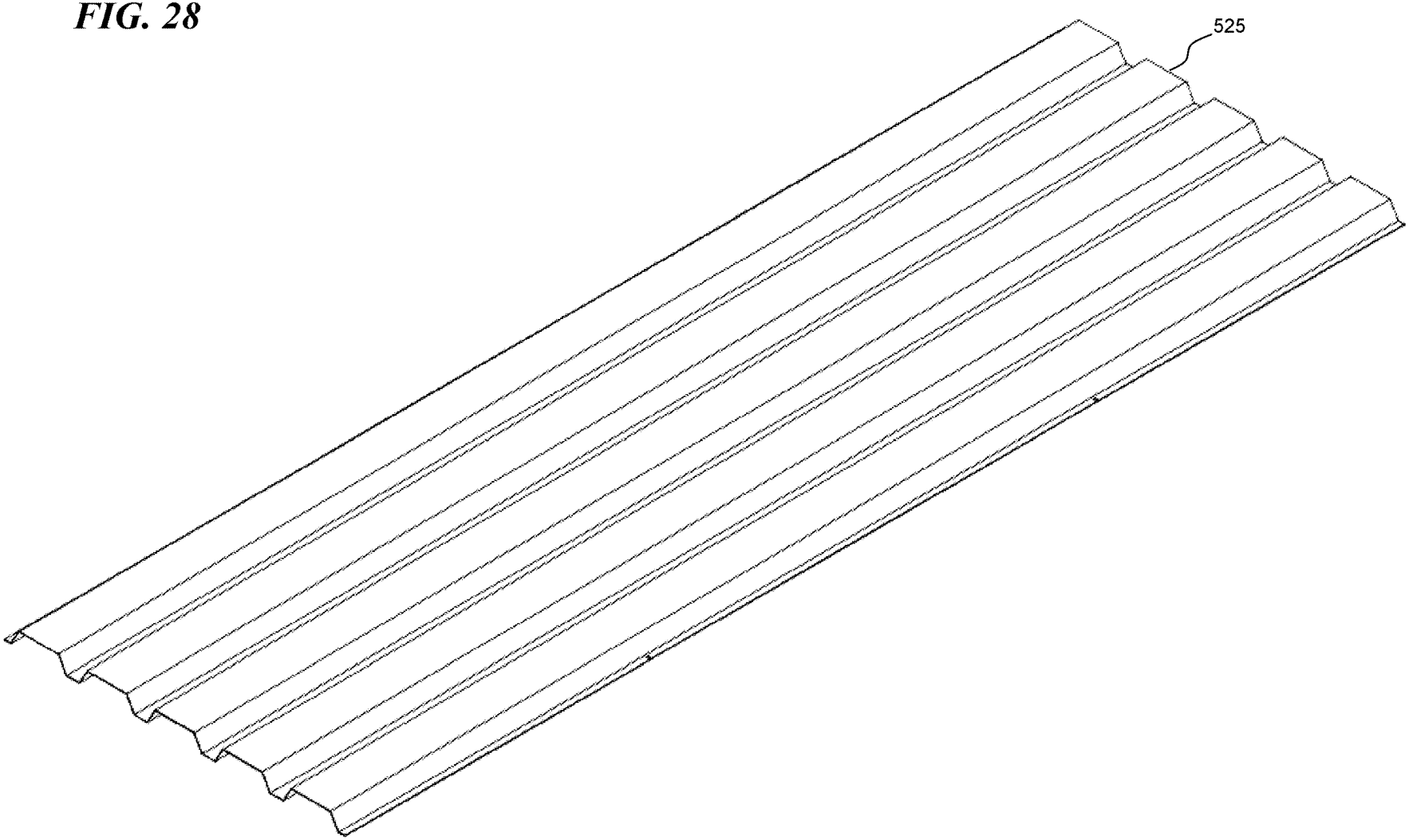
FIG. 28 shows a corrugated sheet according to some embodiments of the present disclosure.

FIG. 27 shows corrugated sheets 525 being added to the sidewalk shed section 500 according to some embodiments of the present disclosure. In particular, the corrugated sheets 525 rest perpendicularly on the junior beams 524 and the senior beams 519. In some embodiments, the corrugated sheets 525 may be made of a metal material, such as carbon steel or stainless steel. In some embodiments, the corrugated sheets 525 may be attached/secured to the junior beams 524. FIG. 28 shows a corrugated sheet 525 according to some embodiments of the present disclosure.

Figure 29A:
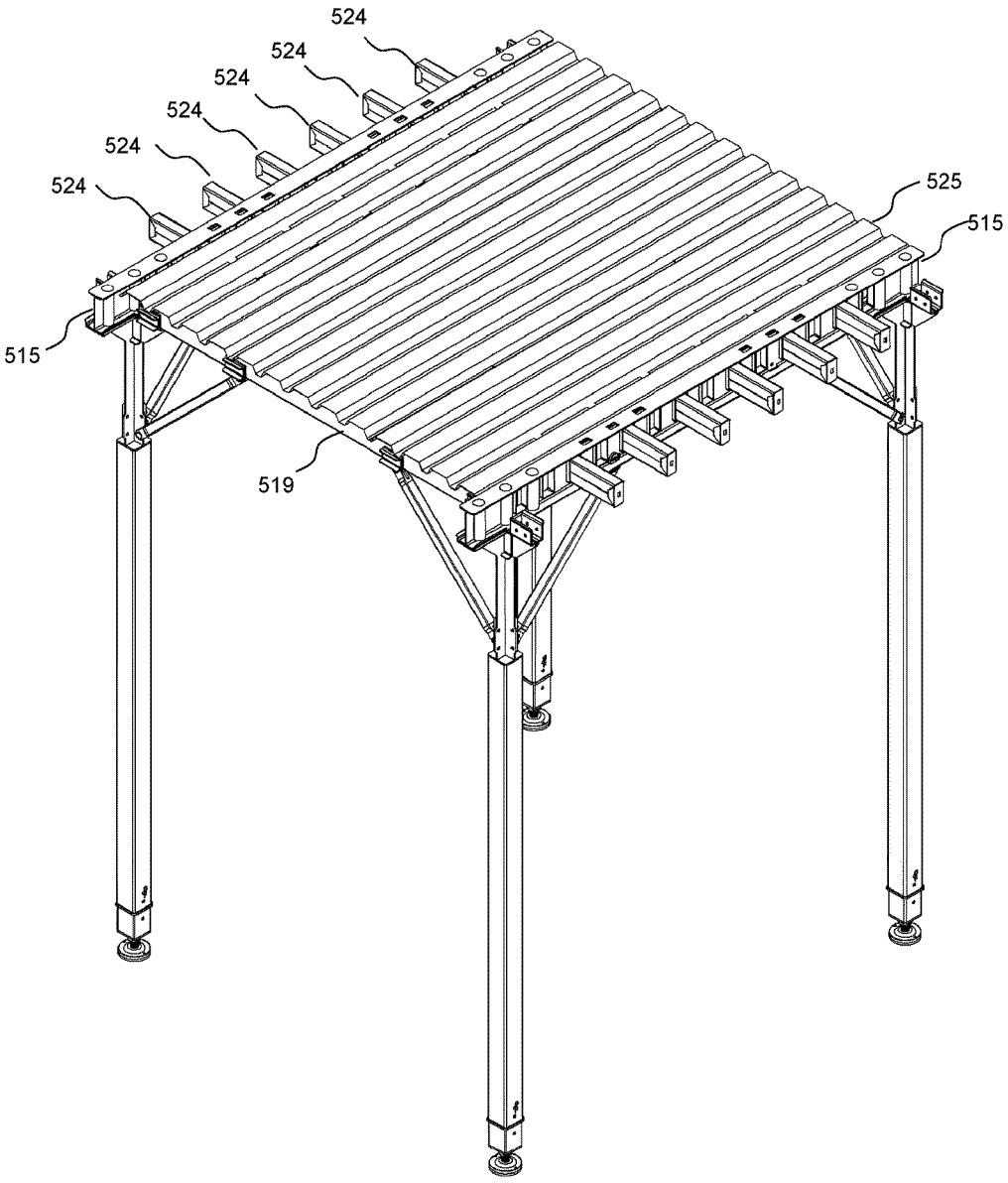
FIG. 29A shows a perspective view of a sidewalk shed section with corrugated sheets according to some embodiments of the present disclosure.
Figure 29B:
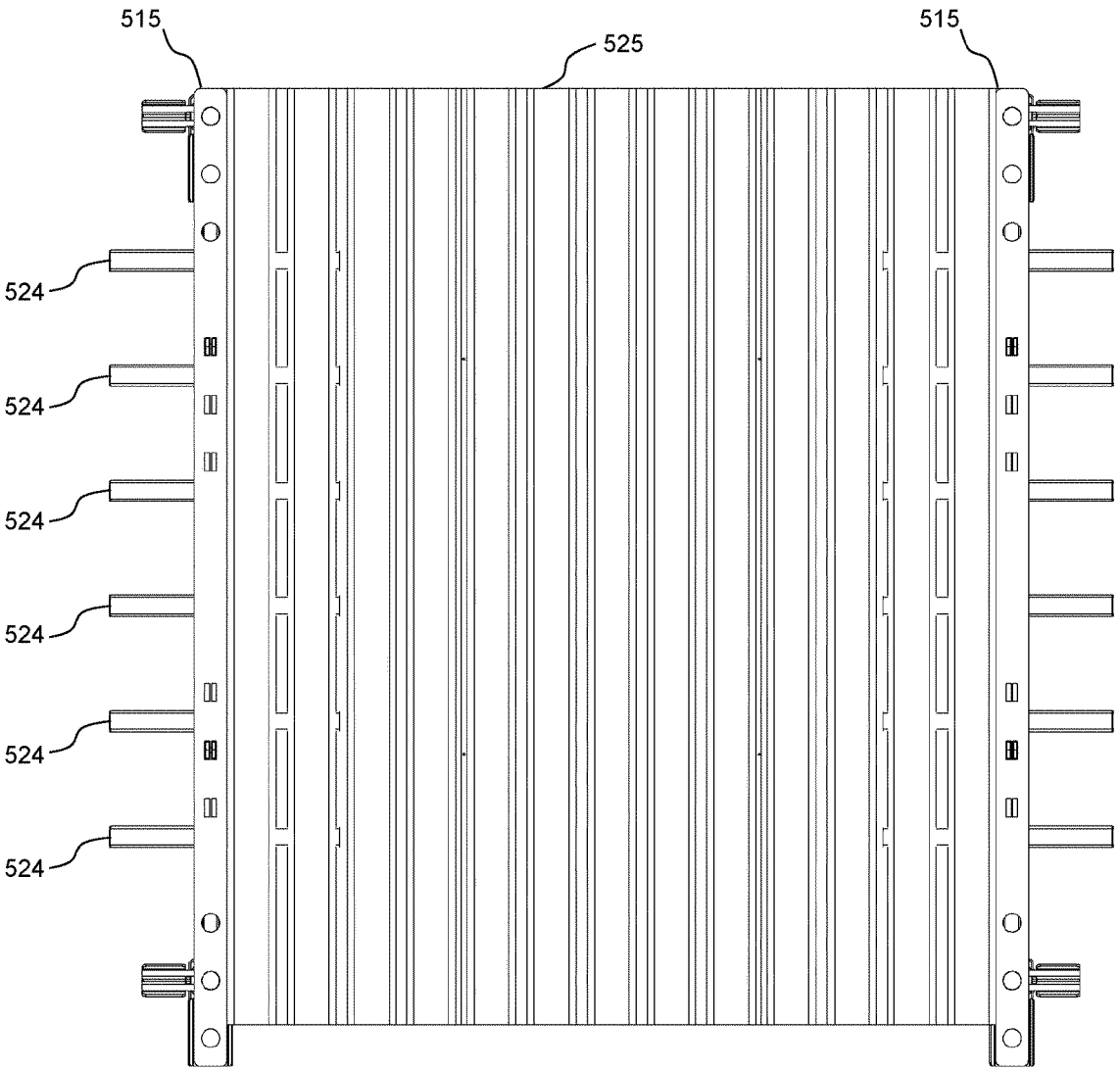
FIG. 29B shows a top view of a sidewalk shed section with corrugated sheets according to some embodiments of the present disclosure.
Figure 29C:
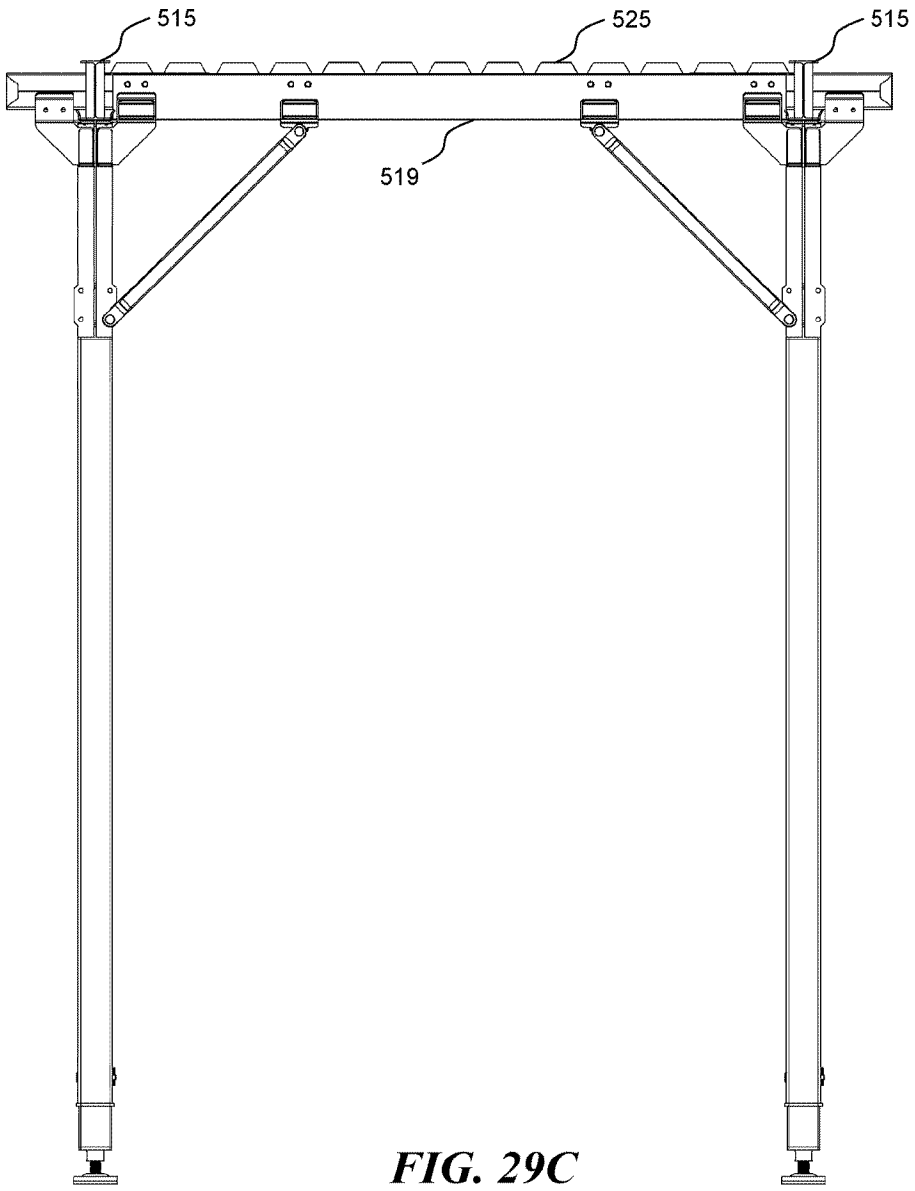
FIG. 29C shows a front view of a sidewalk shed section with corrugated sheets according to some embodiments of the present disclosure.

FIG. 29A shows a perspective view of a sidewalk shed section 500 with corrugated sheets 525 according to some embodiments of the present disclosure. FIG. 29B shows a top view of a sidewalk shed section 500 with corrugated sheets 525 according to some embodiments of the present disclosure. FIG. 29C shows a front view of a sidewalk shed section 500 with corrugated sheets 525 according to some embodiments of the present disclosure.

Figure 30A:
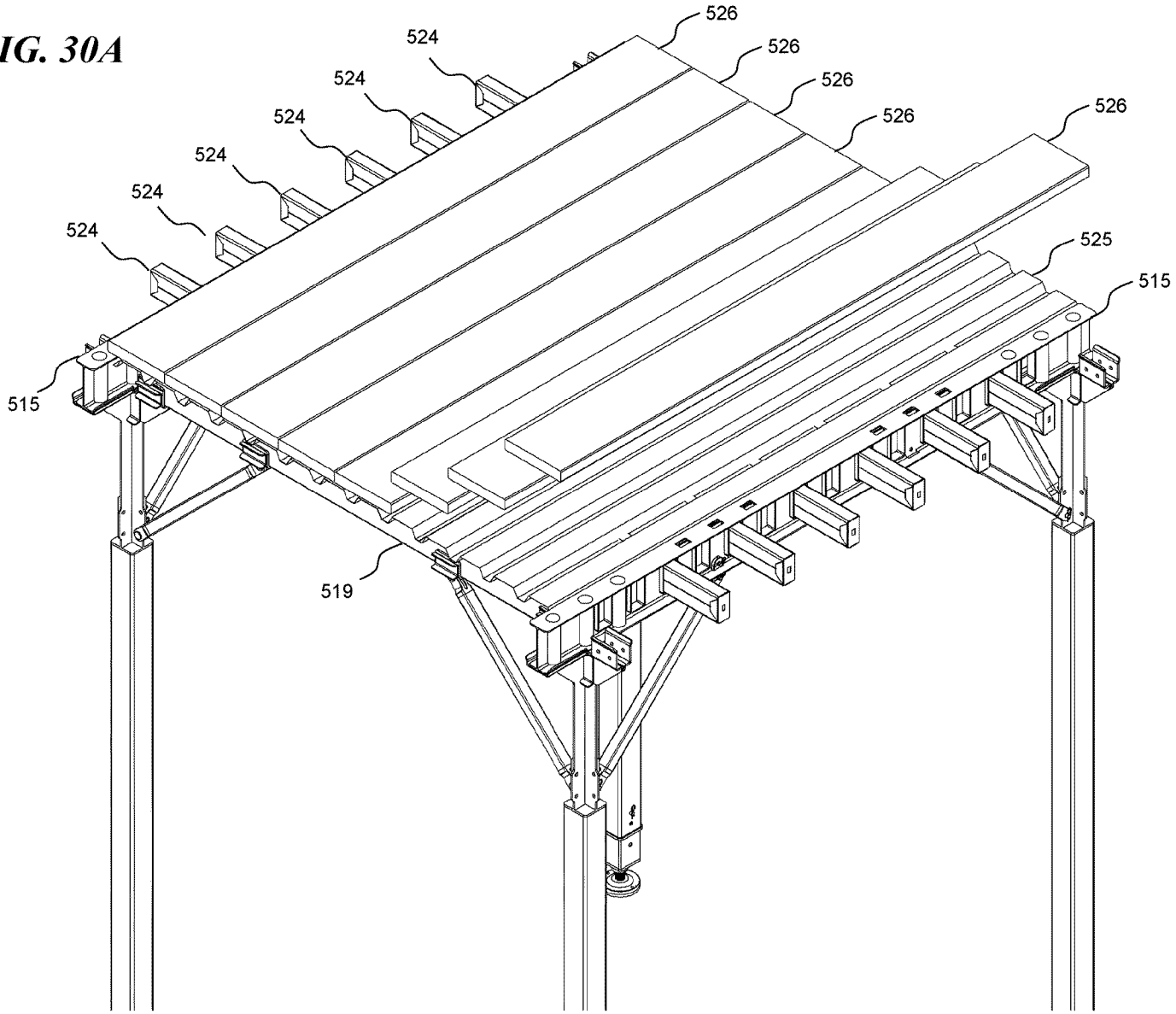
FIG. 30A shows various planks being added to a sidewalk shed section according to some embodiments of the present disclosure.
Figure 30B:
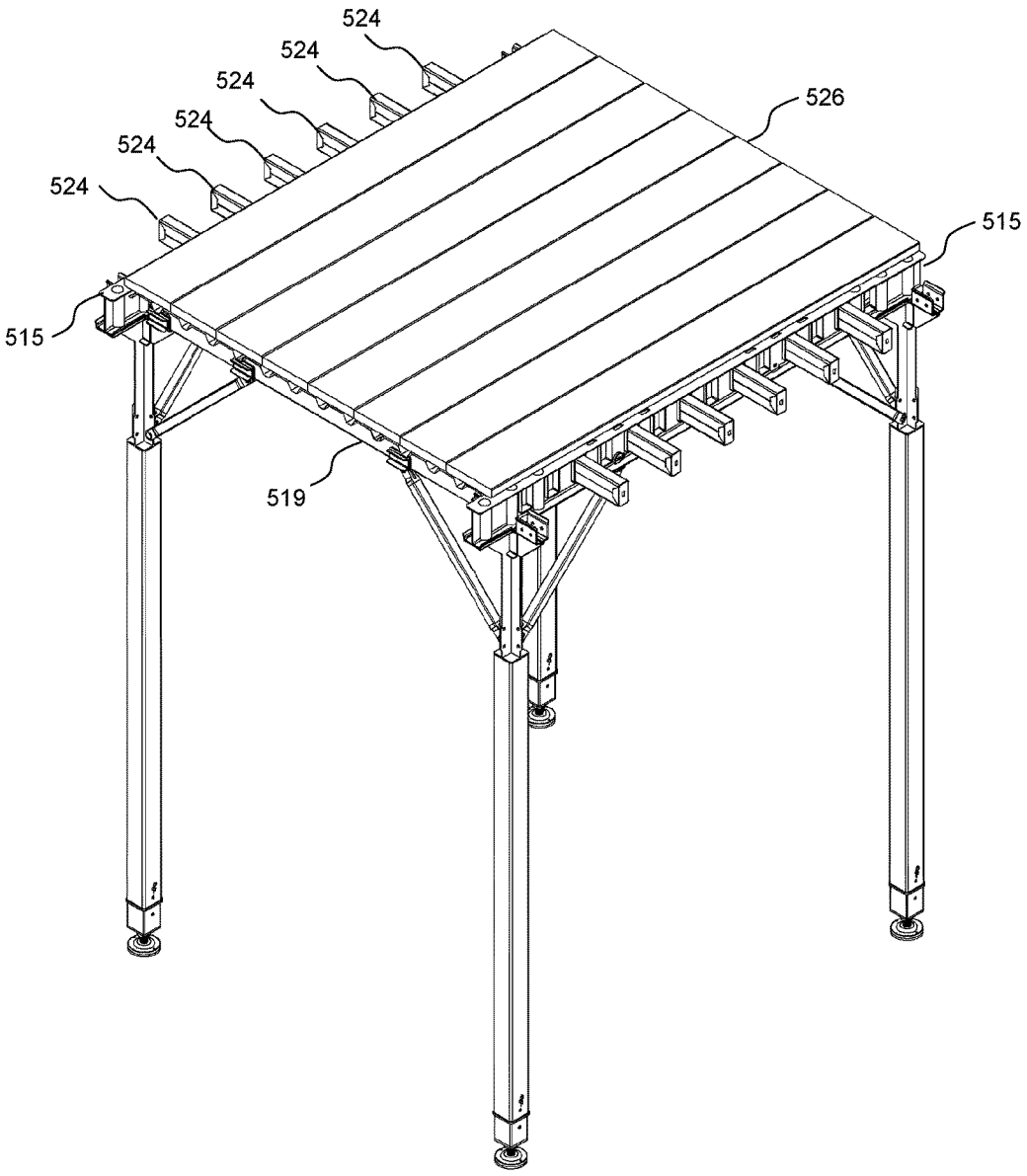
FIG. 30B shows various planks added to a sidewalk shed section according to some embodiments of the present disclosure.
Figure 30C:
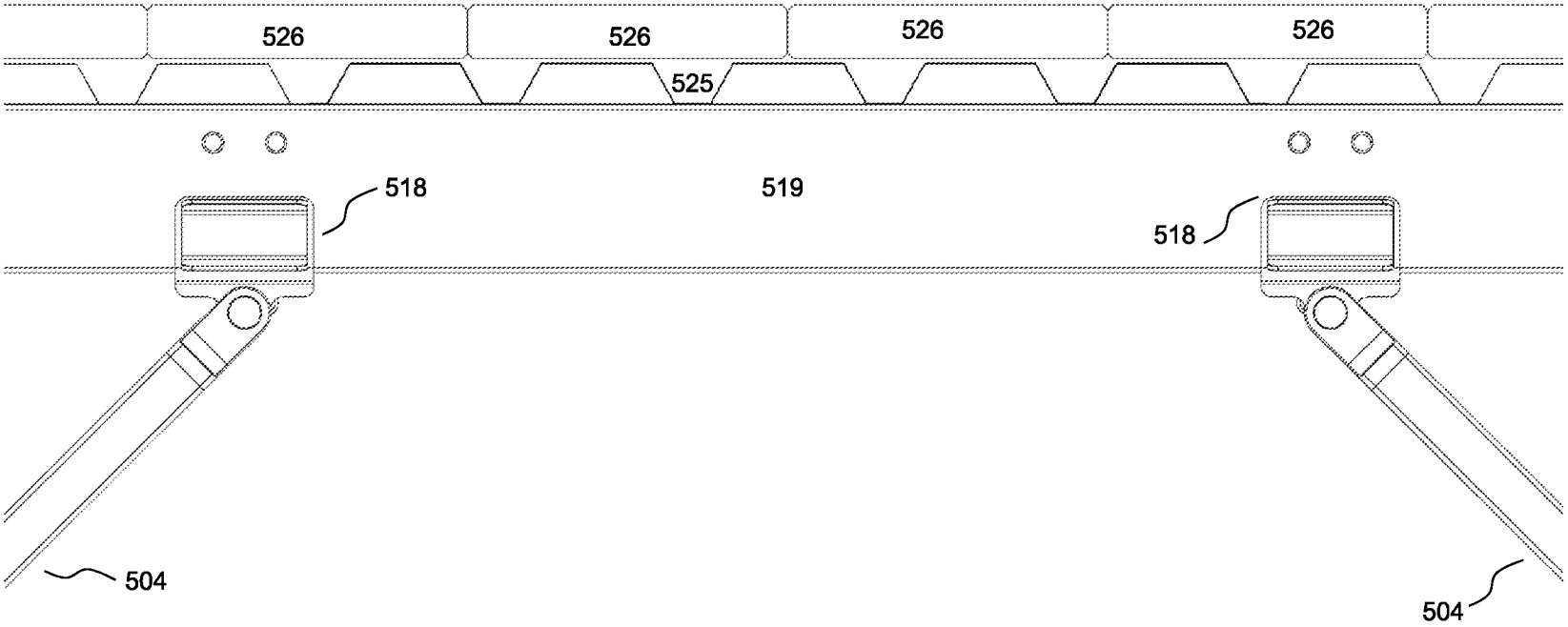
FIGS. 30C-30D show side views of the various planks added to a sidewalk shed section according to some embodiments of the present disclosure.
Figure 30D:
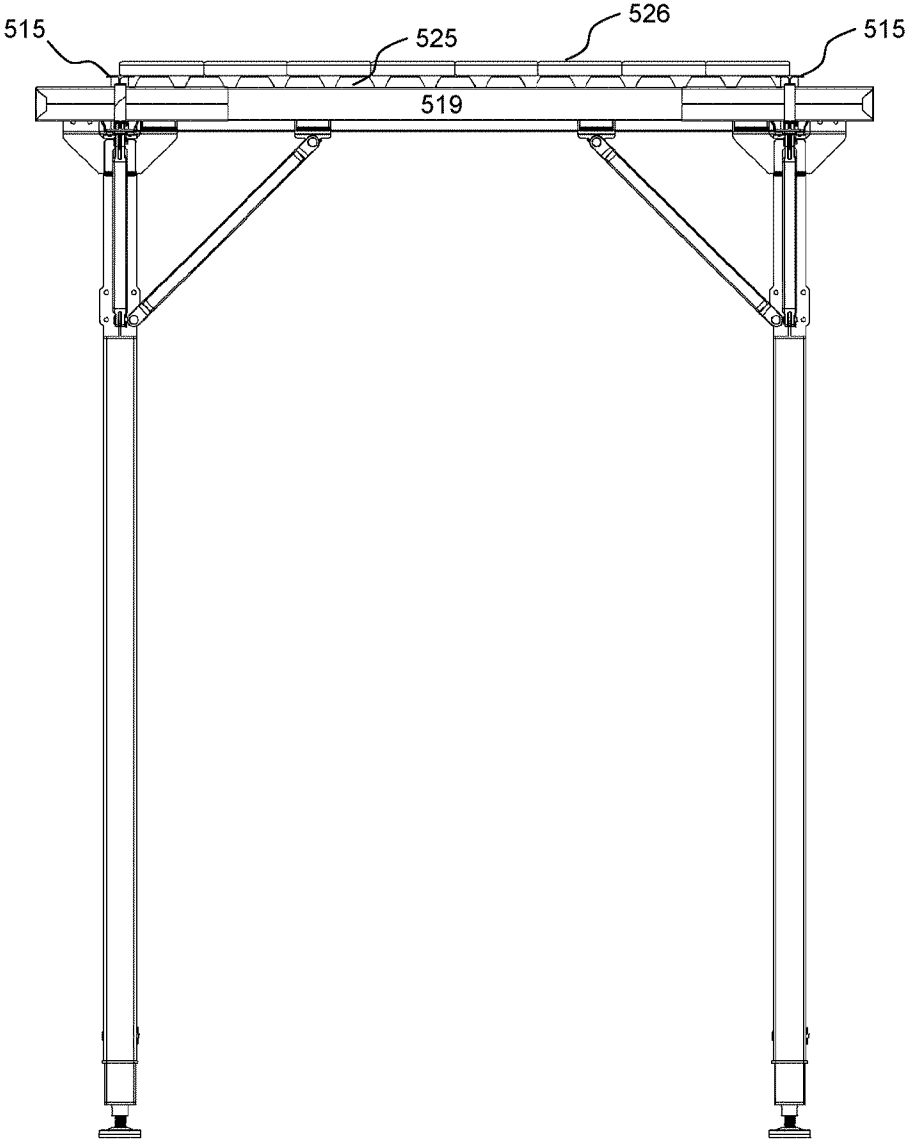

FIG. 30A shows various planks 526 being added to a sidewalk shed section 500 according to some embodiments of the present disclosure. FIG. 30B shows various planks 526 added to a sidewalk shed section 500 according to some embodiments of the present disclosure. FIGS. 30C-30D show side views of the various planks 526 added to a sidewalk shed section 500 according to some embodiments of the present disclosure. In some embodiments, the planks 526 can be wooden and can simply rest on the corrugated sheet 525, offering ease of assembly and disassembly. However, because of the friction between the corrugated sheets 525 and the planks 526, the planks 526 are sufficiently secure to serve as a walking platform for workers.

Figure 31:
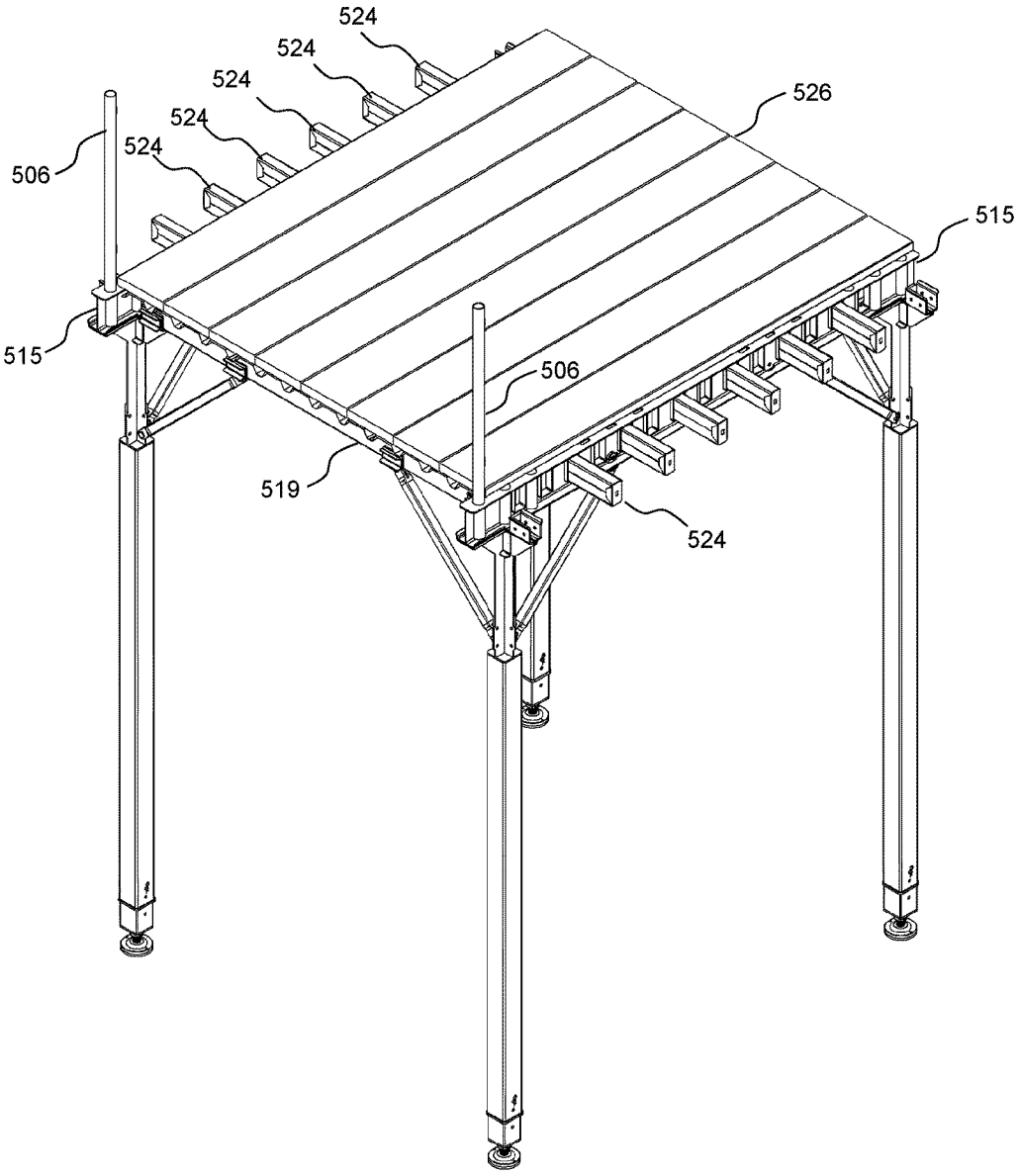
FIG. 31 shows a sidewalk shed section with two parapet rods according to some embodiments of the present disclosure.

FIG. 31 shows a sidewalk shed section 500 with two parapet rods 506 according to some embodiments of the present disclosure. In particular, FIG. 31 illustrates additional benefits of the disclosed sidewalk shed system, specifically the hole arrangement of the header beams 515. Besides allowing for the header beams 515 to be connected to the rod header 512 and thus the plus part 503, the holes can be configured to receive a parapet rod 506. The cross-sectional area of the parapet can be slightly smaller than the cross-sectional area of the hole, allowing for a snug fit.

Figure 32:
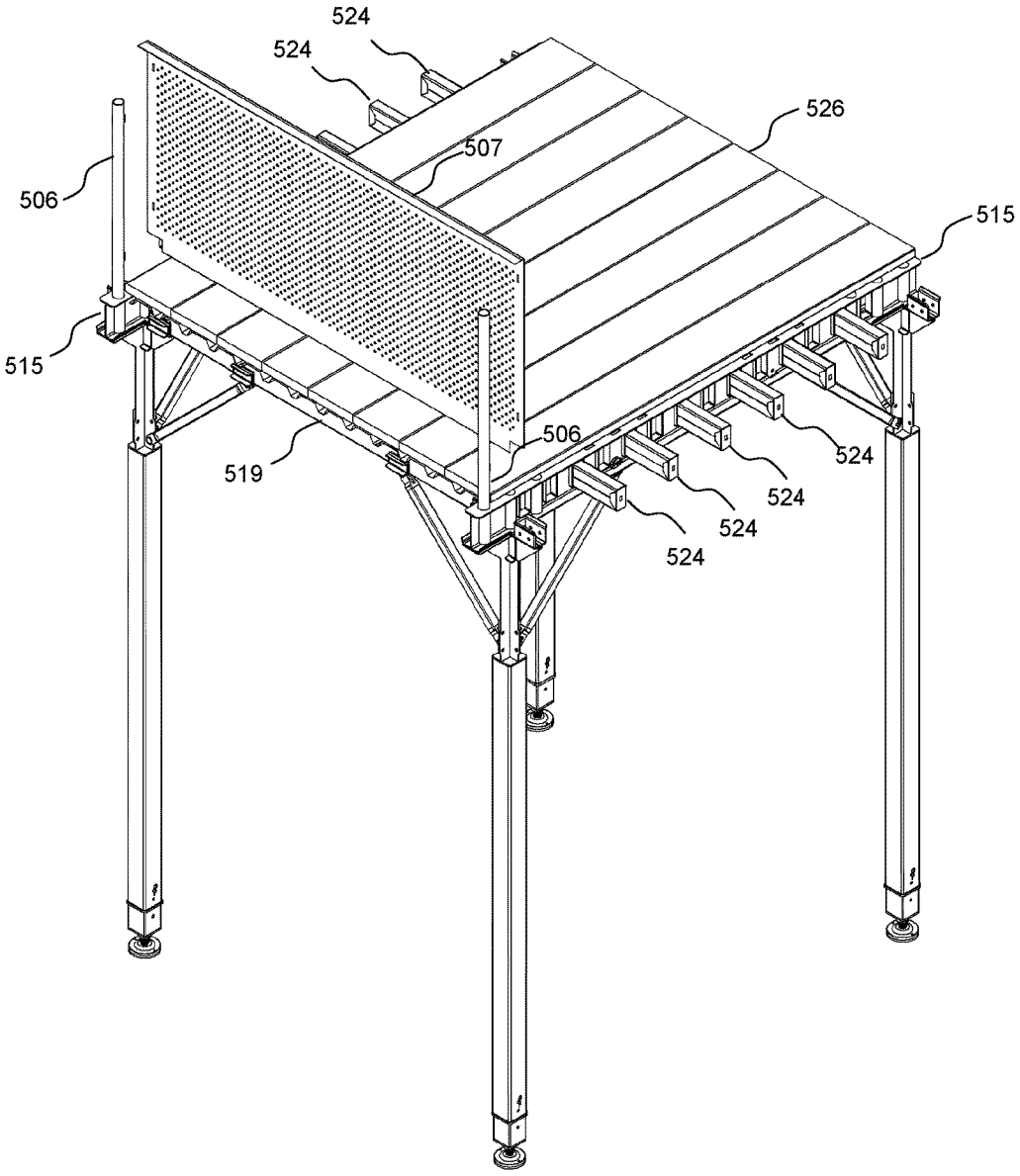
FIG. 32 shows a parapet being added to a sidewalk shed section according to some embodiments of the present disclosure.
Figure 33:
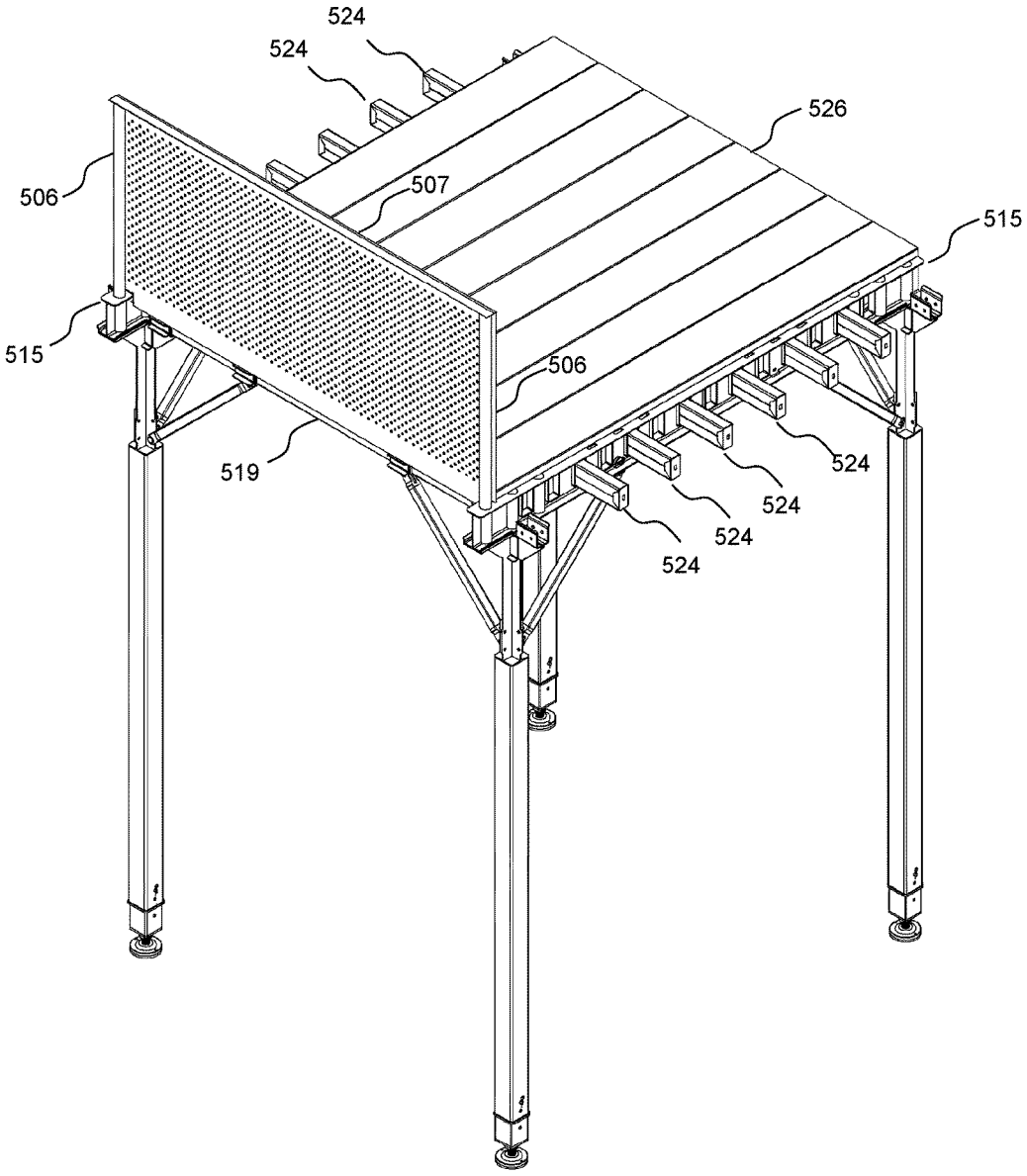
FIG. 33 shows a sidewalk shed section with a parapet according to some embodiments of the present disclosure.

FIG. 32 shows a parapet 507 being added to a sidewalk shed section 500 according to some embodiments of the present disclosure. The parapet 507 is configured to be connected to each of the parapet rods 506 via, for example, flange-receiving slots that can receive a flange from the parapet rod 506. FIG. 33 shows a sidewalk shed section 500 with a parapet 507 according to some embodiments of the present disclosure. After the parapet 507 is secured to each of the parapet rods 506, the parapet 507 can serve as a barrier to workers walking on the planks 526 and can prevent falling or tools dropping.

After construction of the sidewalk shed section 500, multiple sections 500 can be connected to each other (both vertically and horizontally) to construct a sidewalk shed system capable of spanning the length of a building or other structure, as well as to reach the desired height on said building or other structure.

In some embodiments, most of the disclosed parts and components described herein can be made of carbon steel. Additionally, the junior beam can be made of fiberglass or carbon steel; the parapet (front, side, corner, etc.) can be expanded mesh or perforated steel; the bracing cap can be stainless steel or carbon steel; the corrugated sheet can be steel, plexiglass (PMMA), or polycarbonate; and the planks can be wood or other composite materials. With respect to dimensions, common dimensions can include an internal height of 8-14', a sidewalk width to cover of 5-14', and a system a length of 16-100', although the disclosed system is modular and may over a variety of dimensions.

Figure 34C:
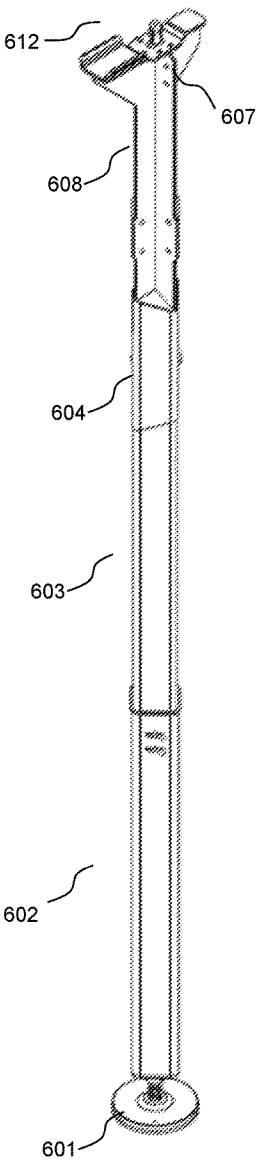
FIG. 34C shows a perspective view of an alternate vertical according to some embodiments of the present disclosure.
Figure 34B:
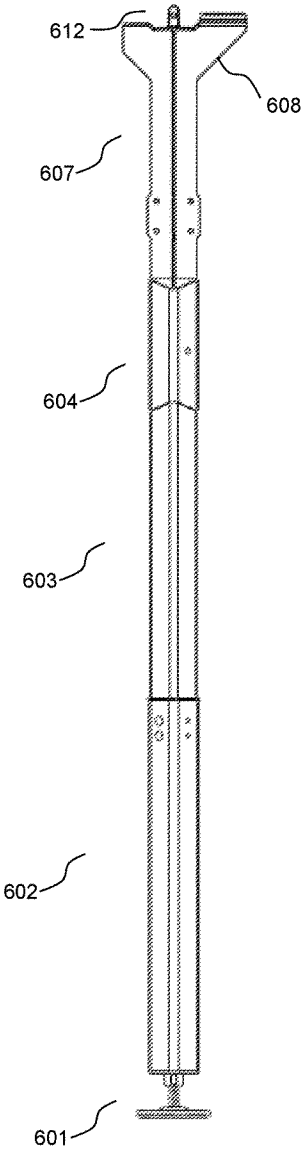
FIGS. 34A-34B show a front view of an alternate vertical according to some embodiments of the present disclosure.
Figure 34A:
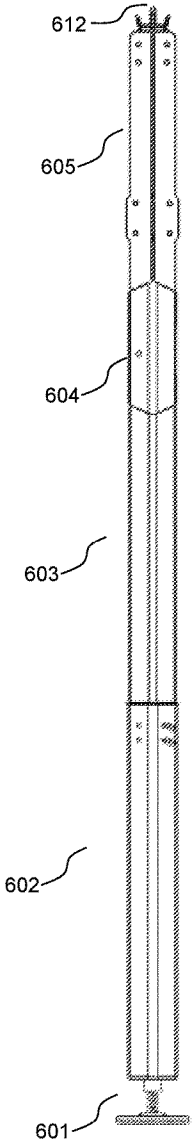

FIGS. 34A-34B show a front view of an alternate vertical according to some embodiments of the present disclosure. FIG. 34C shows a perspective view of an alternate vertical according to some embodiments of the present disclosure. The alternate vertical is similar to the vertical of FIGS. 19A-19C and can be used in a similar manner to form a sidewalk shed. As shown in the figures, the center rod has a base 601, a vertical leg 602, a vertical rod 603, a center rod 604, and a plus part 605. In some embodiments, the center rod can also include an alternate plus part 607 and a header plate 608. In addition, the alternate vertical includes a different shaped rod header 612, which can be rectangular.

Figure 35A:
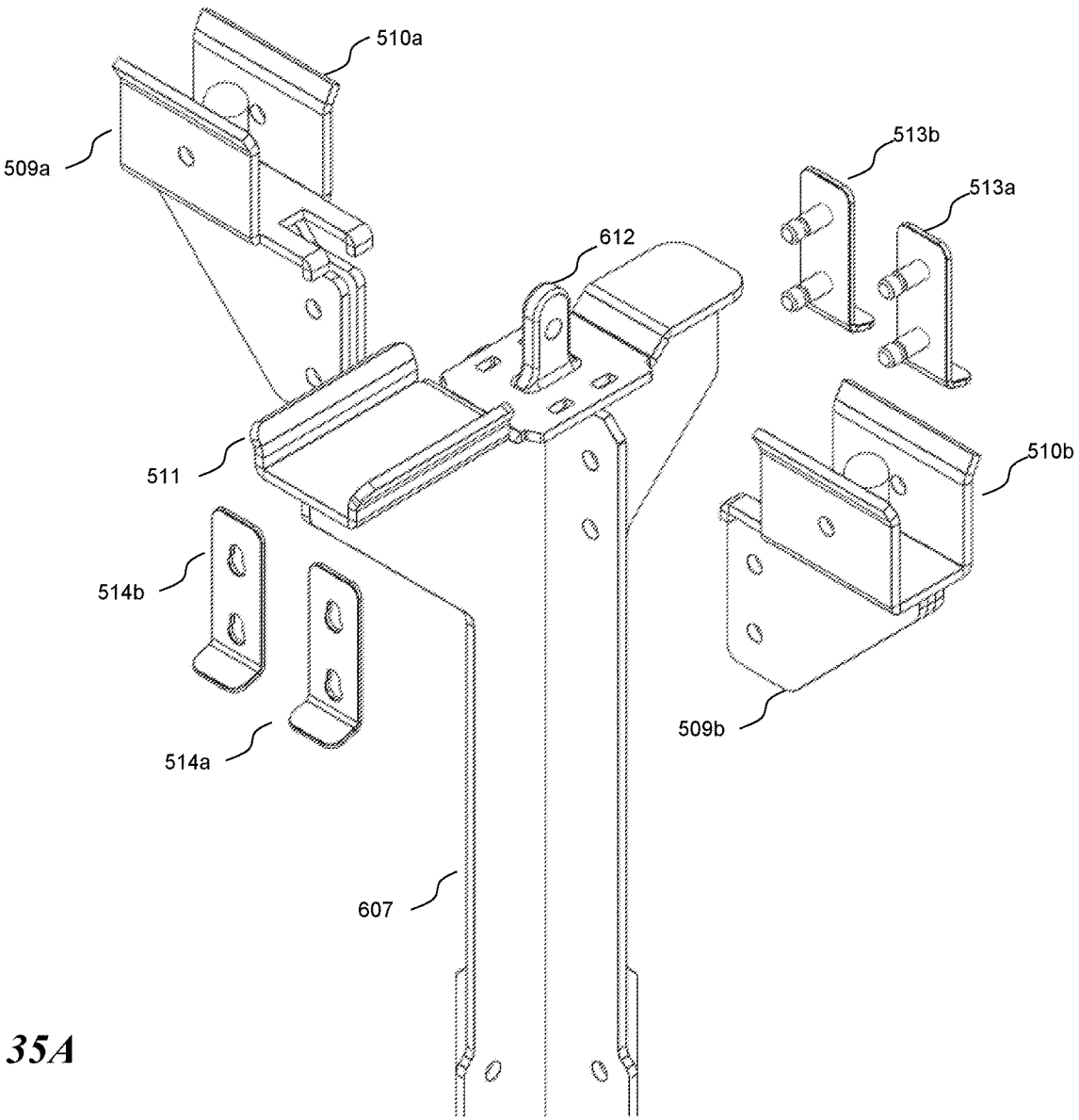
FIGS. 35A-35B show various parts being attached to an alternate plus part according to some embodiments of the present disclosure.
Figure 35B:
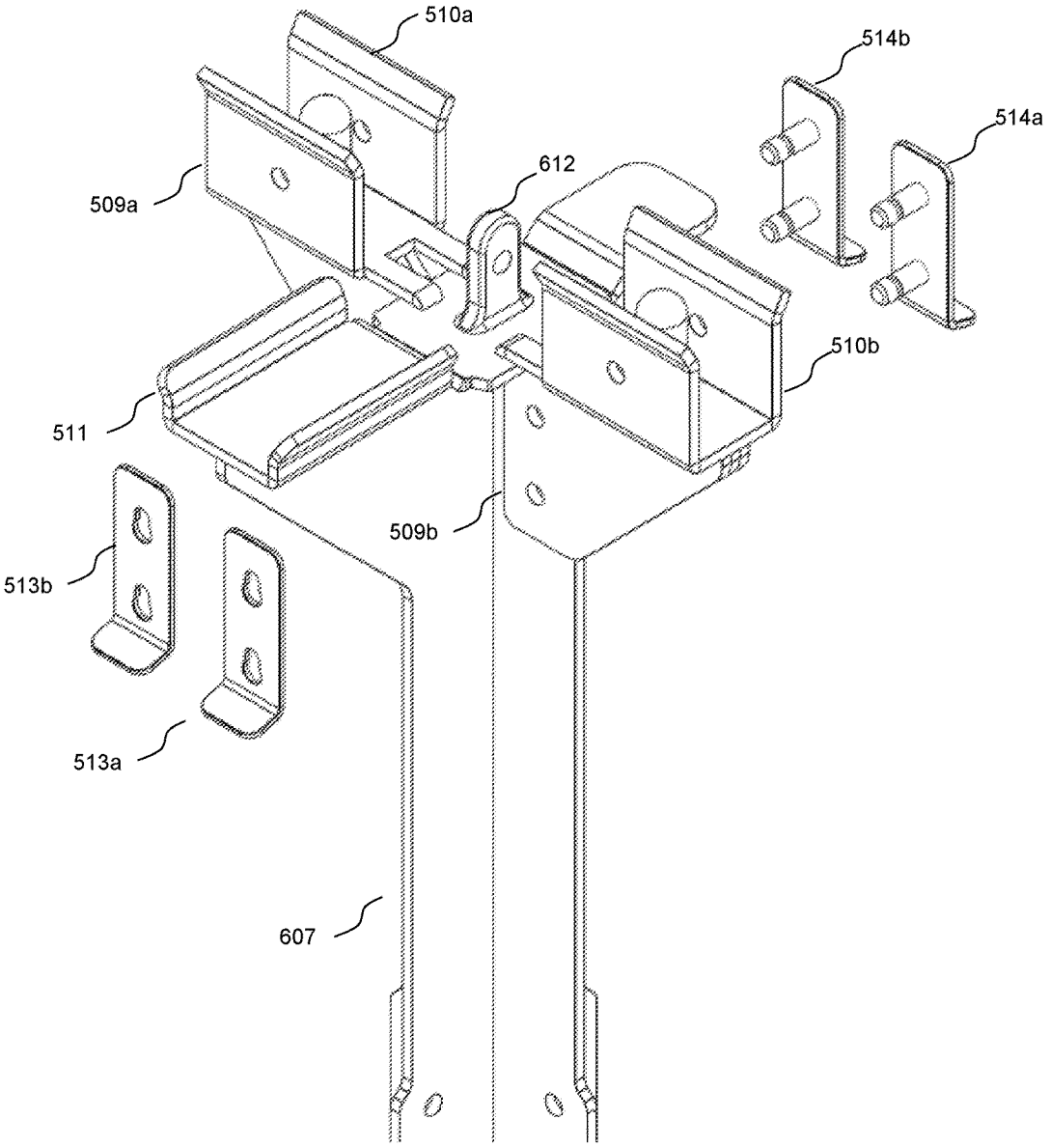

FIGS. 35A-35B show various parts being attached to an alternate plus part 607 according to some embodiments of the present disclosure. This can be an alternate version of the leg section described in relation to FIGS. 18A-18B. First, the plus part 607 has a header plate 511 and rod header 512 attached, such as via welding. In addition, the plus part 607 has pin plates 513 and lockers 514 secured to each other through two holes in the plus part 607. The pin plate 513 and locker 514 combination can be used to secure the bracket 509 and bracket mirror 510 to the plus part 503. In addition, the alternative plus part 607 can include an alternate rod header 612.

Figure 36:
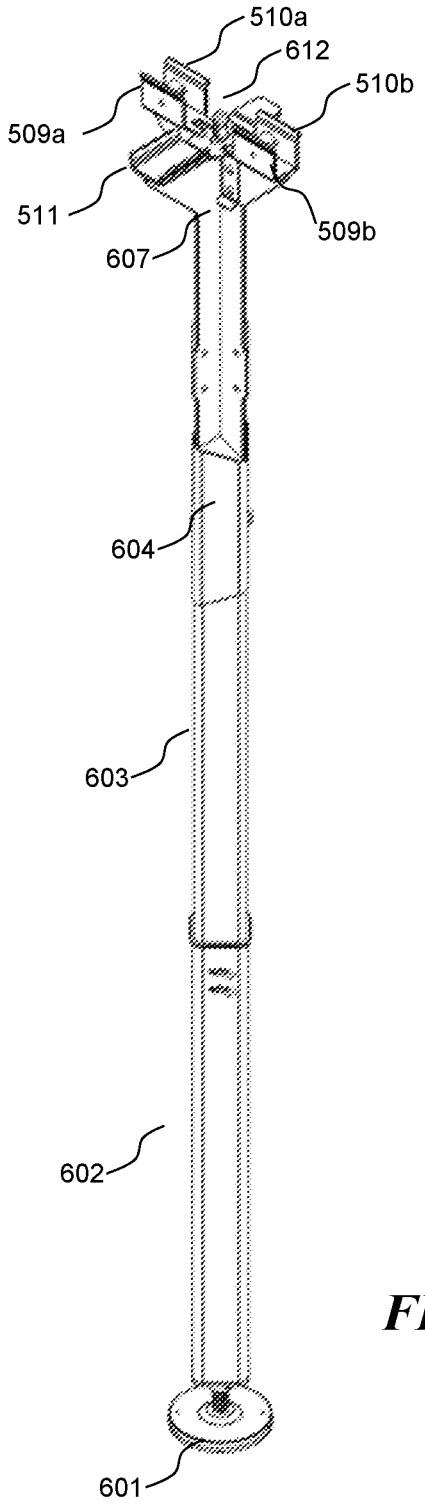
FIG. 36 shows a perspective view of an alternate vertical according to some embodiments of the present disclosure.

FIG. 36 shows a perspective view of an alternate plus part 607 and vertical according to some embodiments of the present disclosure. As shown in the figure, the center rod has a base 601, a vertical leg 602, a vertical rod 603, a center rod 604, and a plus part 605. In addition, the alternate plus part 607 is included that has a set of brackets 509 and bracket mirror 510 combinations attached to either side, each being secured by a pin plate 513 and locker 514 (not shown). In addition, the plus part 503 has a header plate 511 and an alternate rod header 612 attached at the top end.

Figure 37:
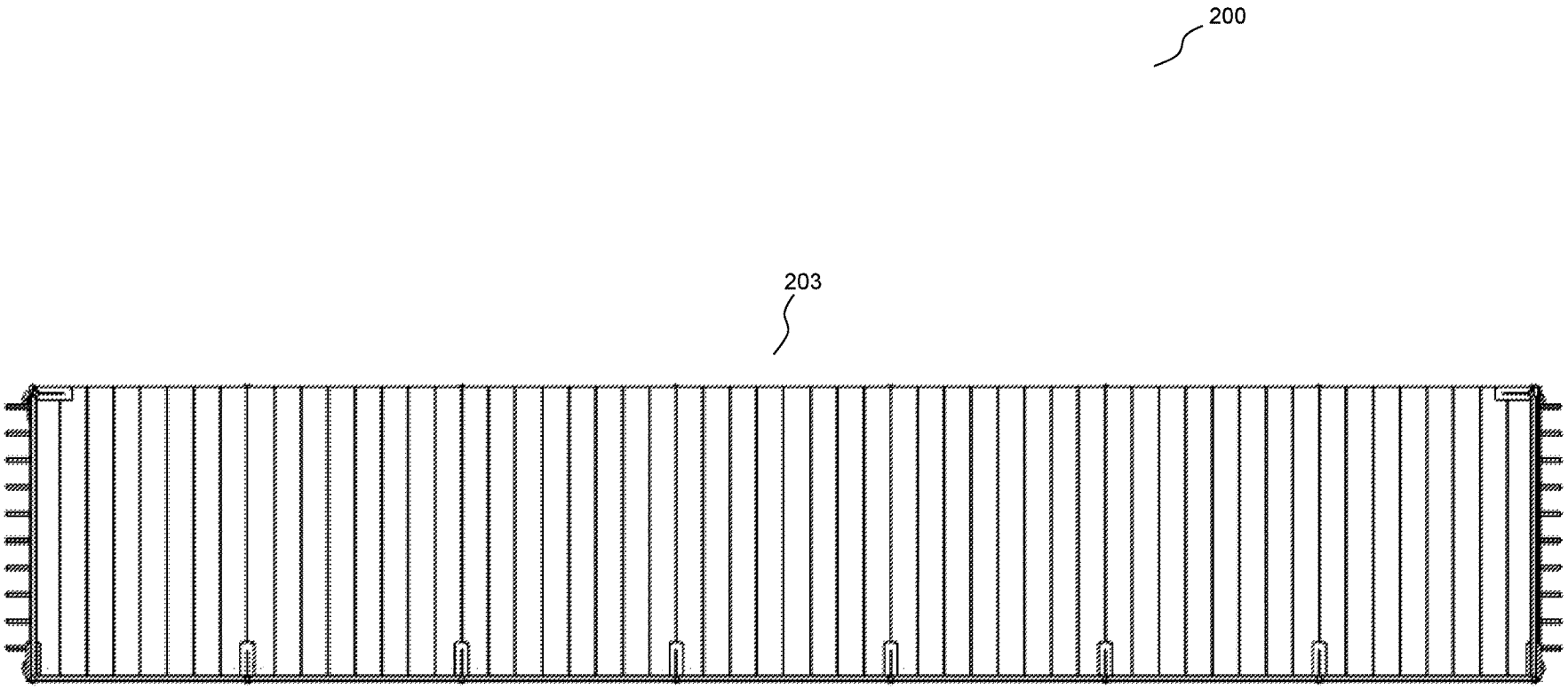
FIG. 37 shows a top view of an alternate sidewalk shed system according to some embodiments of the present disclosure.

FIG. 37 shows a top view of an alternate sidewalk shed system 200 according to some embodiments of the present disclosure. The platform 203 includes various planks. In some embodiments, the planks can be wooden.

Figure 38:
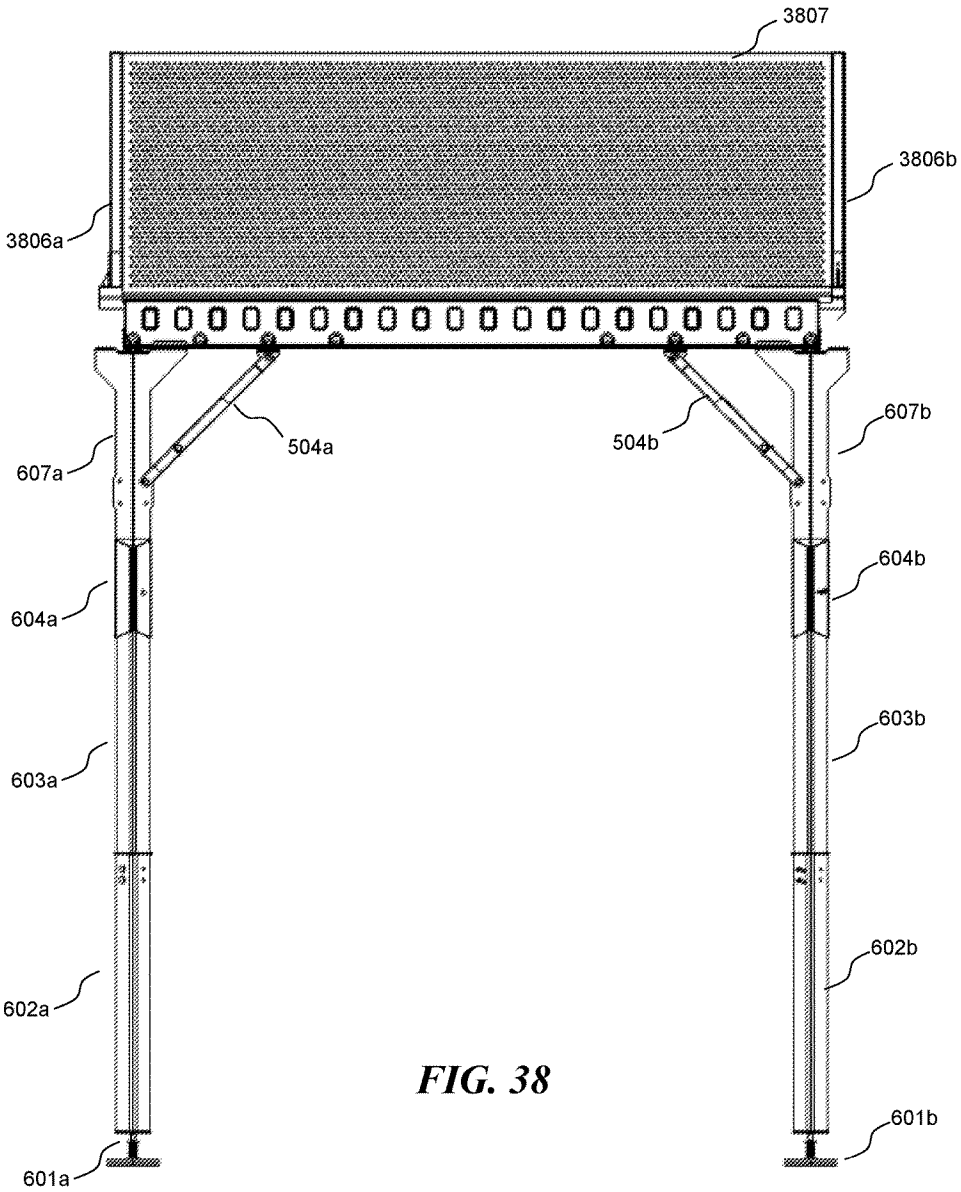
FIG. 38 shows a front view of an alternate sidewalk shed section according to some embodiments of the present disclosure.

FIG. 38 shows a front view of an alternate sidewalk shed section according to some embodiments of the present disclosure. The alternate sidewalk shed section of FIG. 38 is similar to the shed section of FIG. 5B. The sidewalk shed section includes four supporting "legs" or "verticals", one at each corner. Each "leg" or "vertical" includes a base 601, a vertical leg 602, a vertical rod 603, a center rod 604, and an alternate plus part 607. In some embodiments, a base 601 can be a threaded rod (e.g., screw) and base, where the rod can screw into a receiving slot in the vertical leg 602. Various braces 504 can connect to the bottom portion of each alternate plus part 607 and the underside of header beams and senior beam. The braces 504 provide support to the platform for functioning as a walking surface for workers. In addition, the sidewalk shed section 500 includes a parapet 3807 that is connected to and supported by parapet rods 3806*a* and 3806*b*. There are additional components in the sidewalk shed section 500 that will be discussed in subsequent figures.

Figure 39A:
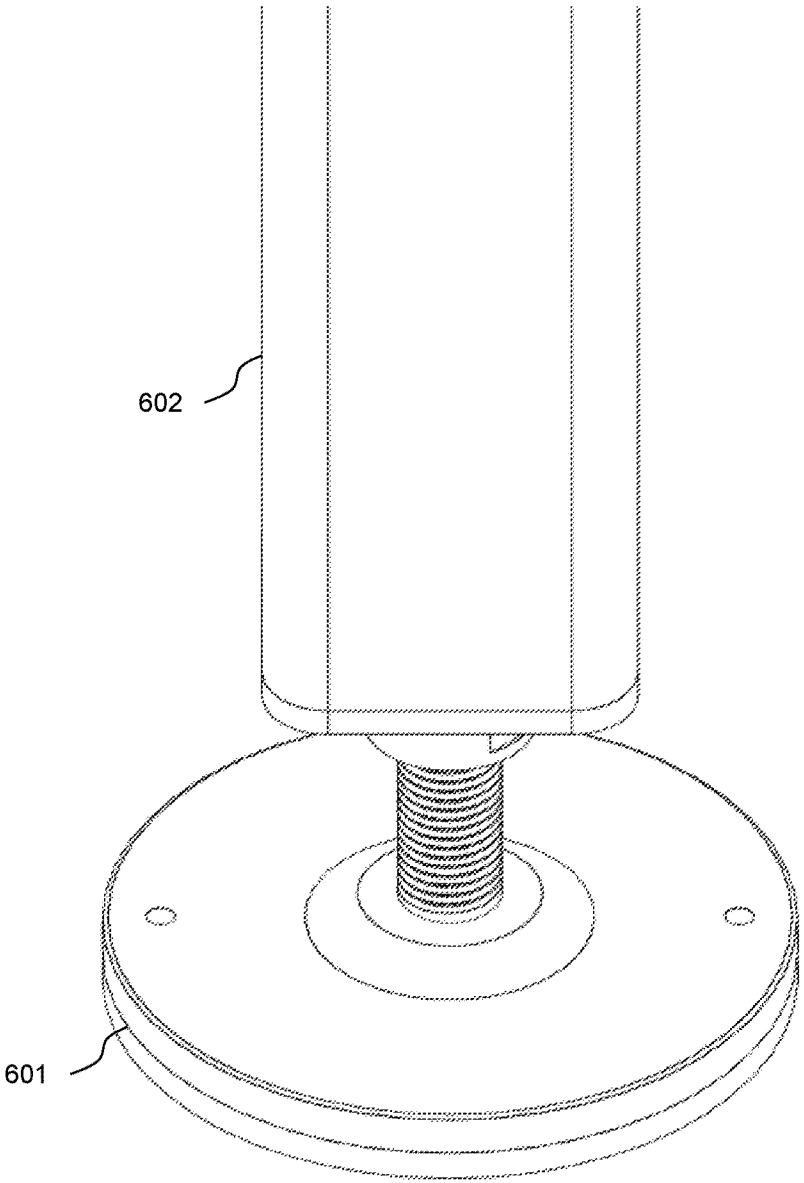
FIGS. 39A-39B show the bottom of an alternate center rod according to some embodiments of the present disclosure.
Figure 39B:
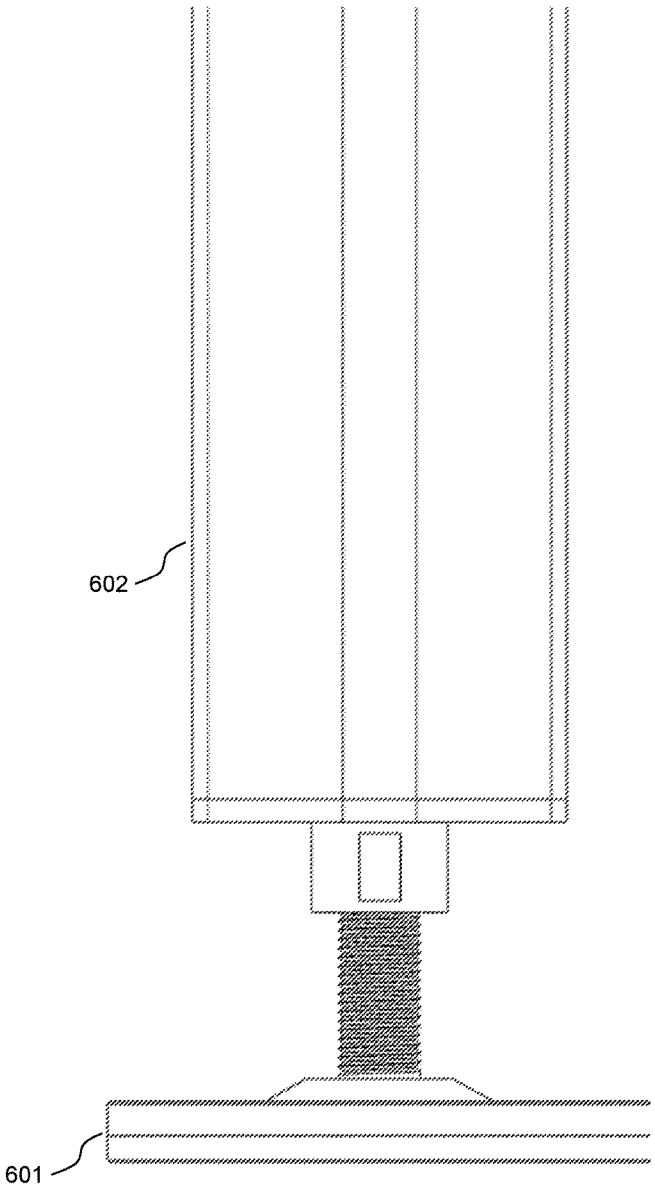
Figure 40:
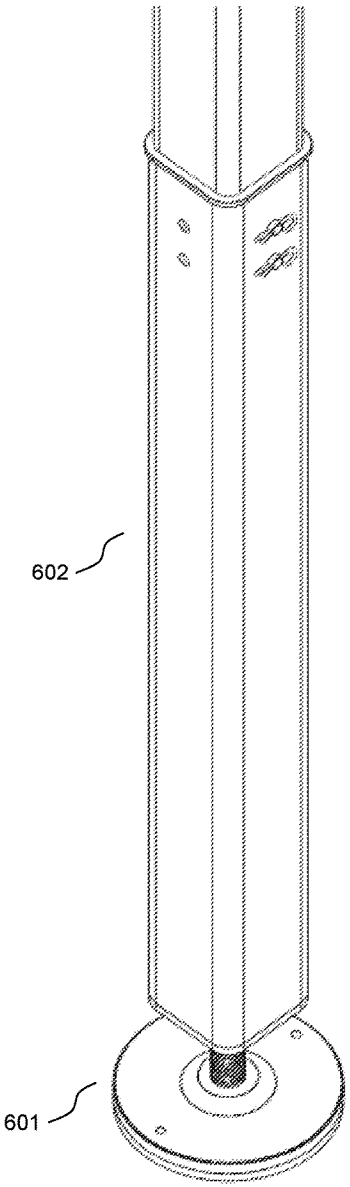
FIG. 40 shows a perspective view of an alternate center rod according to some embodiments of the present disclosure.

FIGS. 39A-39B show the bottom of an alternate vertical according to some embodiments of the present disclosure. FIG. 39A shows a perspective view, while FIG. 39B shows a side view. As discussed above, the vertical leg 602 is configured to receive a base 601, such as via a threaded rod and threaded receiving slot. In other words, the base 601 can be screwed into the vertical leg 602. FIG. 40 shows a perspective view of an alternate vertical according to some embodiments of the present disclosure.

Figure 41A:
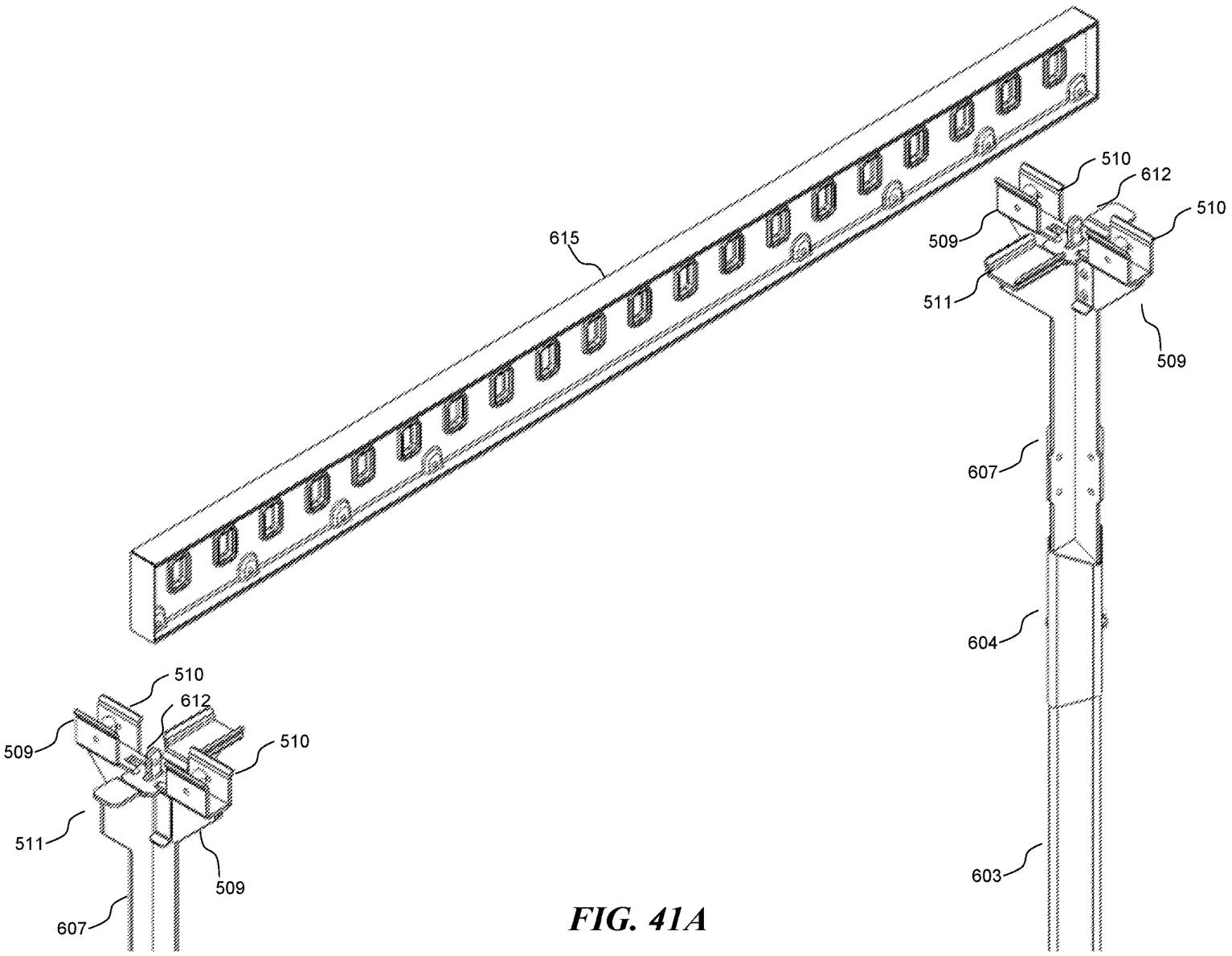
FIG. 41A shows an alternate configuration of a header beam being connected to two verticals according to some embodiments of the present disclosure.
Figure 41B:
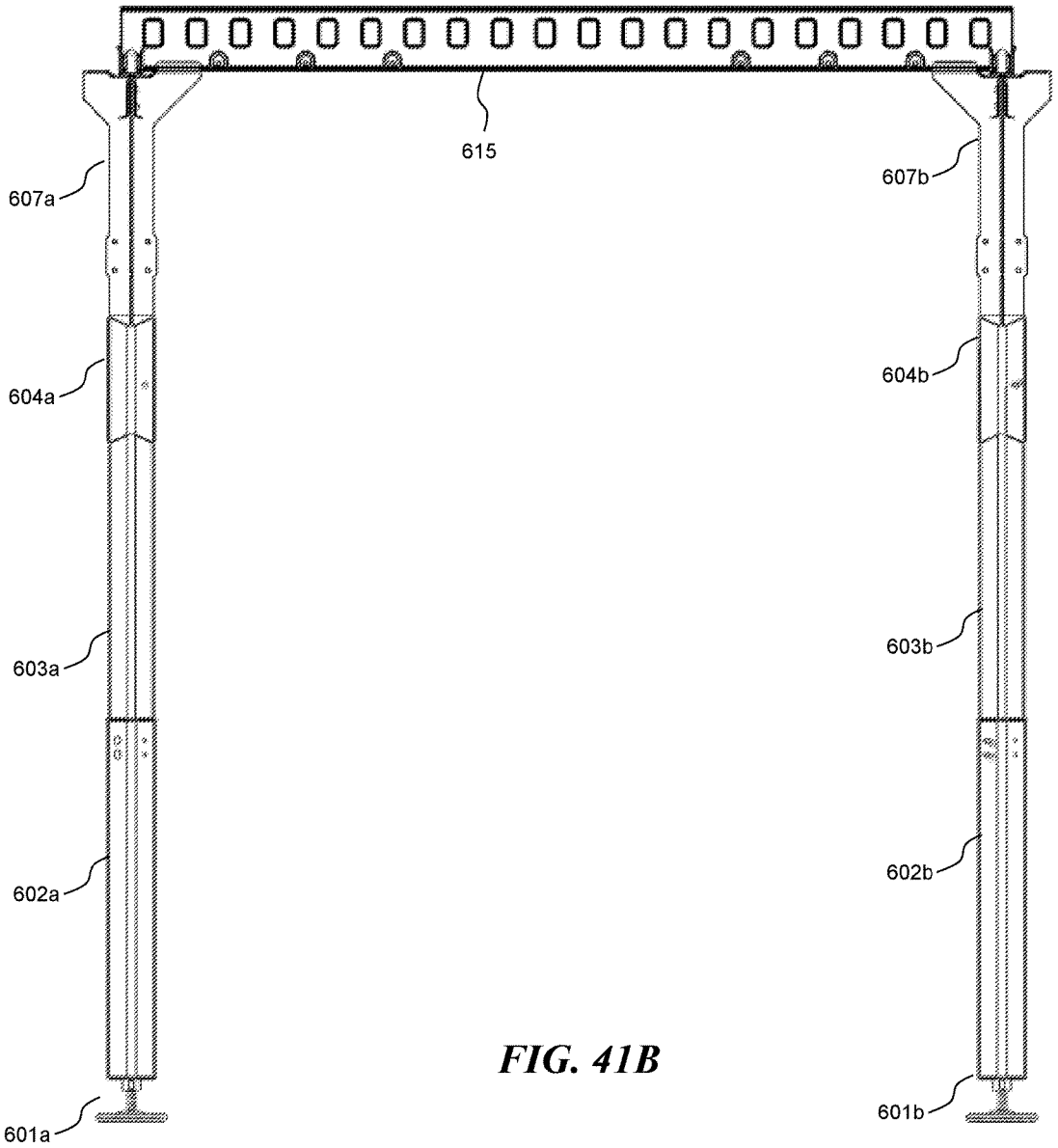
FIG. 41B shows a front view of an alternate configuration of the header beam connected to two verticals according to some embodiments of the present disclosure.
Figure 41C:
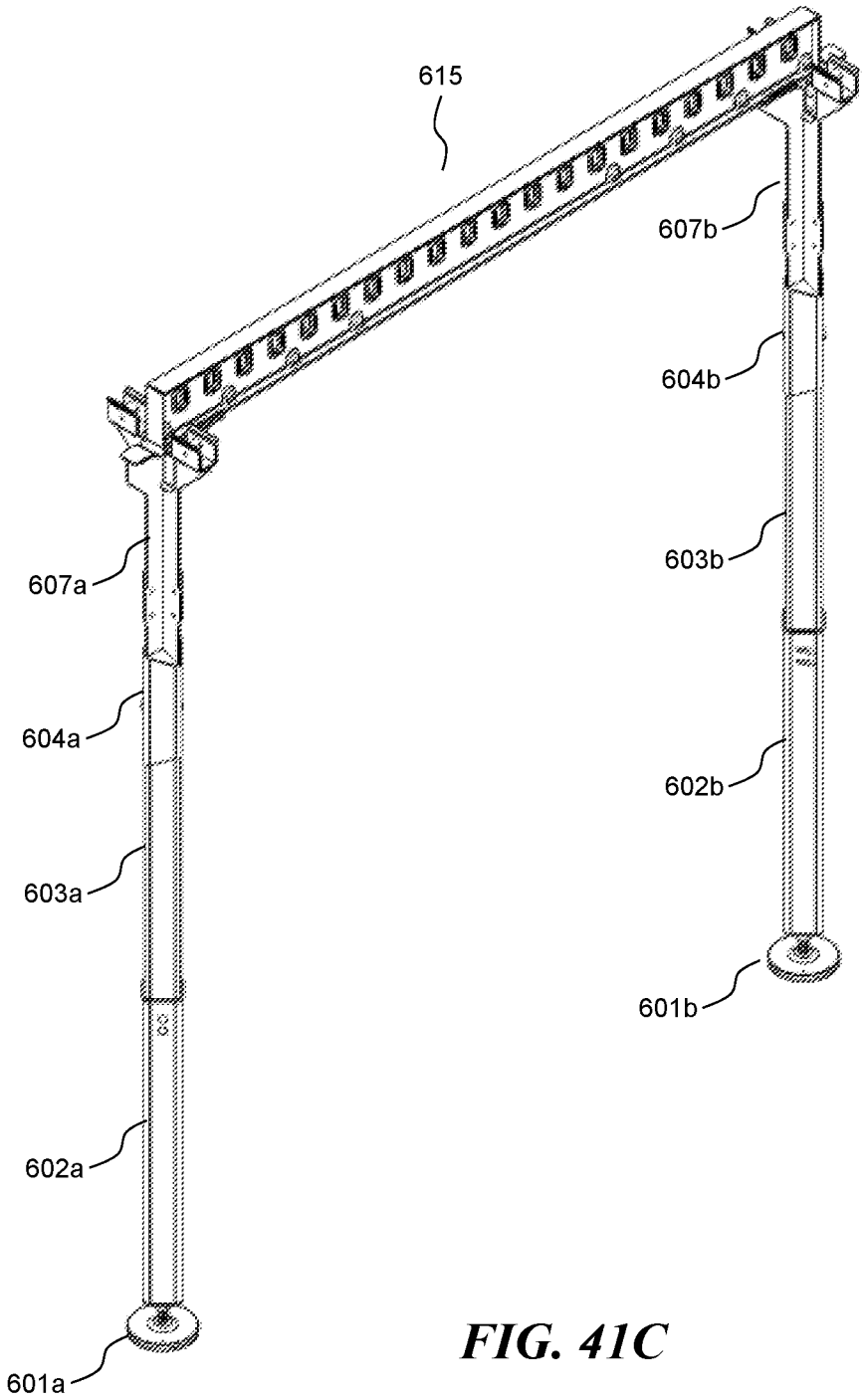
FIG. 41C shows a perspective view of an alternate configuration of the header beam connected to two verticals according to some embodiments of the present disclosure.

FIG. 41A shows an alternate configuration of a header beam being connected to two verticals according to some embodiments of the present disclosure. FIG. 41B shows a front view of an alternate configuration of the header beam connected to two verticals according to some embodiments of the present disclosure. FIG. 41C shows a perspective view of an alternate configuration of the header beam connected to two verticals according to some embodiments of the present disclosure. Here, the configuration shown in FIGS. 41A-41C is similar to the configuration shown in FIGS. 20A-20B except there is an alternate plus part 607, an alternate rod header 612, and an alternate header beam 615.

Figure 42A:
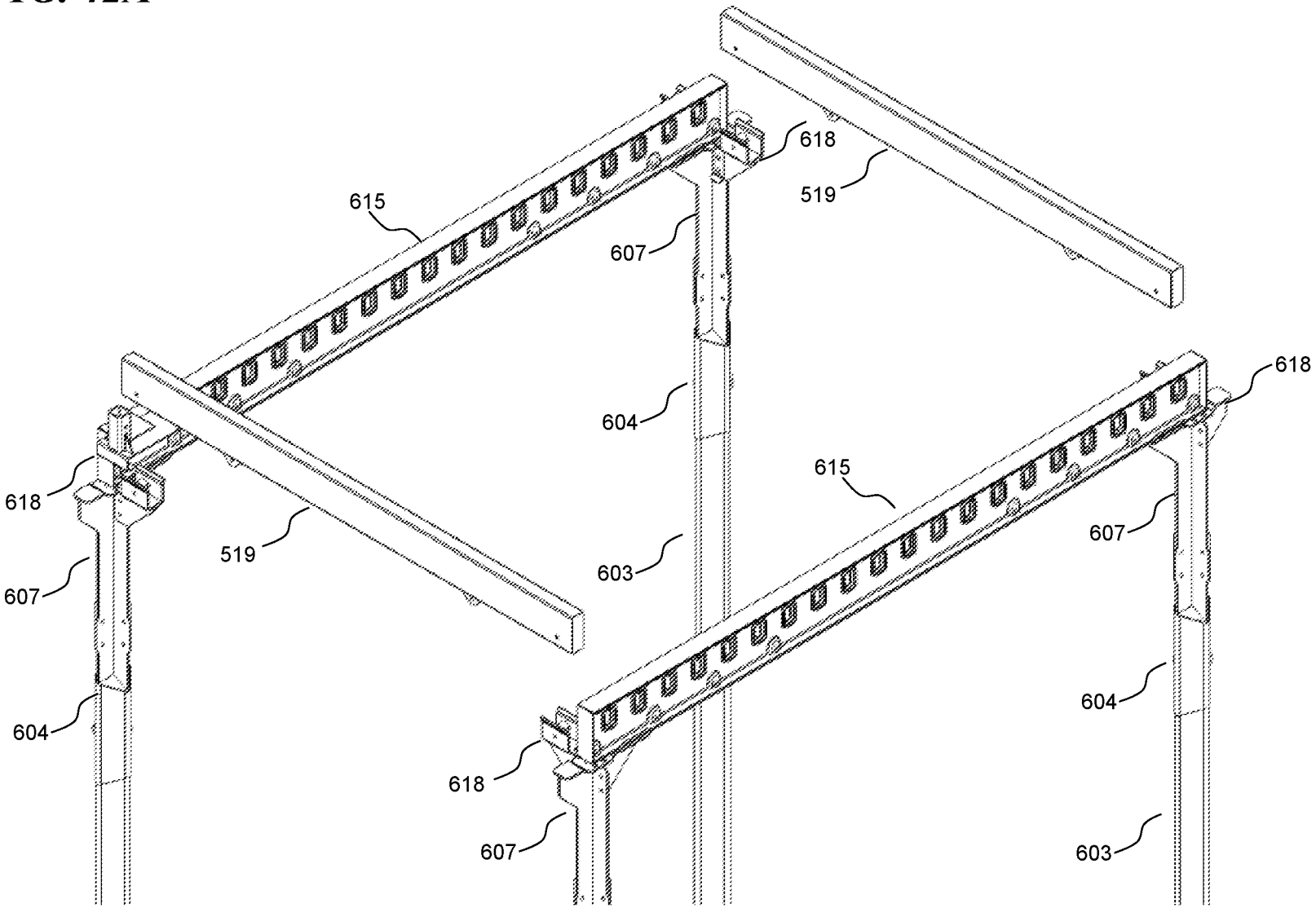
FIGS. 42A-42E shows an alternative configuration of two senior beams being connected to various verticals according to some embodiments of the present disclosure.
Figure 42B:
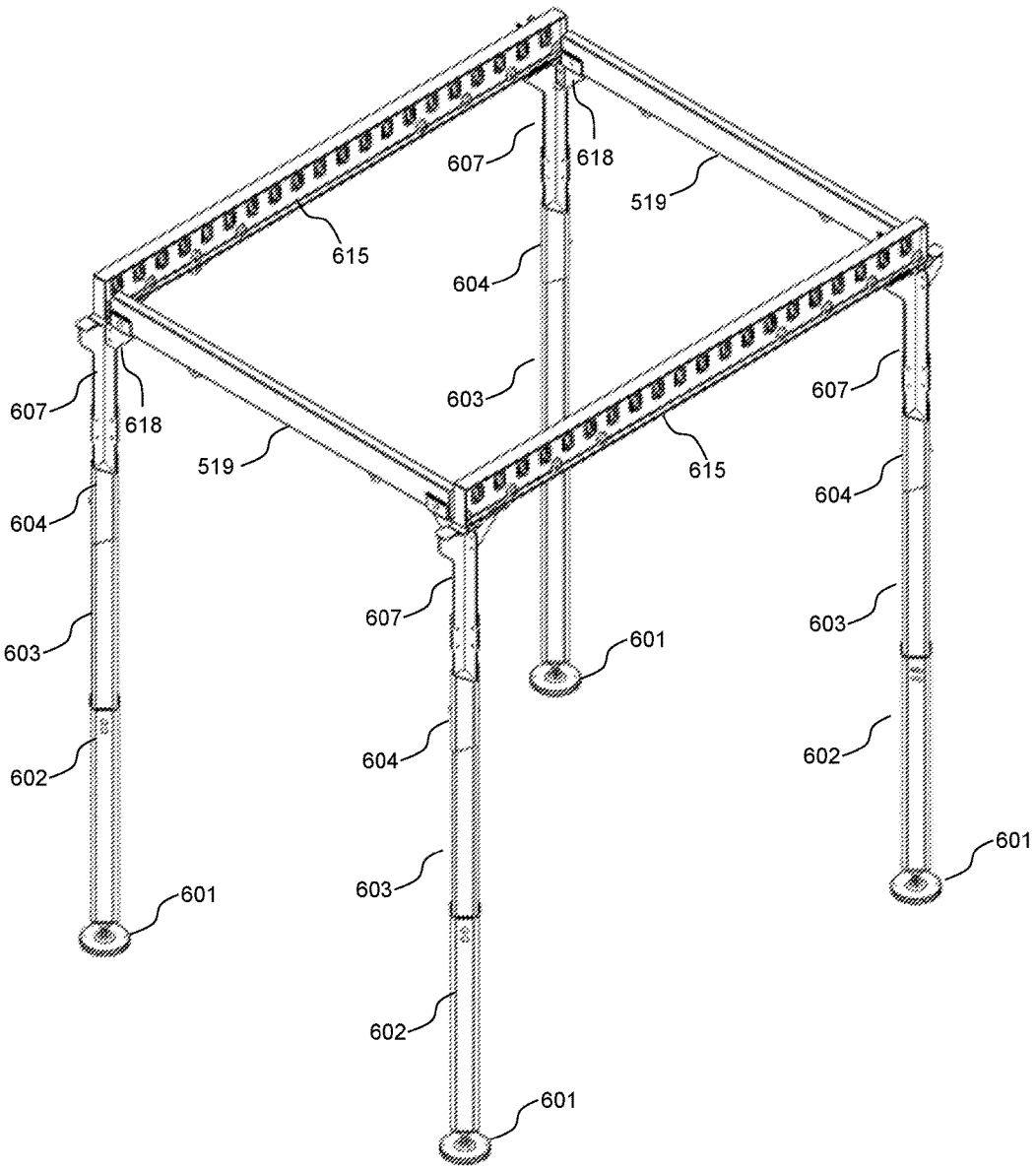
Figure 42C:
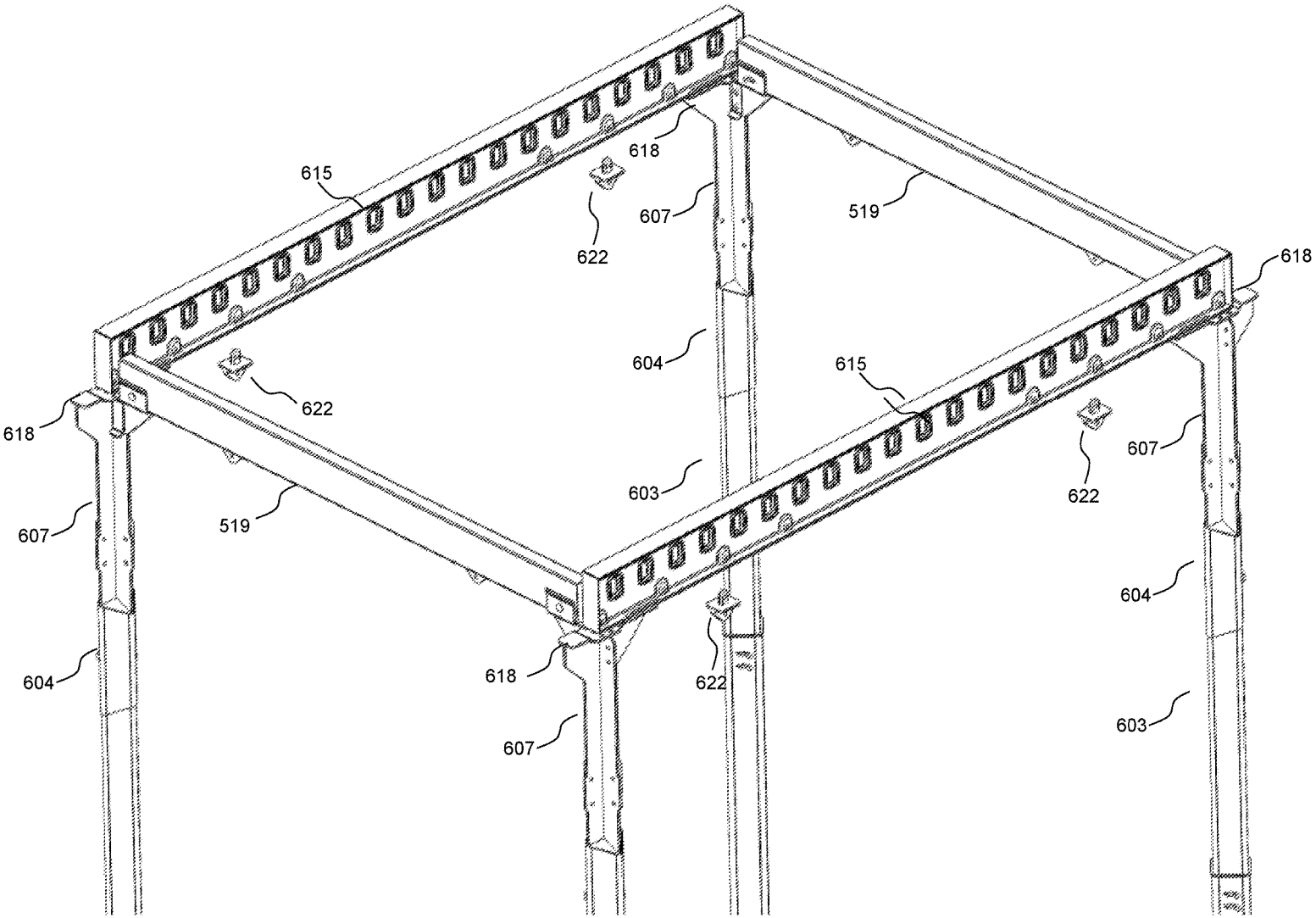
Figure 42D:
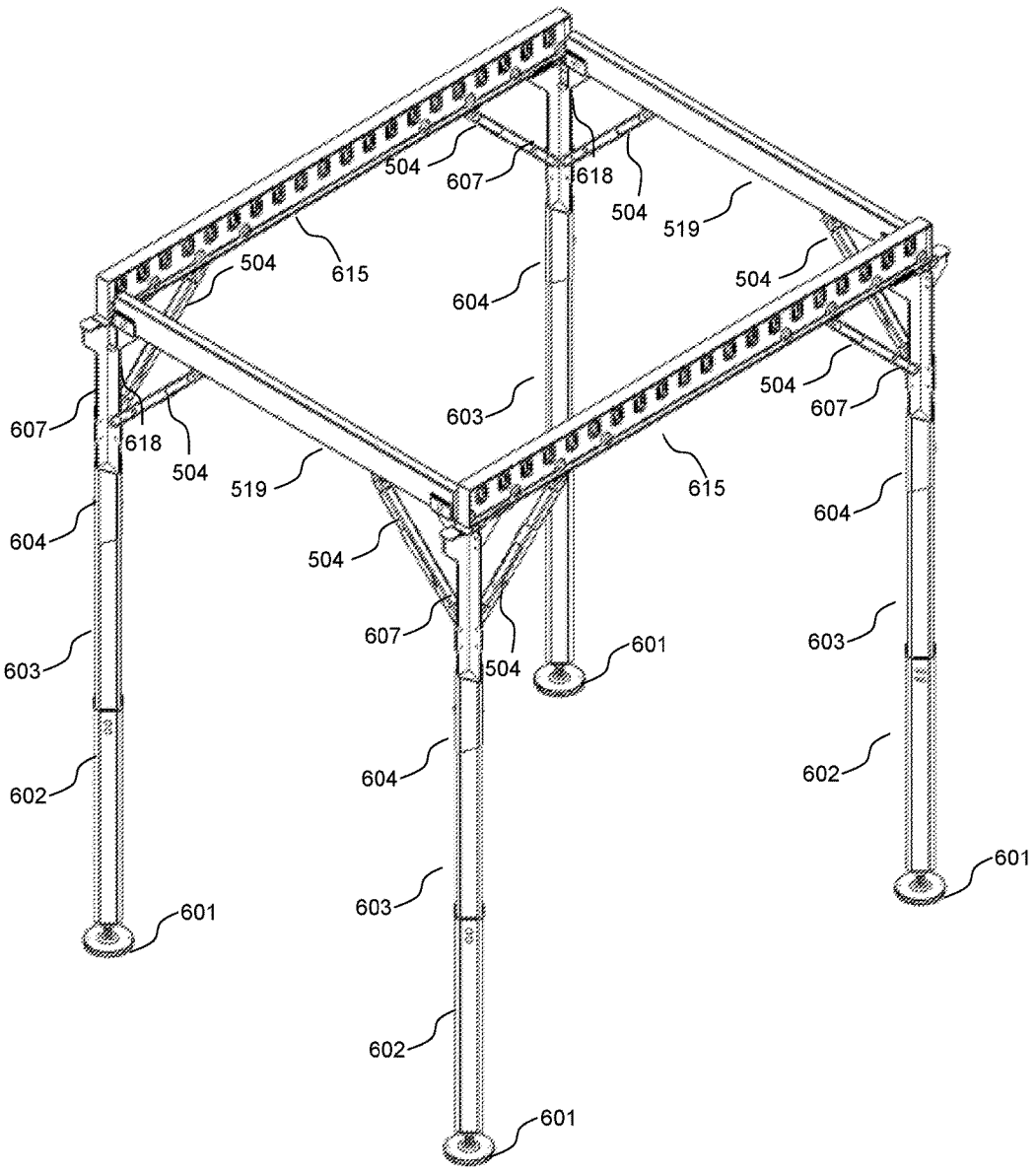
Figure 42E:
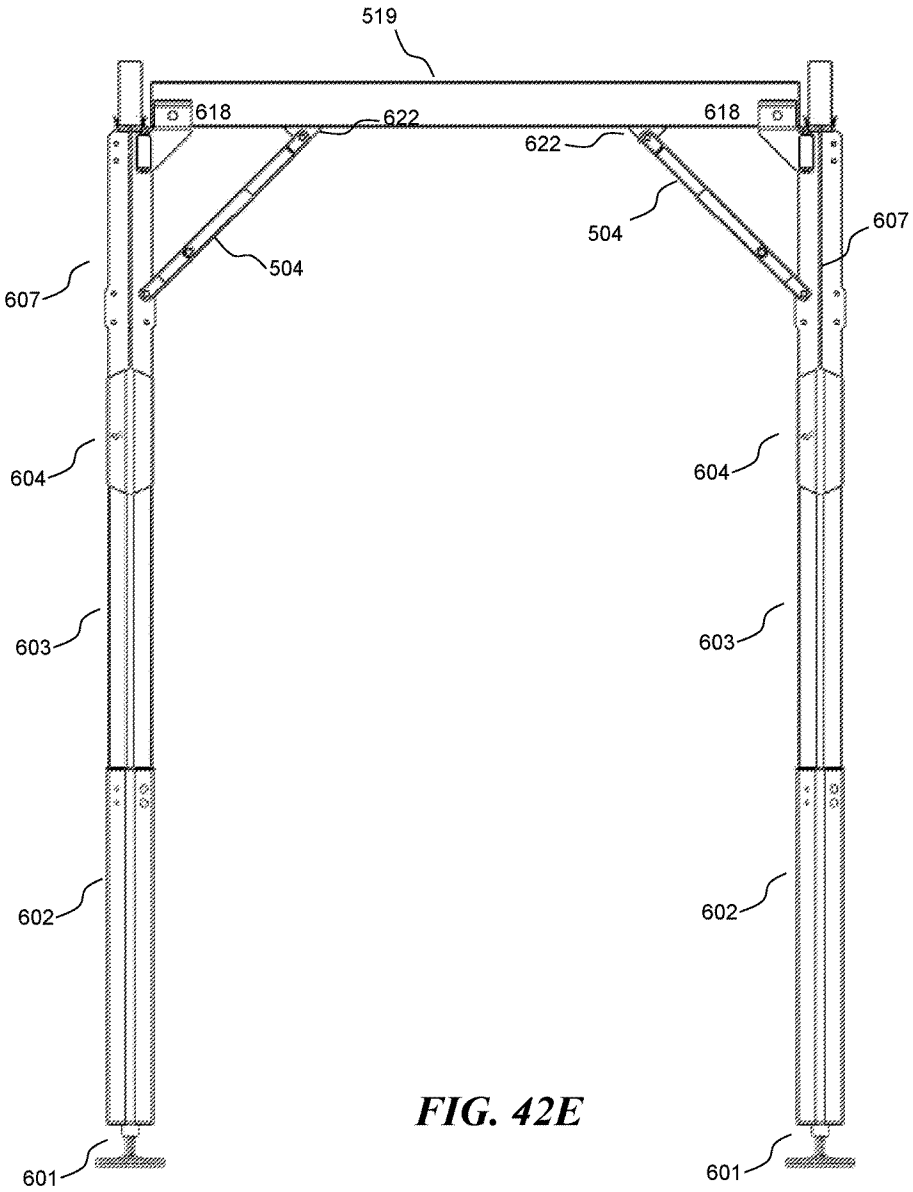

FIGS. 42A-42E shows an alternative configuration of two senior beams being connected to various verticals according to some embodiments of the present disclosure. Here, the configuration shown in FIGS. 42A-42E is similar to the configuration shown in FIGS. 21A-21F except there are alternate plus parts 607, alternate rod headers 612, and alternate header beams 615. In addition, in FIG. 42C, the configuration utilizes an alternate bracket configuration 618 and bracing connectors 622. Each of the bracing connectors 622 can reside within an alternate header beam 615 and/or a senior beam 519. In FIG. 42D, a brace 504 can be connected to the alternate plus part 607 at one end and the bracing connector 622 at an opposite end. In some embodiments, the brace 504 connections can be made via a bracing cap 527, as discussed in relation to FIG. 8. A bracing cap 527 can be received at each end of the brace 504, and the free ends of the bracing cap 527 can be attached to a hole on the plus part 503 and the clamp 522, respectively. The attachments can then be secured via a pin. In addition, in the adjacent side, the brace 504 is connected (similarly, via a bracing cap 527) to the underside of the alternate header beam 615. FIG. 42E shows a front view of the configuration. Each brace 504 is connected via bracing caps 527 to the bracing connector 622 of the senior beam 519 at one end and the alternate plus part 607 at an opposite end, providing support to the senior beam 519.

Figure 43:
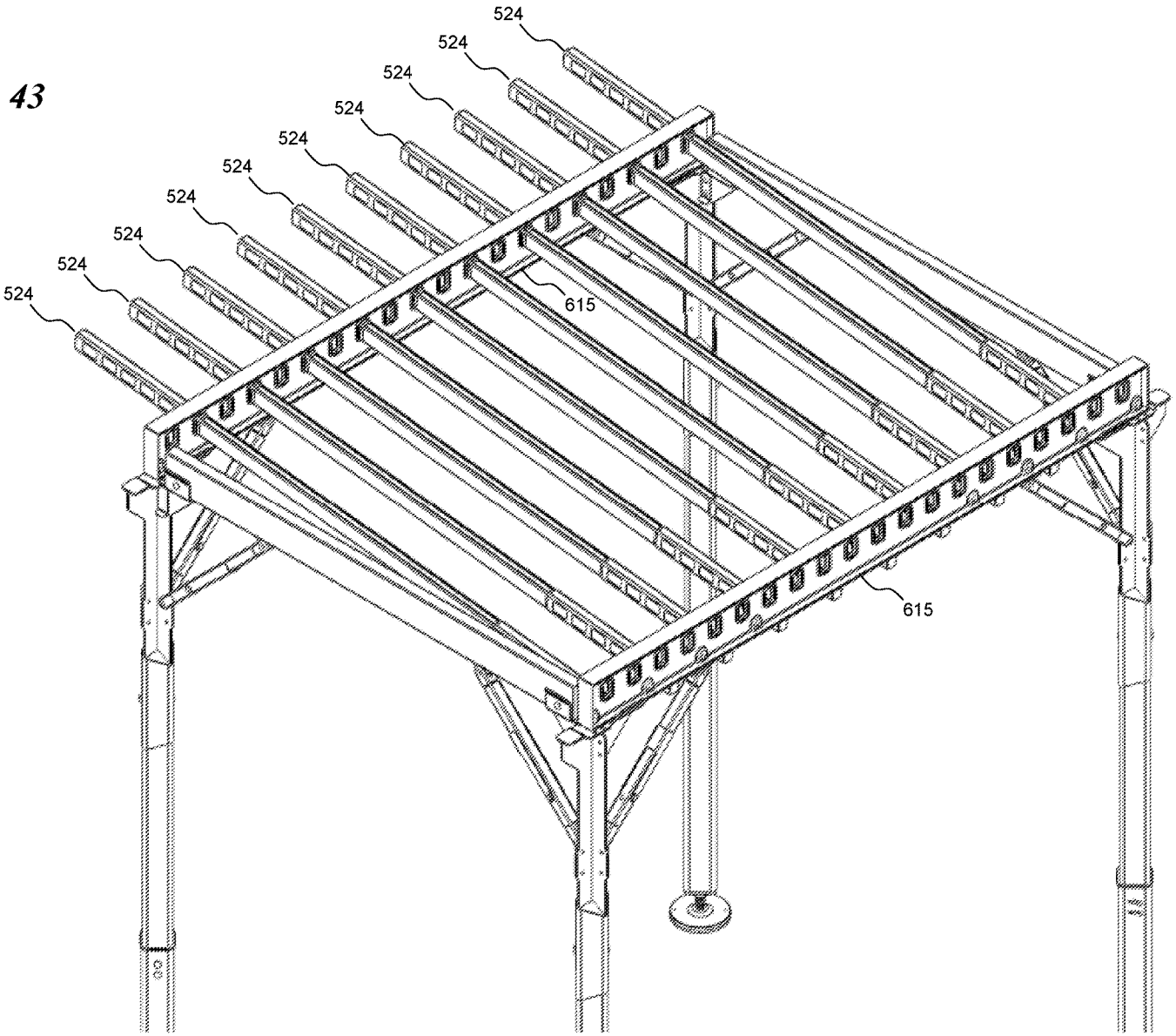
FIG. 43 shows an alternative configuration of various junior beams being connected to various header beams according to some embodiments of the present disclosure.

FIG. 43 shows an alternative configuration of various junior beams being connected to various header beams according to some embodiments of the present disclosure. The configuration shown in FIG. 43 is similar to the configuration shown in FIG. 22 except that it includes an alternate header beam 615.

Figure 44:
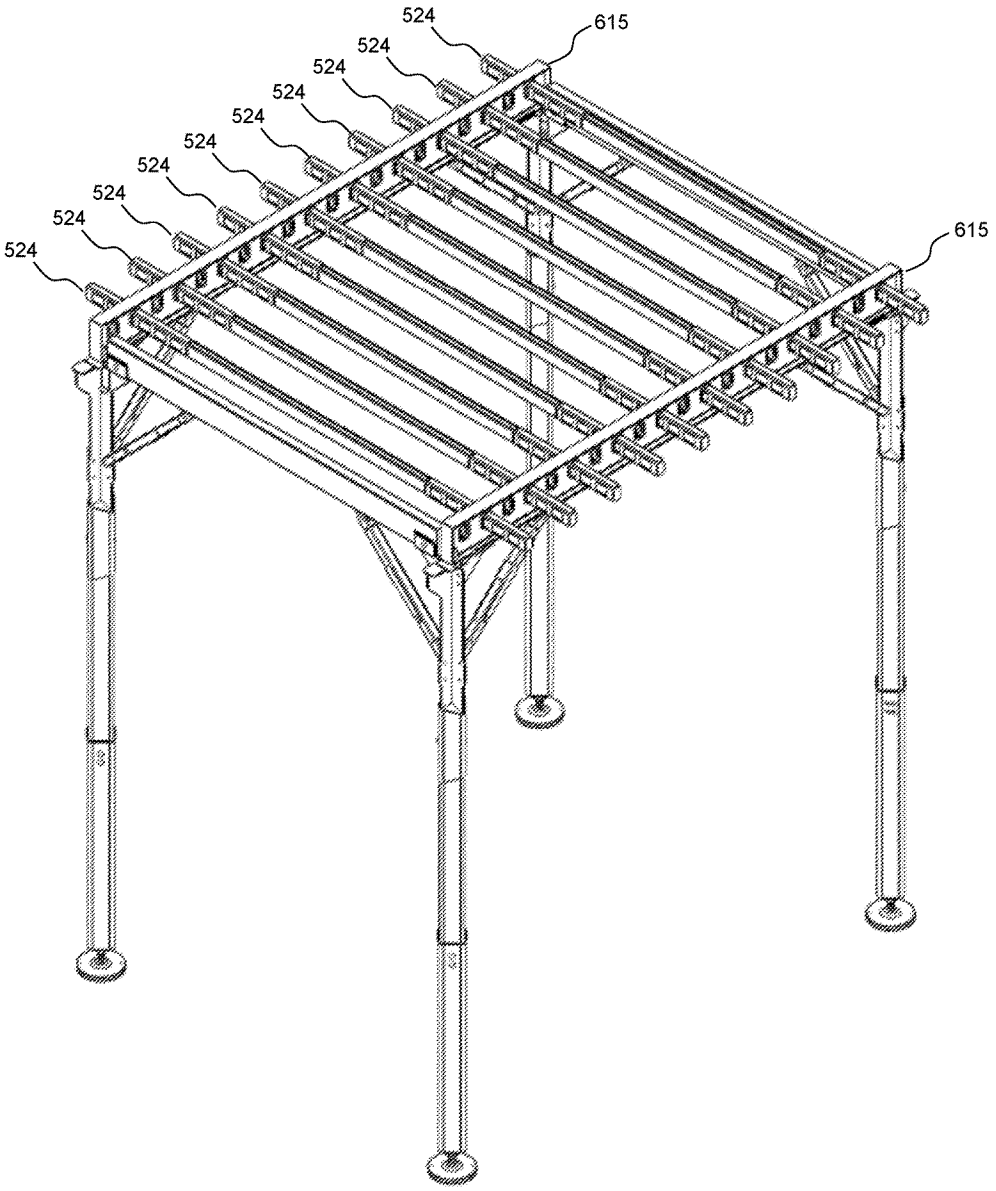
FIG. 44 shows an alternative configuration of various junior beams connected to various header beams according to some embodiments of the present disclosure.

FIG. 44 shows an alternative configuration of various junior beams connected to various header beams according to some embodiments of the present disclosure. The configuration shown in FIG. 44 is similar to the configuration shown in FIG. 24 except that it includes an alternate header beam 615.

Figure 45:
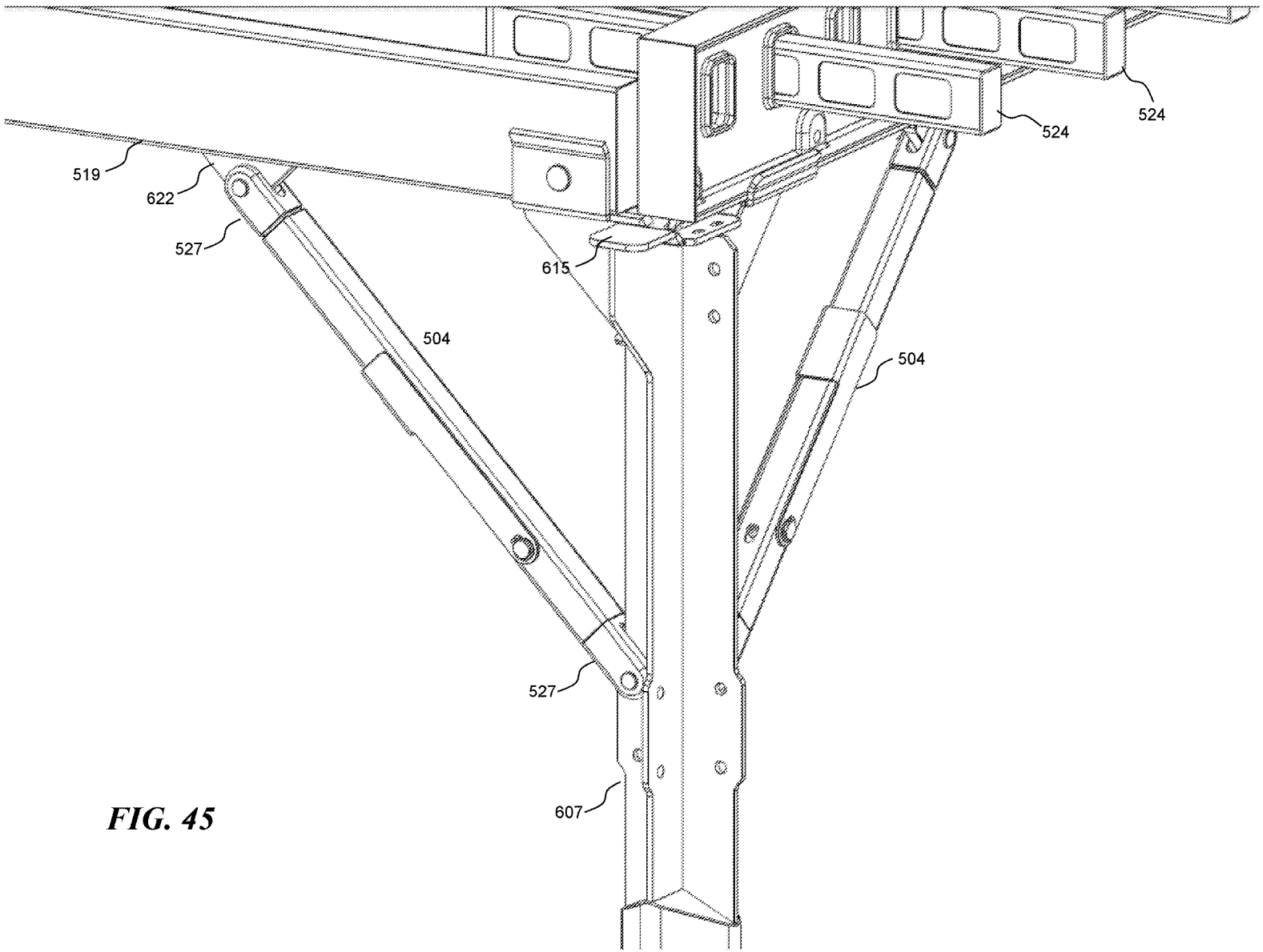
FIG. 45 shows a zoomed view of an alternative configuration of a corner of a sidewalk shed section according to some embodiments of the present disclosure.

FIG. 45 shows a zoomed view of an alternative configuration of a corner of a sidewalk shed section according to some embodiments of the present disclosure. The configuration shown in FIG. 45 is similar to the configuration shown in FIG. 24 except that it includes an alternate header beam 615, a bracing connector 622, and an alternate plus part 607.

Figure 46:
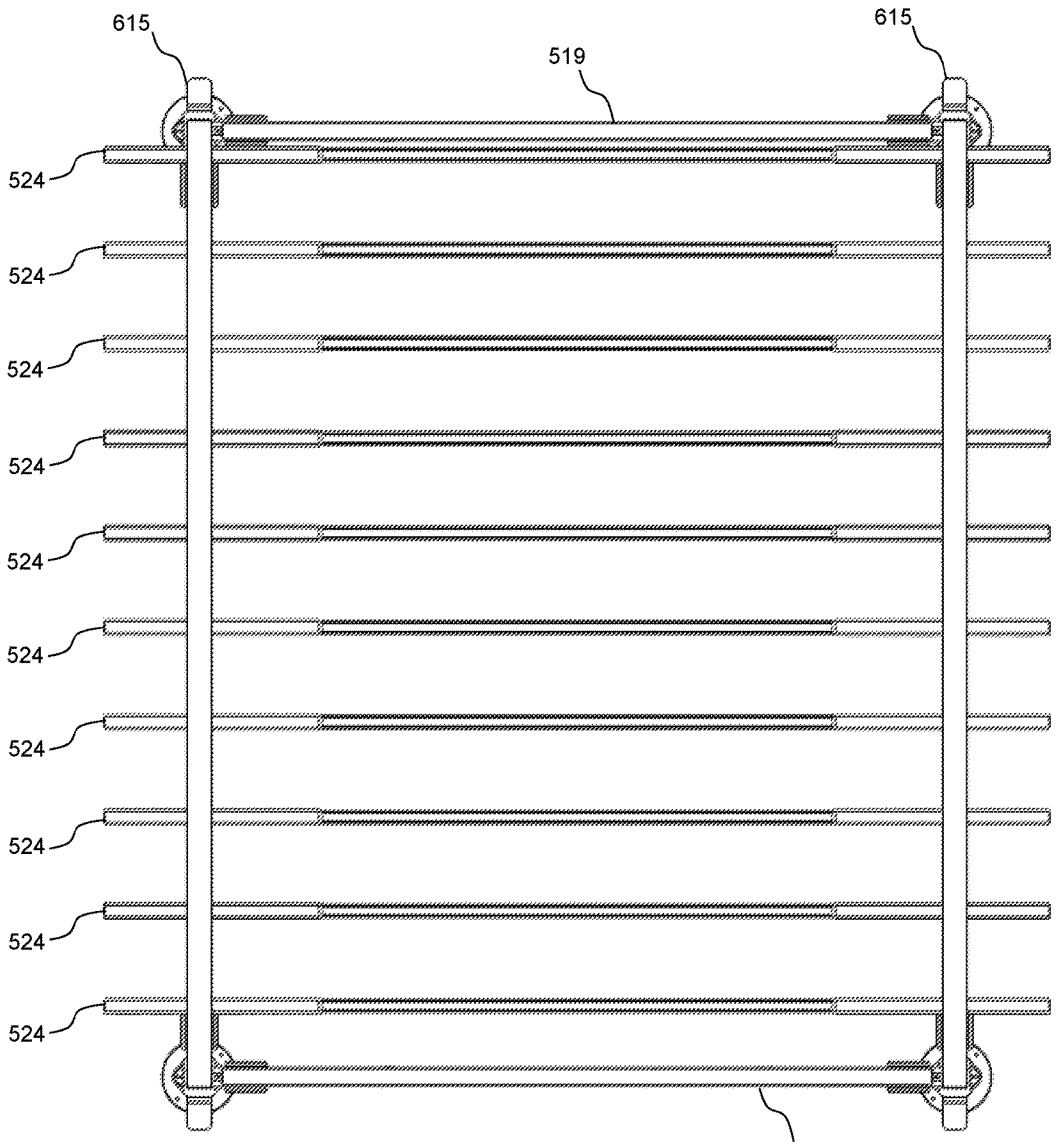
FIG. 46 shows a top view of the assembled junior beams according to some embodiments of the present disclosure.

FIG. 46 shows a top view of the assembled junior beams 519 according to some embodiments of the present disclosure. Here, the various junior beams 524 span the width of the sidewalk shed section and rest on the header beams 515.

Figure 47:
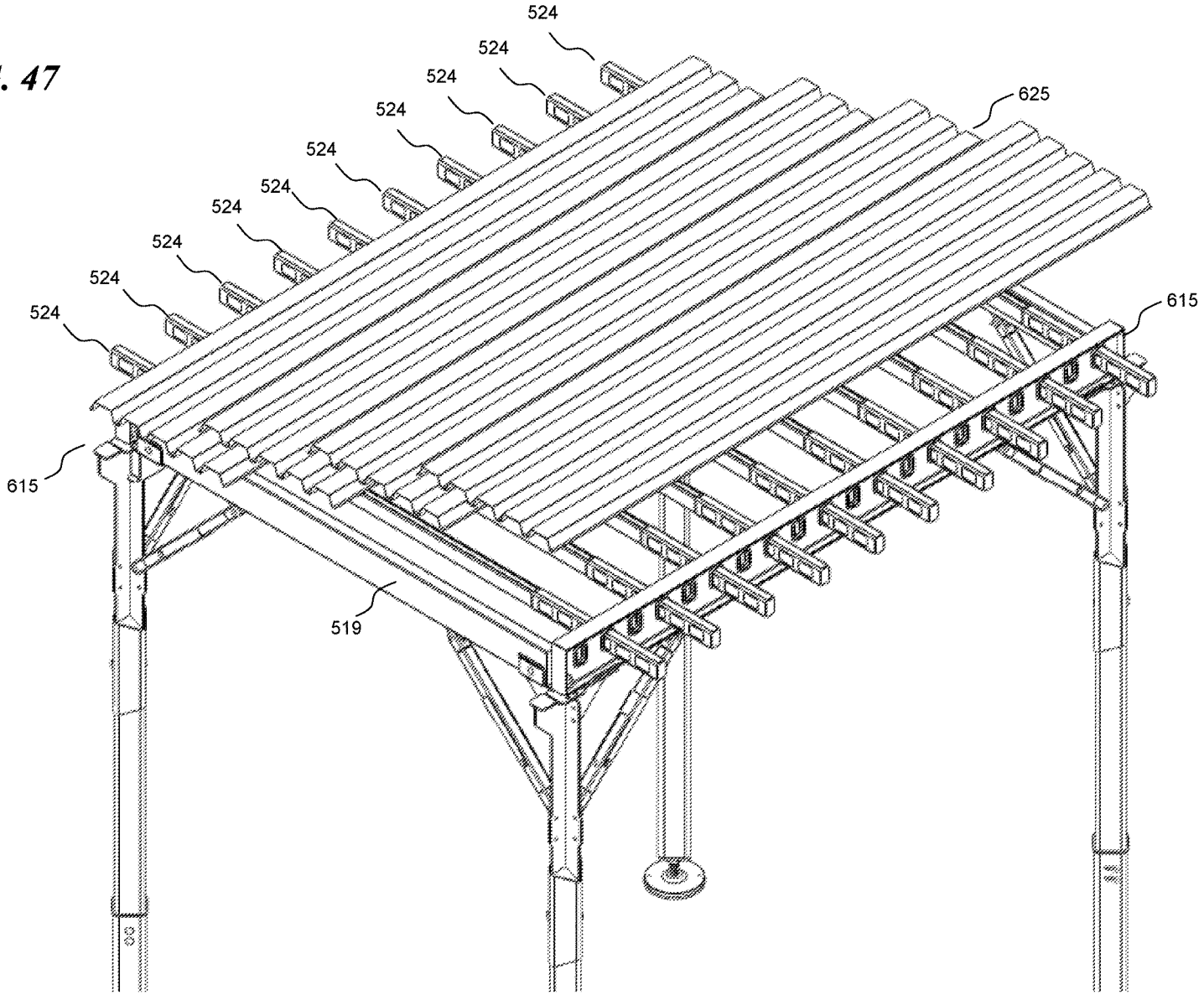
FIG. 47 shows an alternative configuration of corrugated sheets being added to the sidewalk shed section according to some embodiments of the present disclosure.
Figure 48:
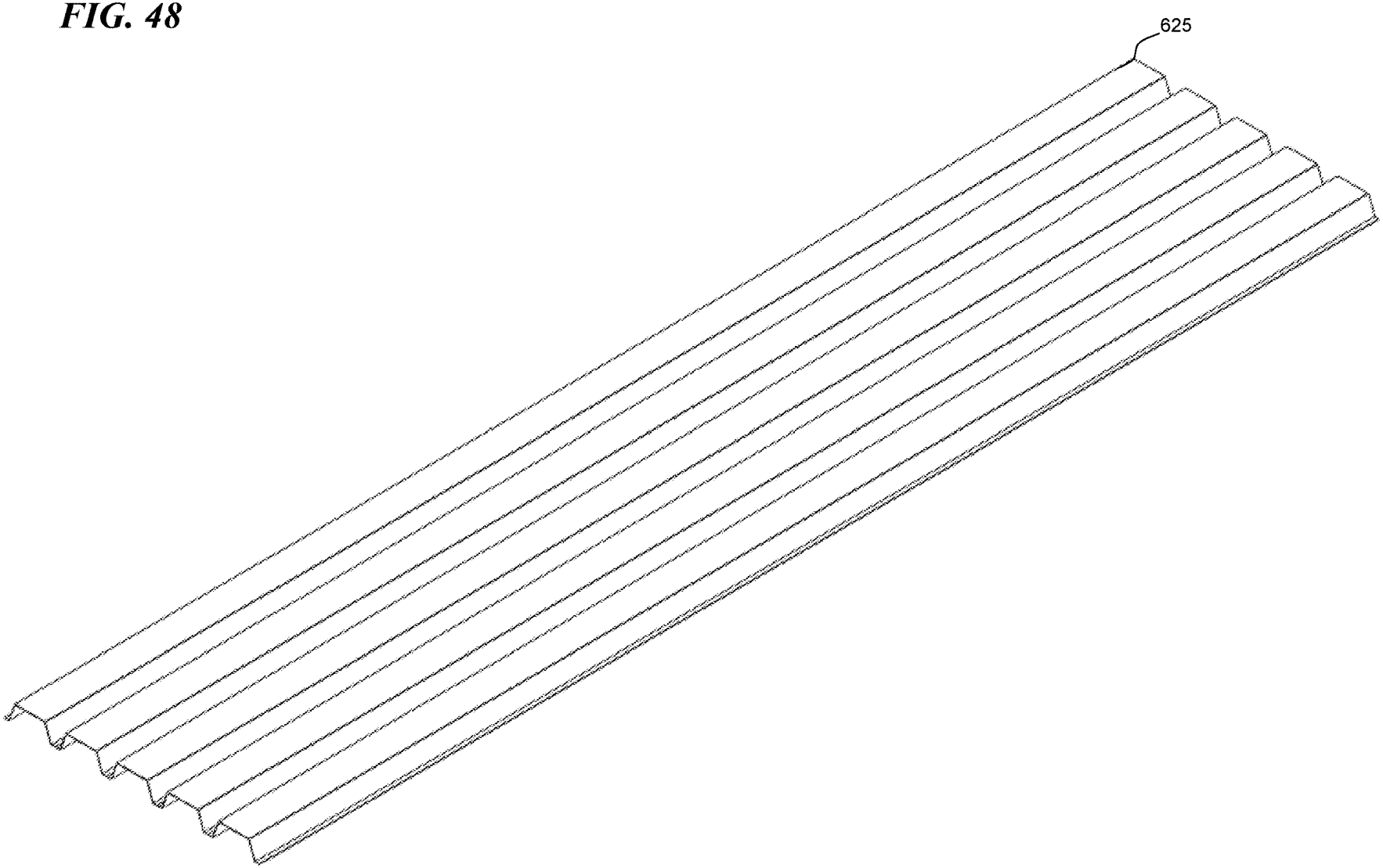
FIG. 48 shows an alternative configuration of a corrugated sheet according to some embodiments of the present disclosure.

FIG. 47 shows an alternative configuration of corrugated sheets 625 being added to the sidewalk shed section according to some embodiments of the present disclosure. In particular, the corrugated sheets 625 rest perpendicularly on the junior beams 524 and the senior beams 519. In some embodiments, the corrugated sheets 625 may be made of a metal material, such as carbon steel or stainless steel. In some embodiments, the corrugated sheets 625 may be attached/secured to the junior beams 524. FIG. 48 shows a corrugated sheet 625 according to some embodiments of the present disclosure. In relation to the corrugated sheet 525 of FIG. 28, corrugated sheet 625 can have mounds with taller heights but less space in between each mound.

Figure 49A:
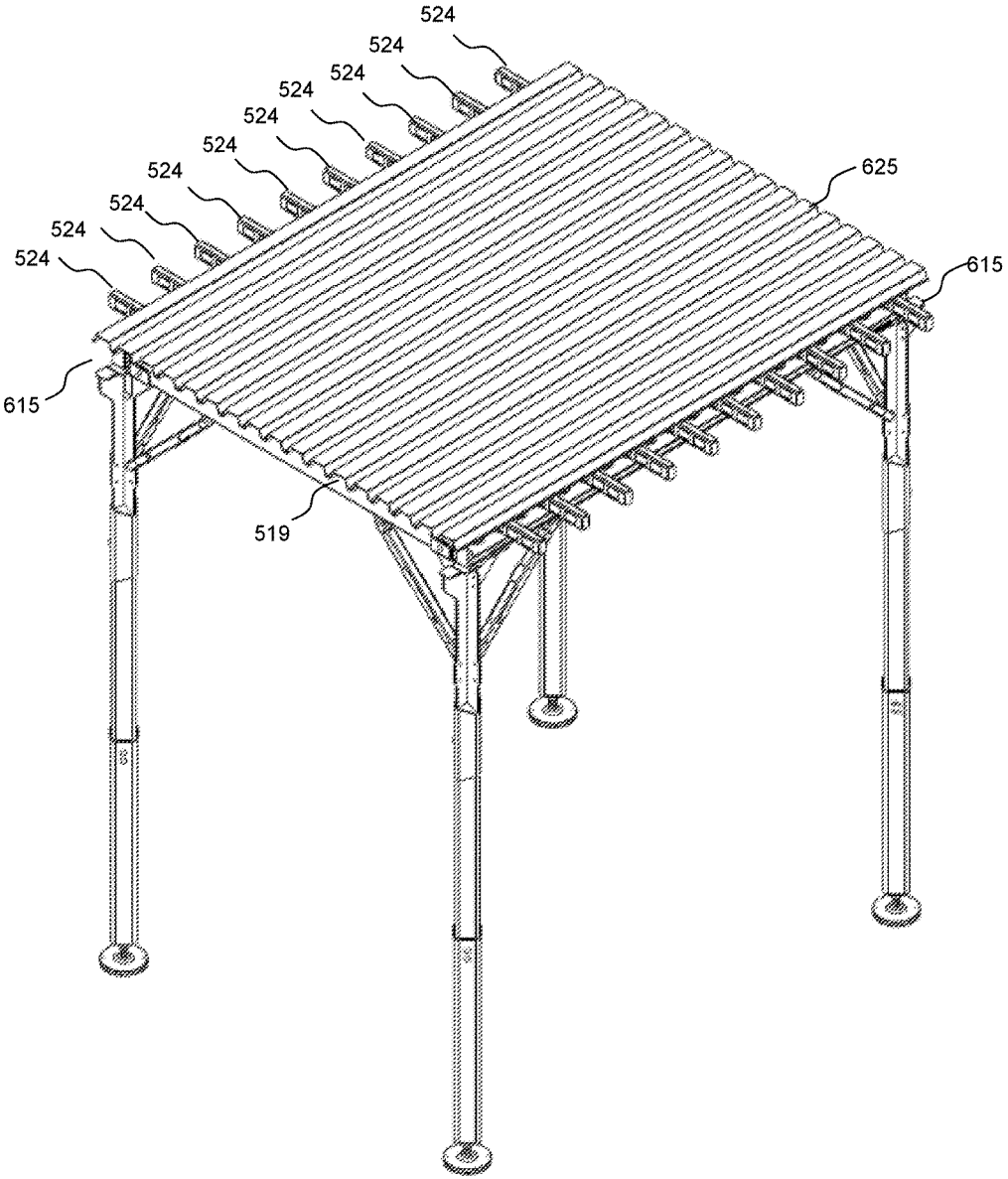
FIG. 49A shows a perspective view of an alternative configuration of a sidewalk shed section with corrugated sheets according to some embodiments of the present disclosure.
Figure 49B:
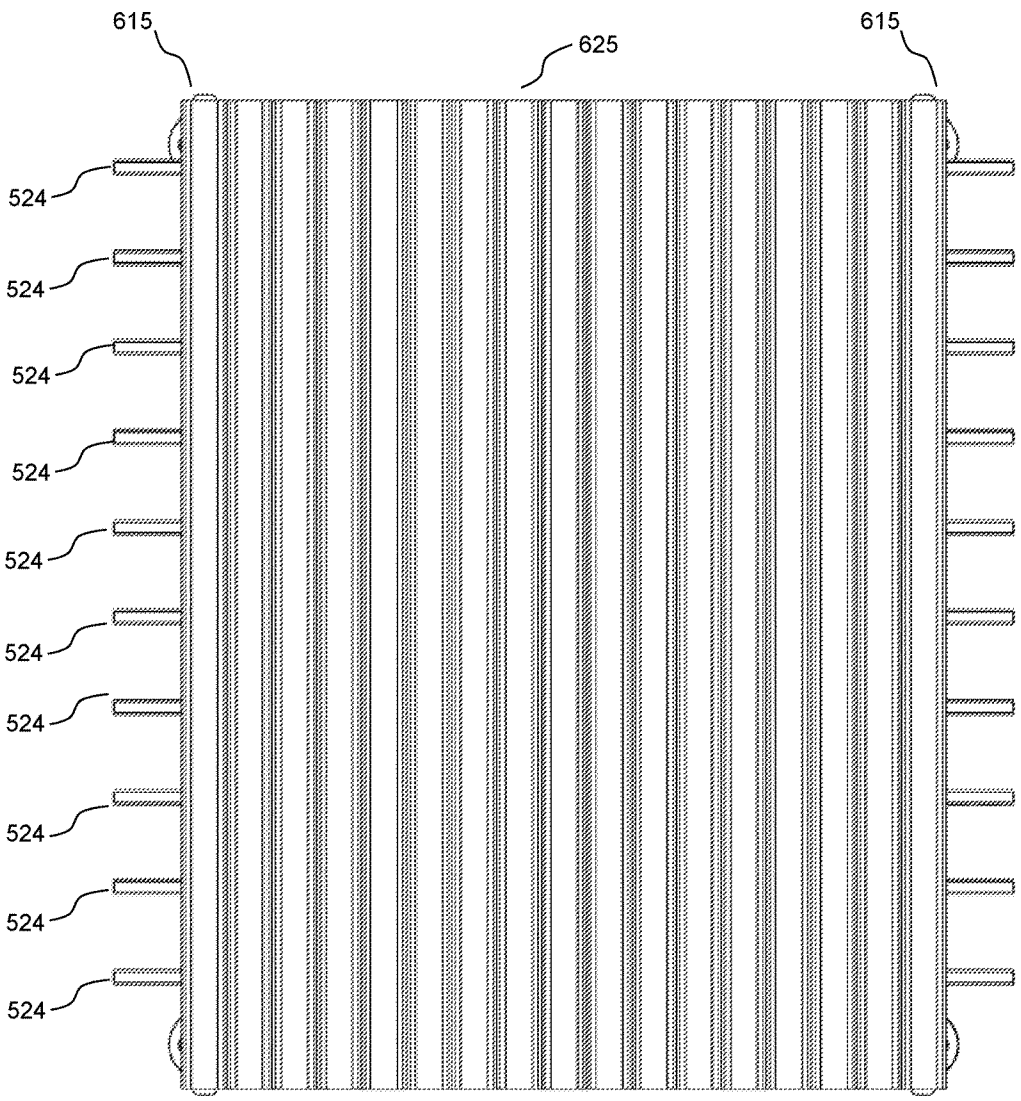
FIG. 49B shows top view of an alternative configuration of a sidewalk shed section with corrugated sheets according to some embodiments of the present disclosure.
Figure 49C:
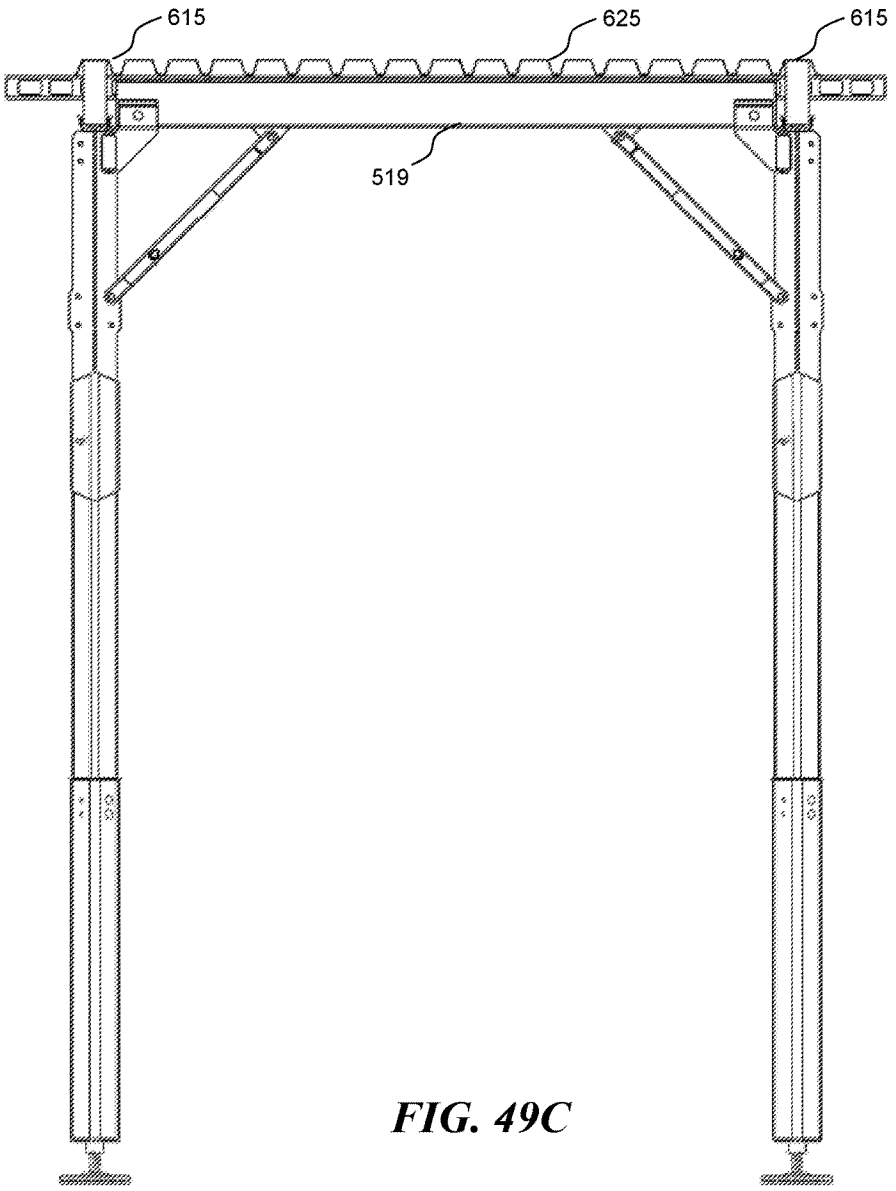
FIG. 49C shows a front view of an alternative configuration of a sidewalk shed section with corrugated sheets according to some embodiments of the present disclosure.

FIG. 49A shows a perspective view of an alternative configuration of a sidewalk shed section with corrugated sheets 625 according to some embodiments of the present disclosure. FIG. 49B shows top view of an alternative configuration of a sidewalk shed section with corrugated sheets 625 according to some embodiments of the present disclosure. FIG. 49C shows a front view of an alternative configuration of a sidewalk shed section with corrugated sheets 625 according to some embodiments of the present disclosure.

Figure 50A:
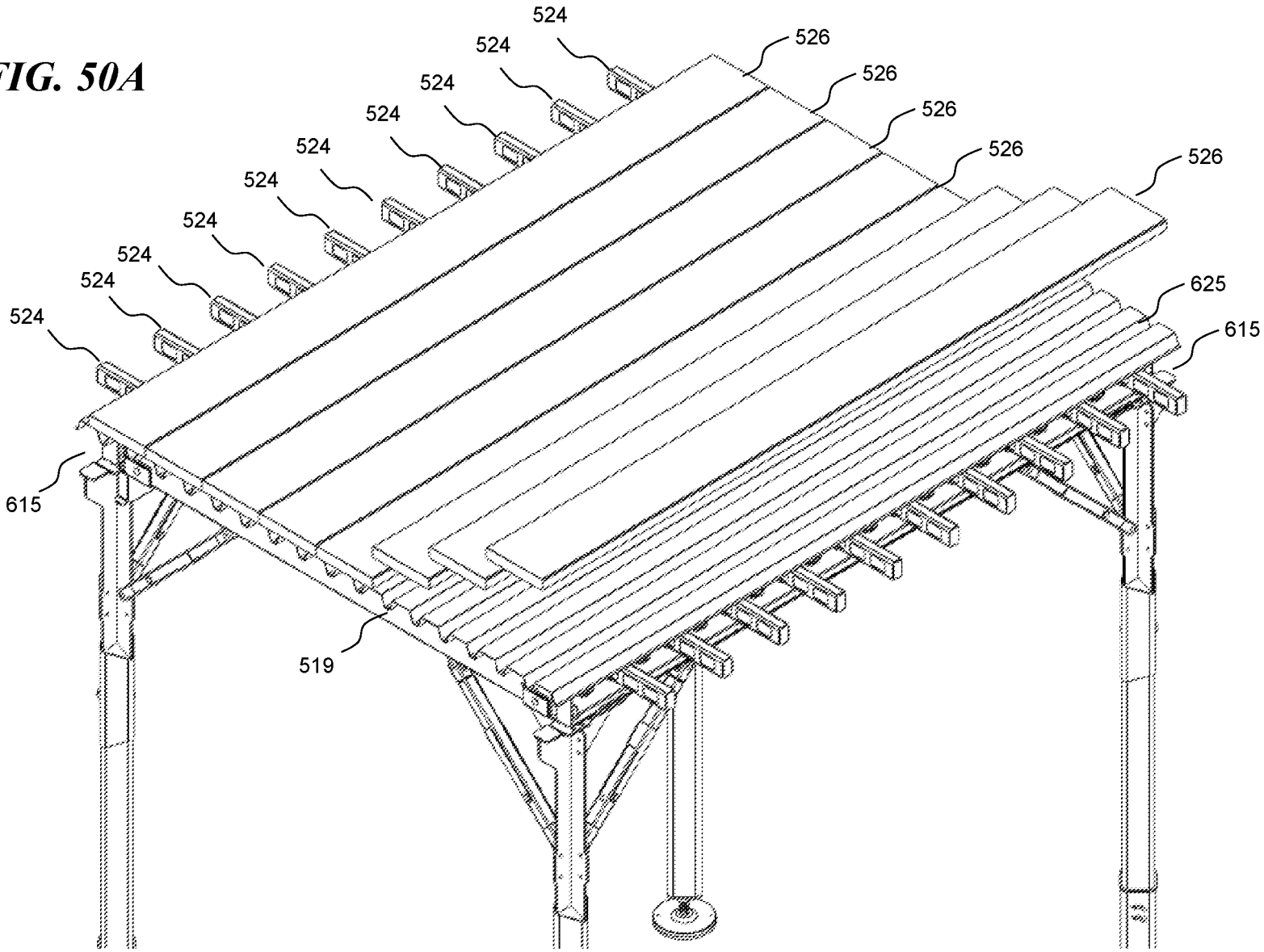
FIG. 50A shows an alternative configuration of various planks being added to a sidewalk shed section according to some embodiments of the present disclosure.
Figure 50B:
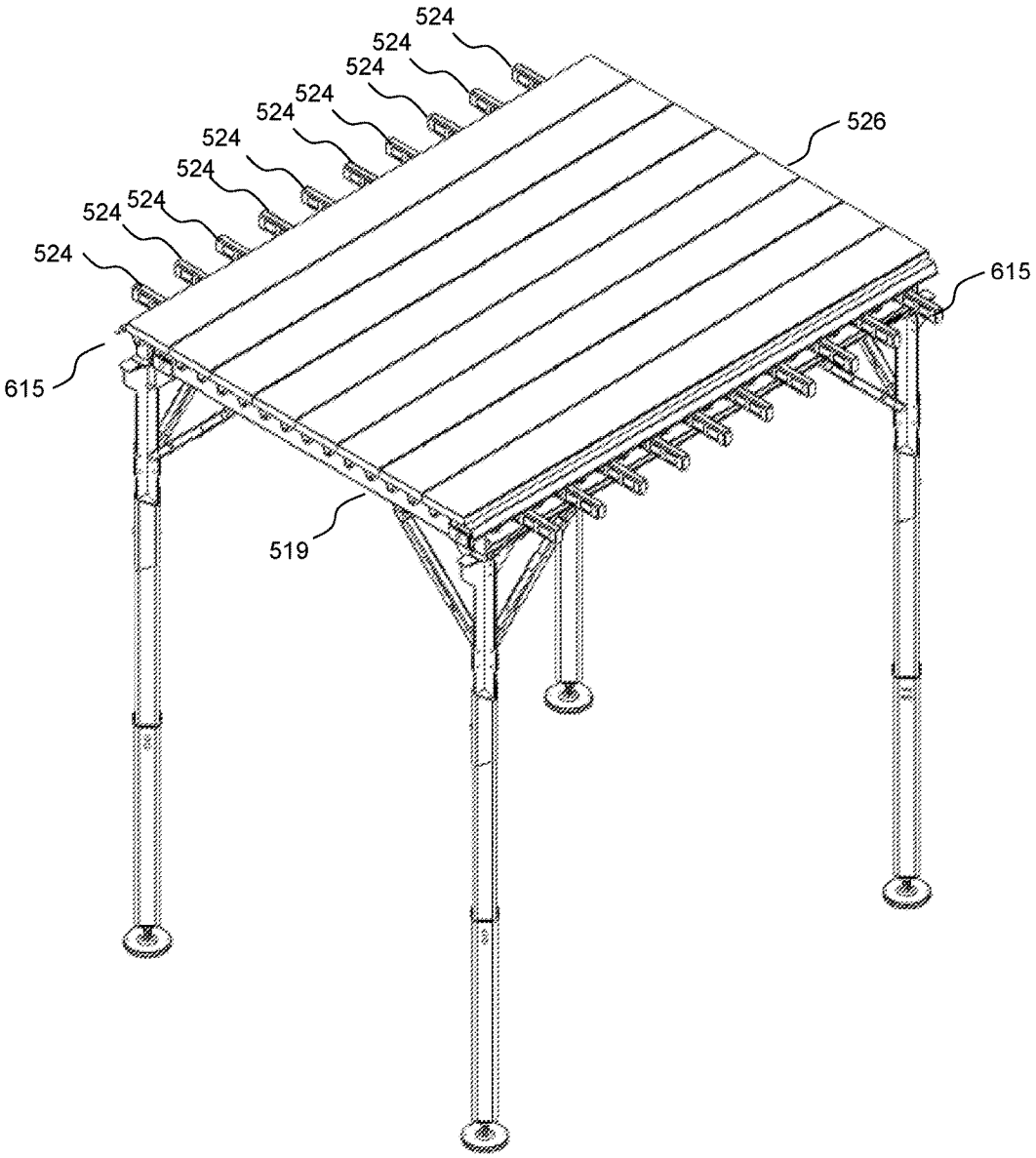
FIG. 50B shows an alternative configuration of various planks added to a sidewalk shed section according to some embodiments of the present disclosure.
Figure 50C:
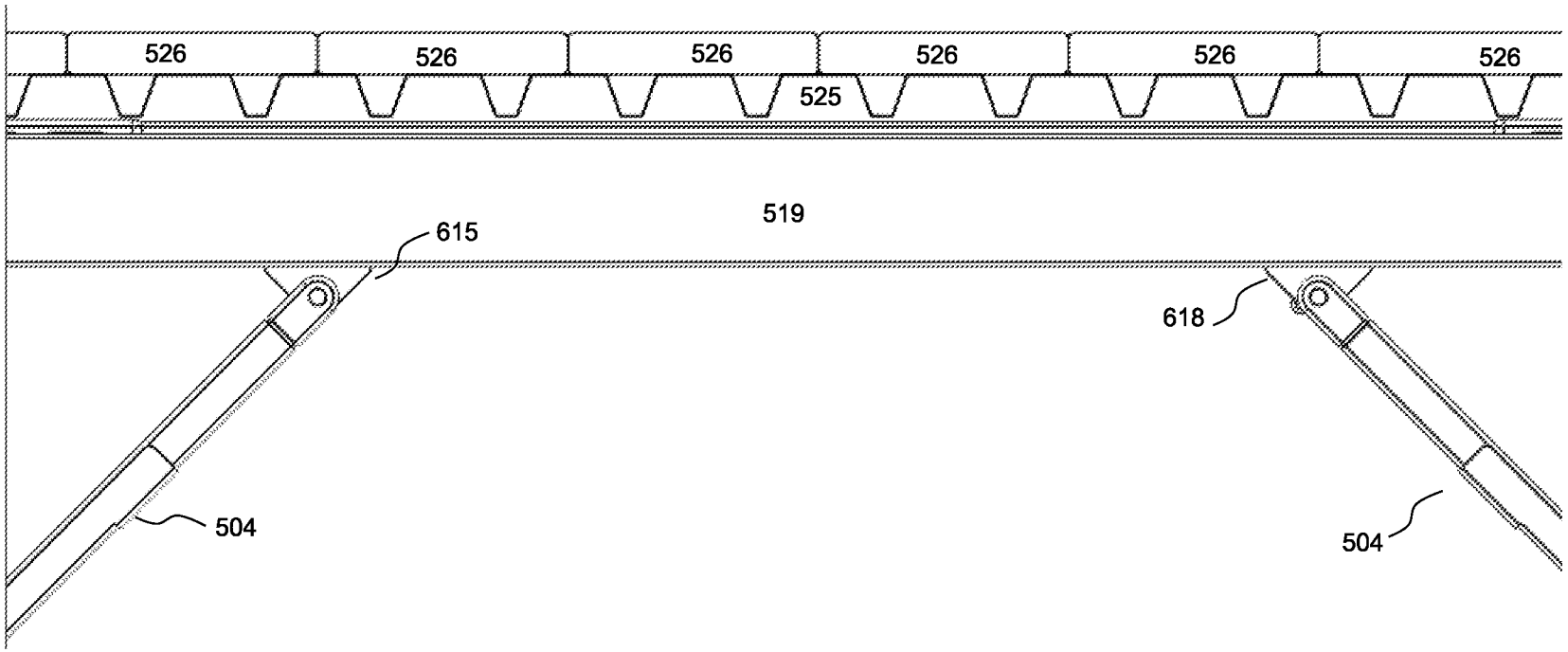
FIG. 50C shows side views of an alternative configuration of the various planks added to a sidewalk shed section according to some embodiments of the present disclosure.

FIG. 50A shows an alternative configuration of various planks 526 being added to a sidewalk shed section according to some embodiments of the present disclosure. FIG. 50B shows an alternative configuration of various planks 526 added to a sidewalk shed section according to some embodiments of the present disclosure. FIG. 50C shows side views of an alternative configuration of the various planks 526 added to a sidewalk shed section according to some embodiments of the present disclosure. FIG. 50C shows side views of the various planks 526 added to a sidewalk shed section according to some embodiments of the present disclosure. In some embodiments, the planks 526 can be wooden and can simply rest on the corrugated sheet 625, offering ease of assembly and disassembly. However, because of the friction between the corrugated sheets 625 and the planks 526, the planks 526 are sufficiently secure to serve as a walking platform for workers.

Figure 51:
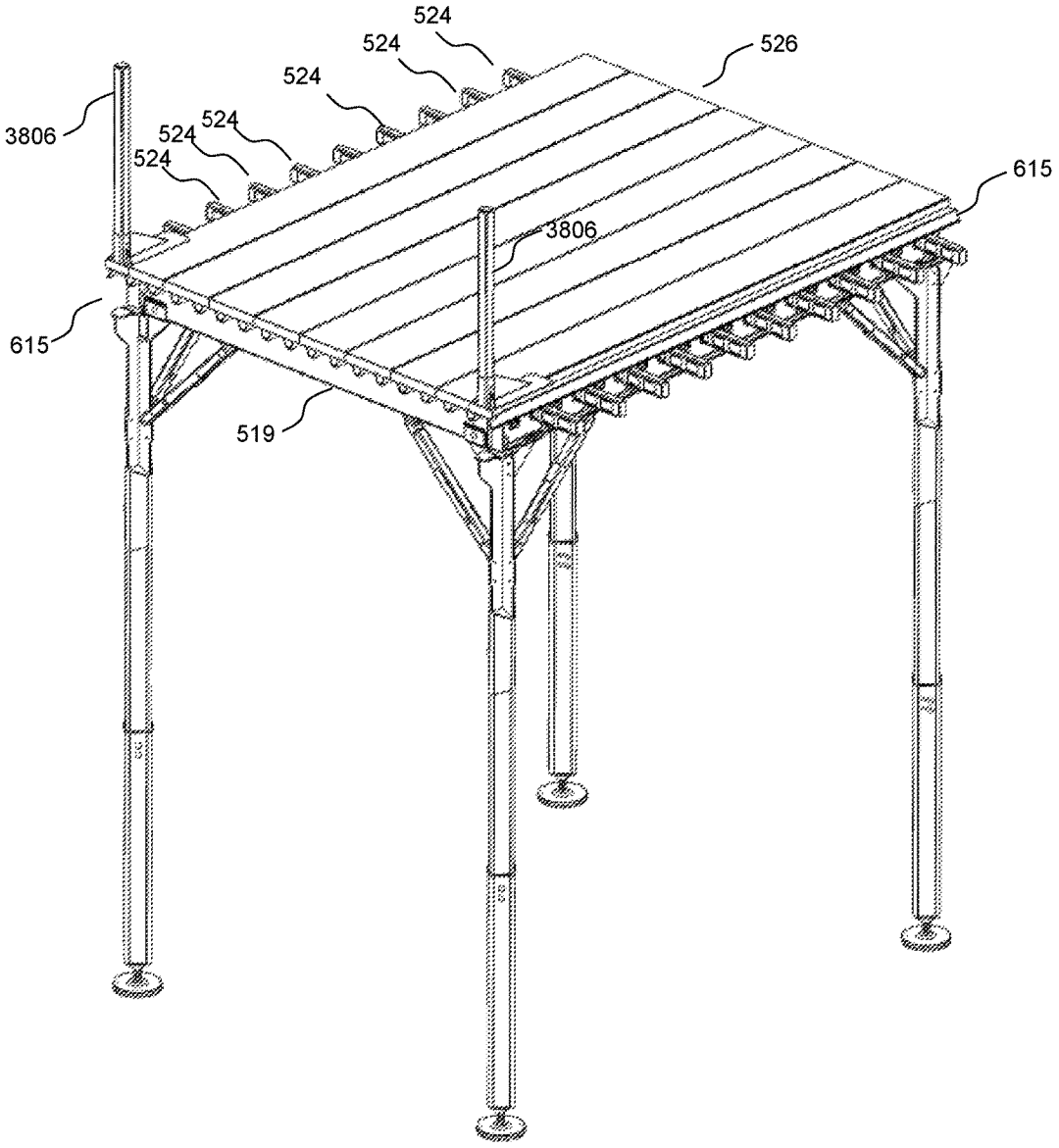
FIG. 51 shows a sidewalk shed section with two parapet rods according to some embodiments of the present disclosure.

FIG. 51 shows a sidewalk shed section with two parapet rods 3806 according to some embodiments of the present disclosure. The configuration shown in FIG. 51 can be similar to the configuration shown in FIG. 31 except with alternate header beams 615. In addition, the parapet rods 3806 can be mounted on a dedicated bracket, which is connected to one or more of the planks 526.

Figure 52:
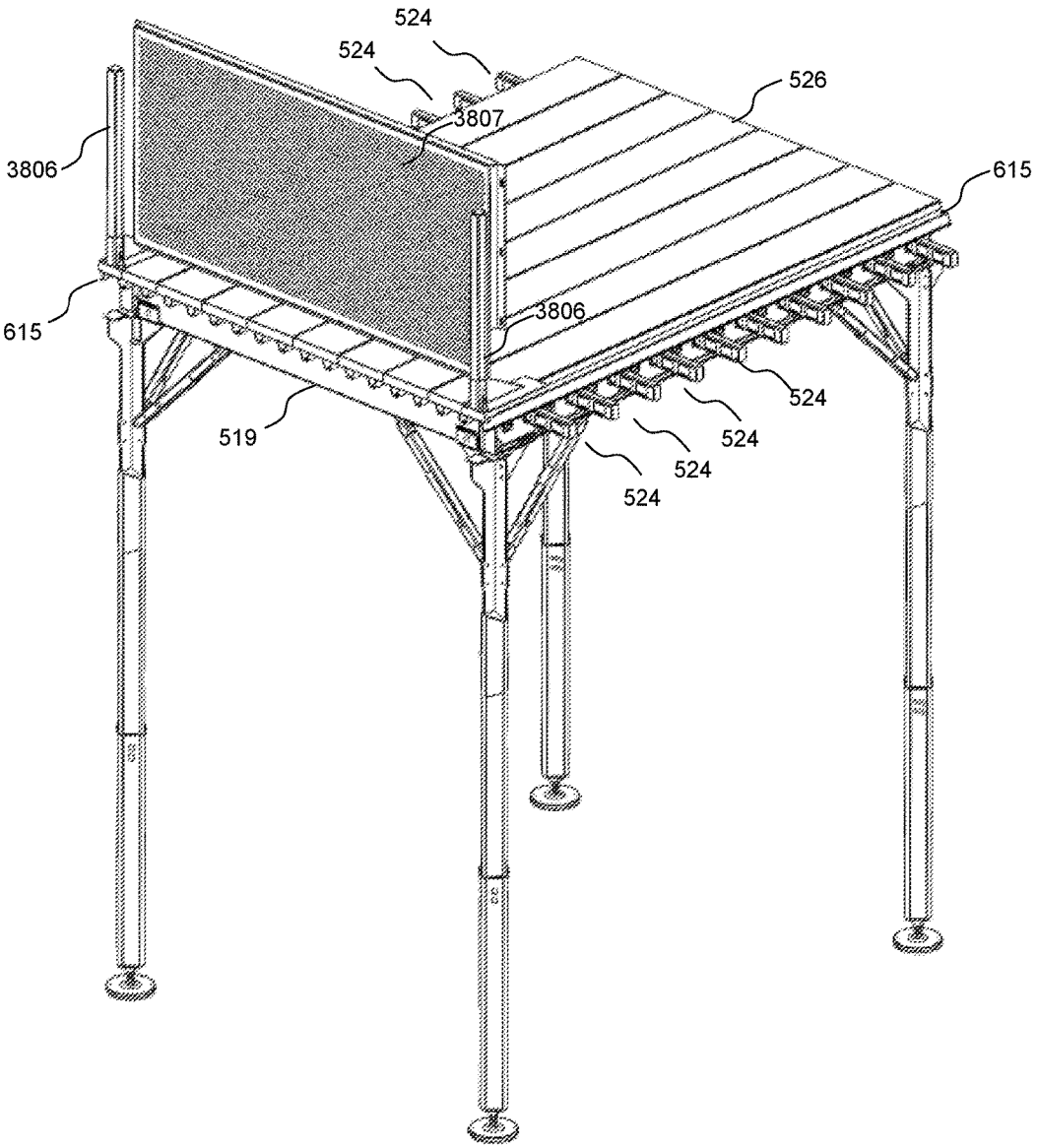
FIG. 52 shows a parapet being added to a sidewalk shed section according to some embodiments of the present disclosure.

FIG. 52 shows a parapet being added to a sidewalk shed section according to some embodiments of the present disclosure. The configuration shown in FIG. 52 can be similar to the configuration shown in FIG. 32 except with alternate header beams 615.

Figure 53:
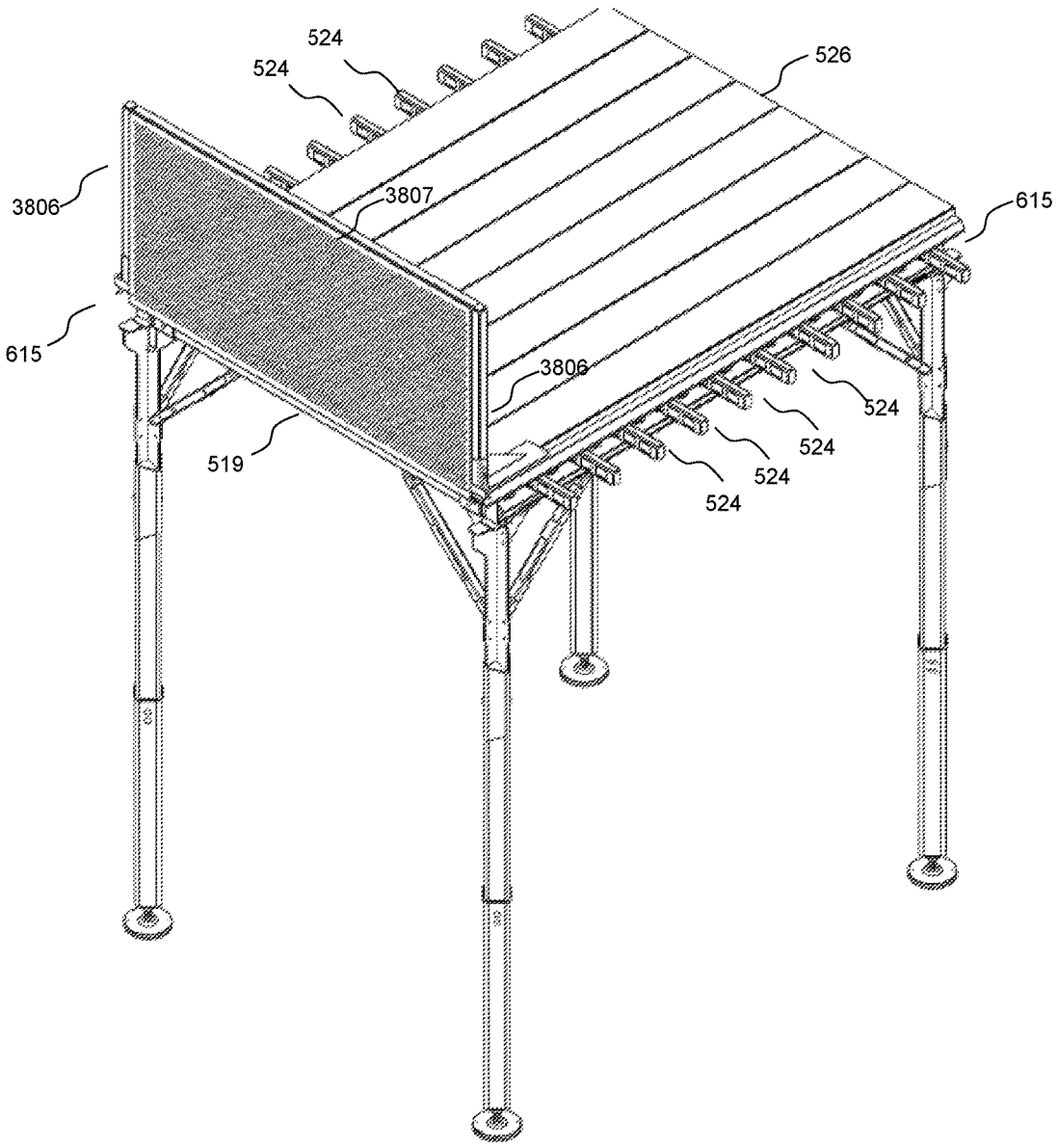
FIG. 53 shows a sidewalk shed section with a parapet according to some embodiments of the present disclosure.

FIG. 53 shows a sidewalk shed section with a parapet according to some embodiments of the present disclosure. The configuration shown in FIG. 53 can be similar to the configuration shown in FIG. 33 except with alternate header beams 615.

Figure 54:
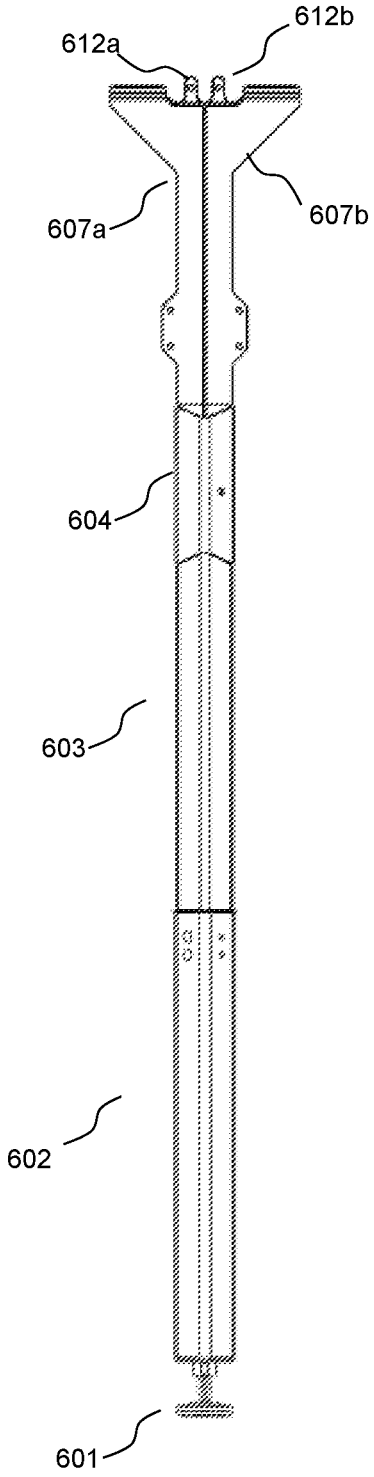
FIG. 54 shows a front view of a double-sided vertical according to some embodiments of the present disclosure.

FIG. 54 shows a front view of a double-sided vertical according to some embodiments of the present disclosure. The double-sided vertical is similar to the vertical of FIGS. 34A-34C except it includes two alternate rod headers 612*a-b* and two alternate plus parts 607*a-b*. The double-sided vertical can facilitate a bi-directional connection to alternate header beams 615.

Figure 55A:
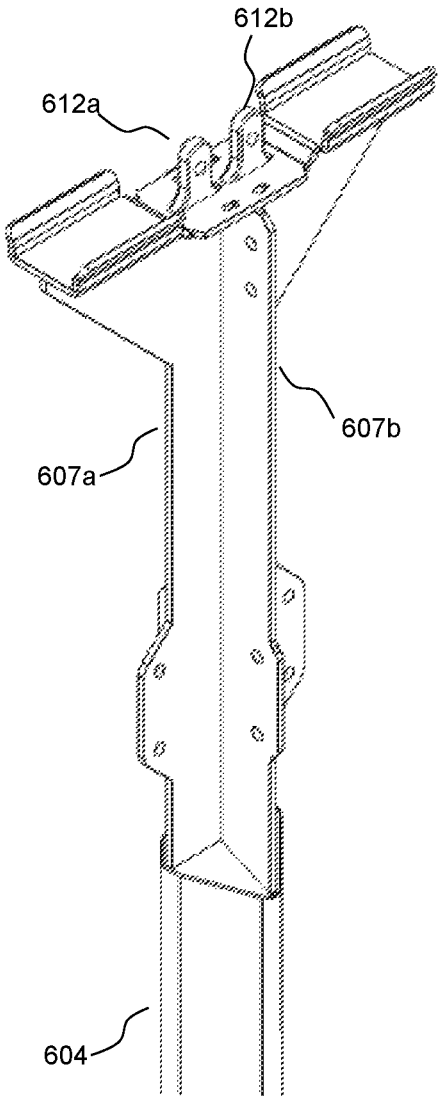
FIG. 55A shows a perspective view of a double-sided vertical according to some embodiments of the present disclosure.

FIG. 55A shows a perspective view of a double-sided vertical according to some embodiments of the present disclosure.

Figure 55B:
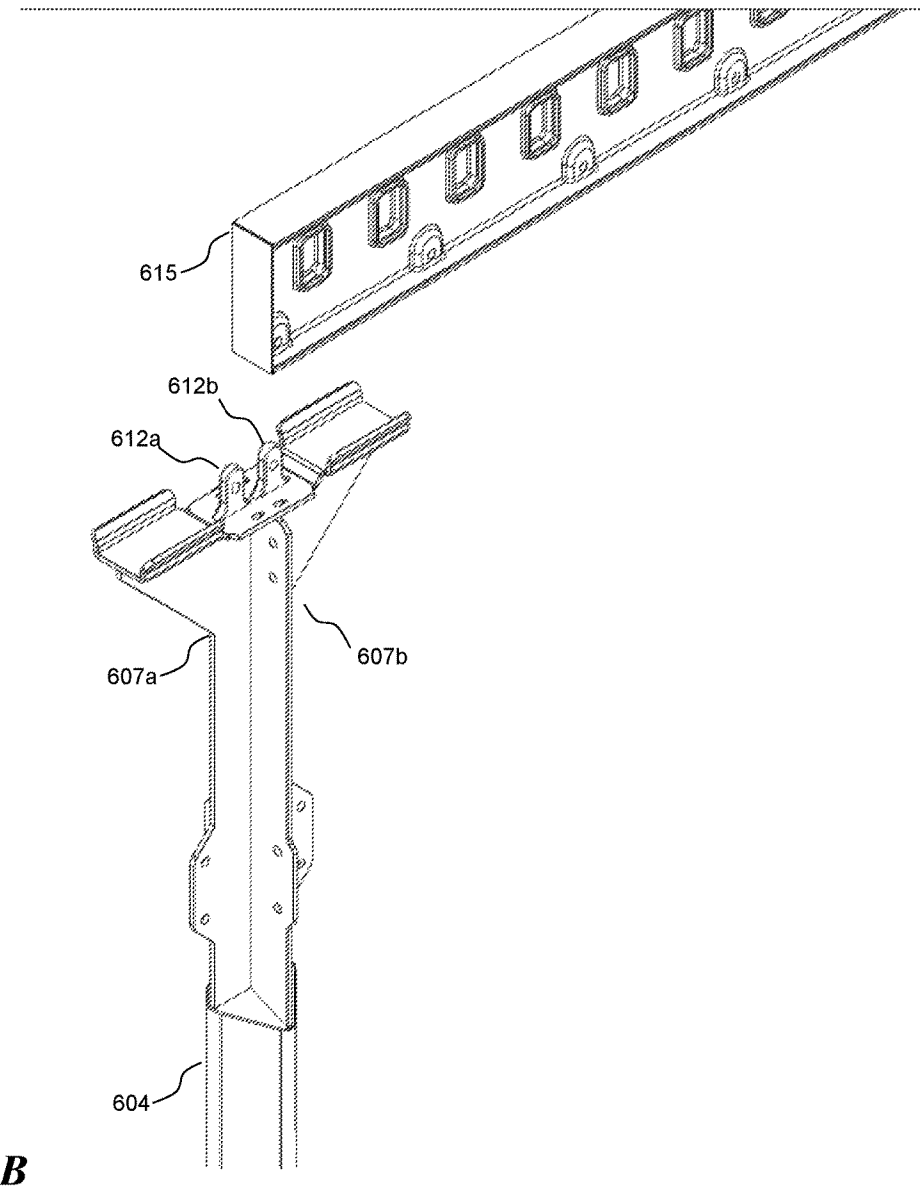
FIG. 55B shows an alternate header beam being connected to a double-sided vertical according to some embodiments of the present disclosure.

FIG. 55B shows an alternate header beam 615 being connected to a double-sided vertical according to some embodiments of the present disclosure. The alternate header beam 615 can connect at the alternate rod header 612*b*.

Figure 55C:
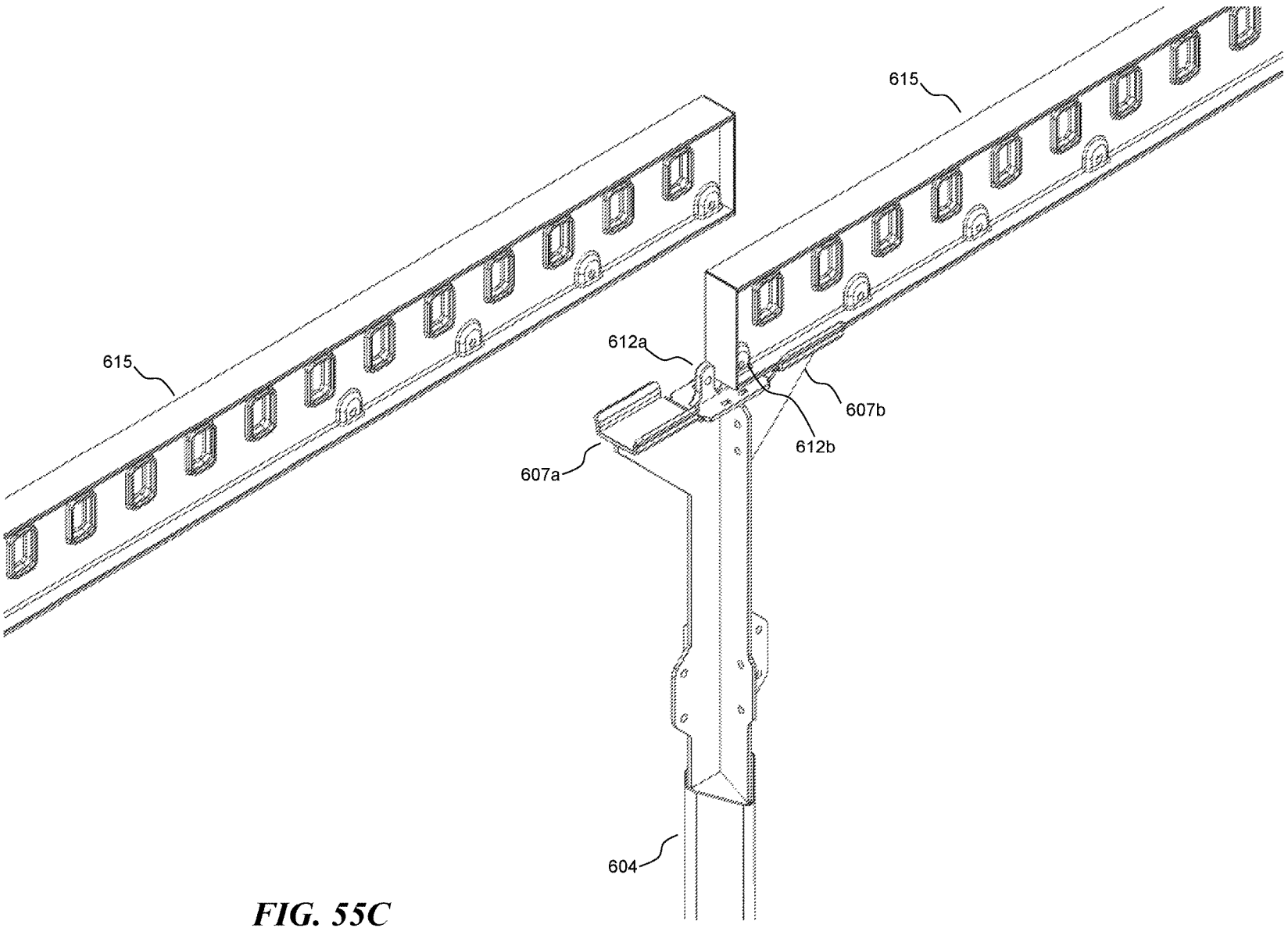
FIG. 55C shows a second alternate header beam being connected to a double-sided vertical according to some embodiments of the present disclosure.

FIG. 55C shows a second alternate header beam 615 being connected to a double-sided vertical according to some embodiments of the present disclosure. The second alternate header beam 615 can connect at the alternate rod header 612*a*.

Figure 55D:
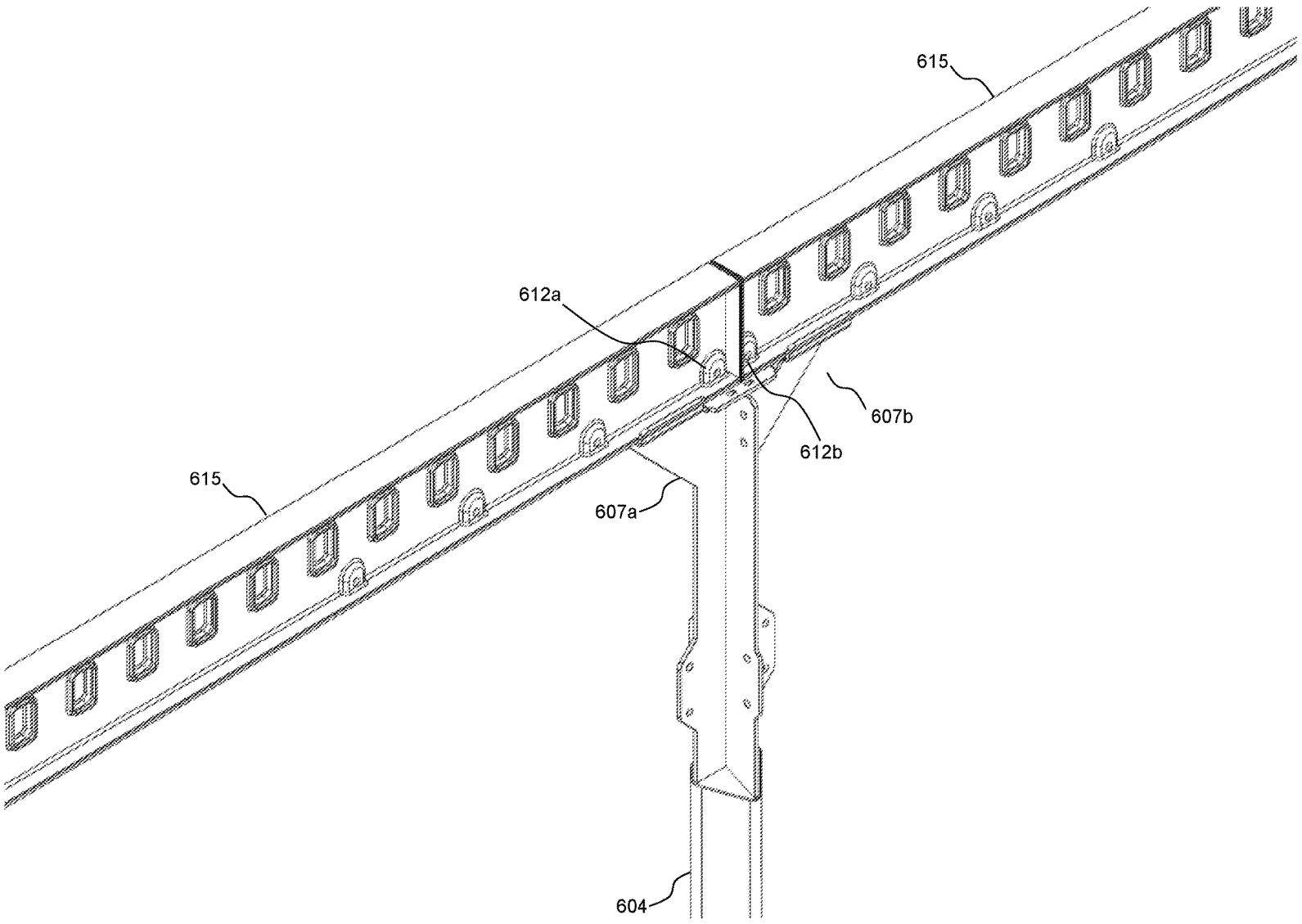
FIG. 55D shows two alternate header beams connected to a double-sided vertical according to some embodiments of the present disclosure.

FIG. 55D shows two alternate header beams 615 connected to a double-sided vertical according to some embodiments of the present disclosure.

Figure 55E:
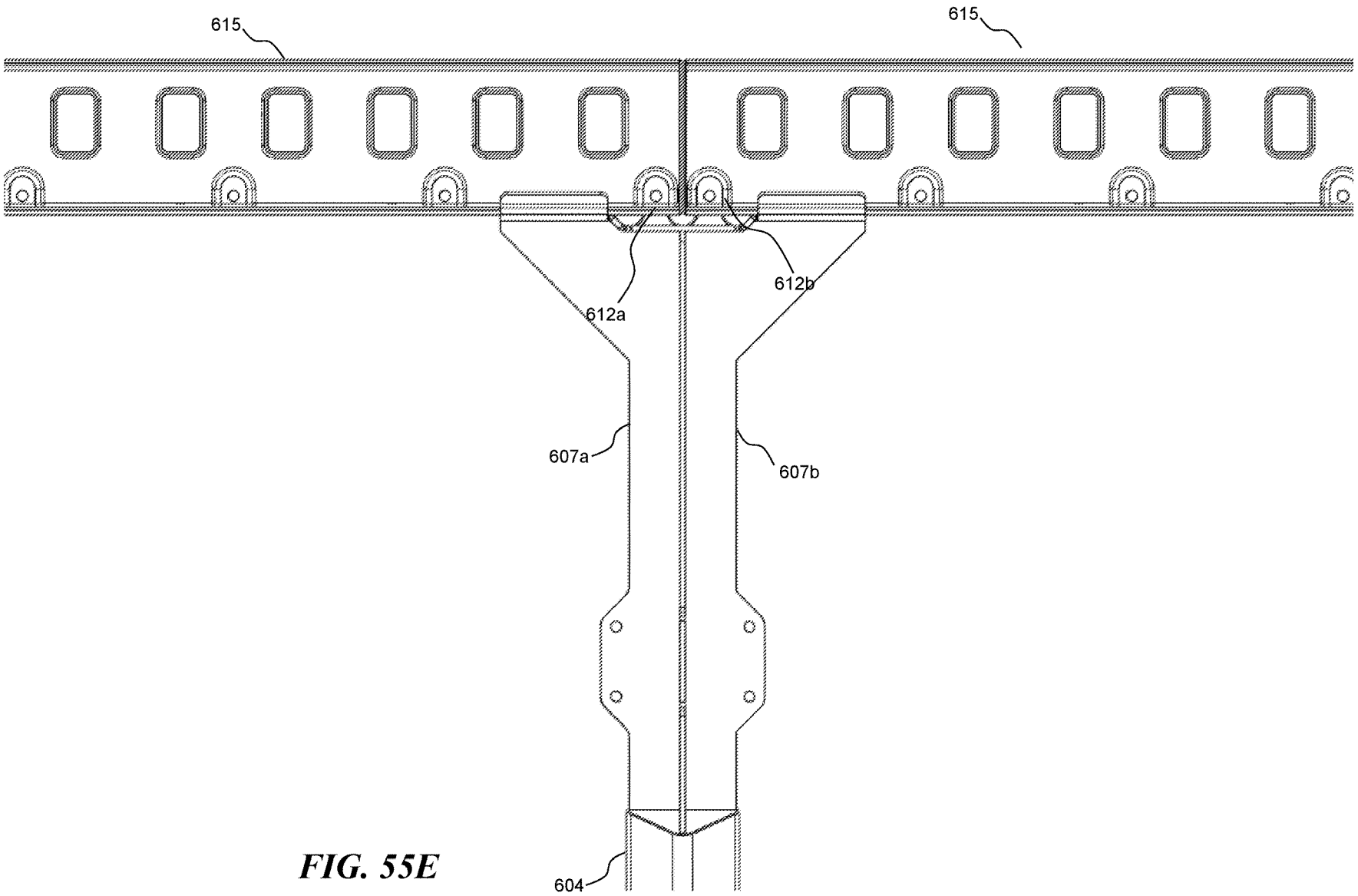
FIG. 55E shows a side view of two alternate header beams connected to a double-sided vertical according to some embodiments of the present disclosure.

FIG. 55E shows a side view of two alternate header beams 615 connected to a double-sided vertical according to some embodiments of the present disclosure.

Figure 56A:
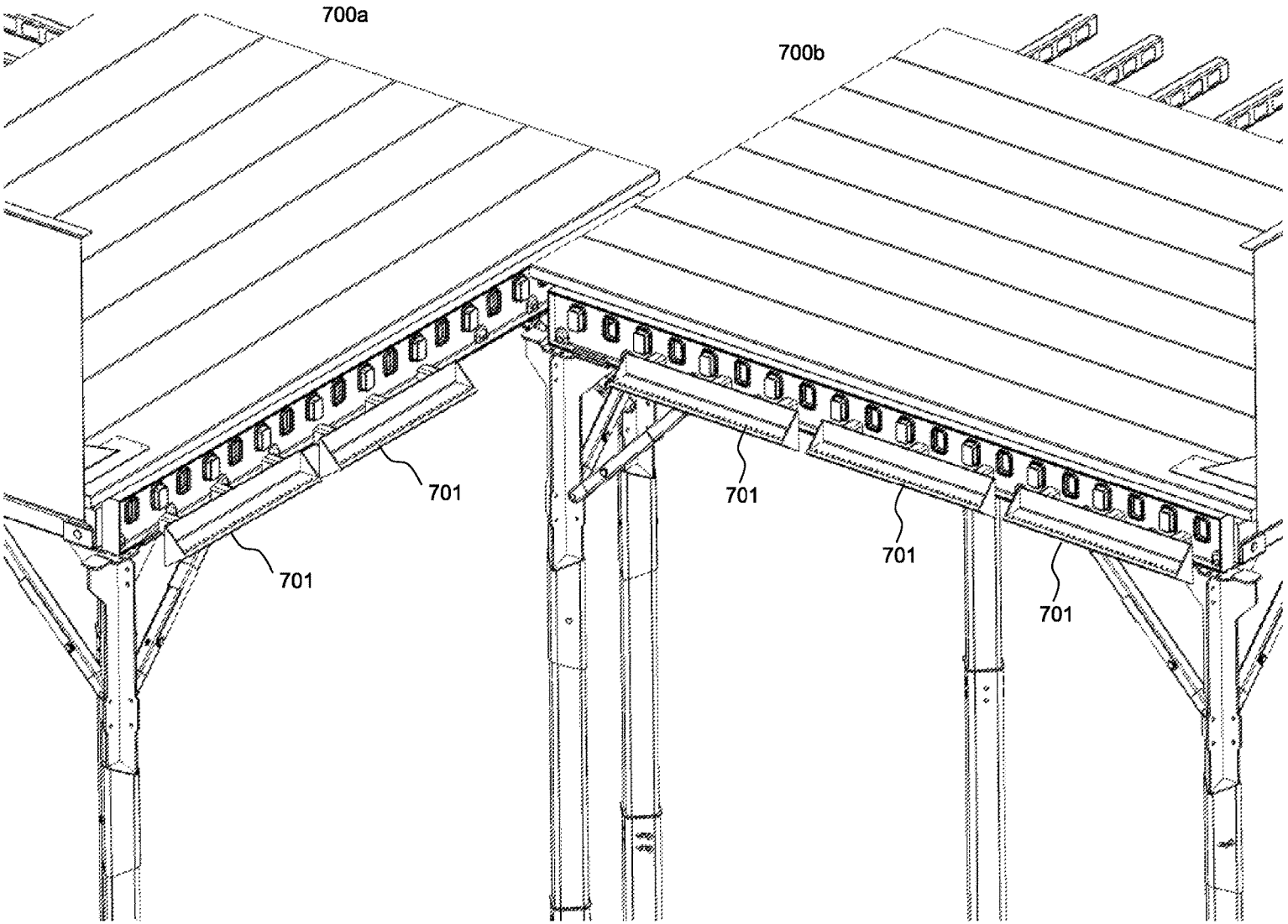
FIGS. 56A-56D show two alternate sidewalk shed sections being connected at a corner according to some embodiments of the present disclosure.
Figure 56B:
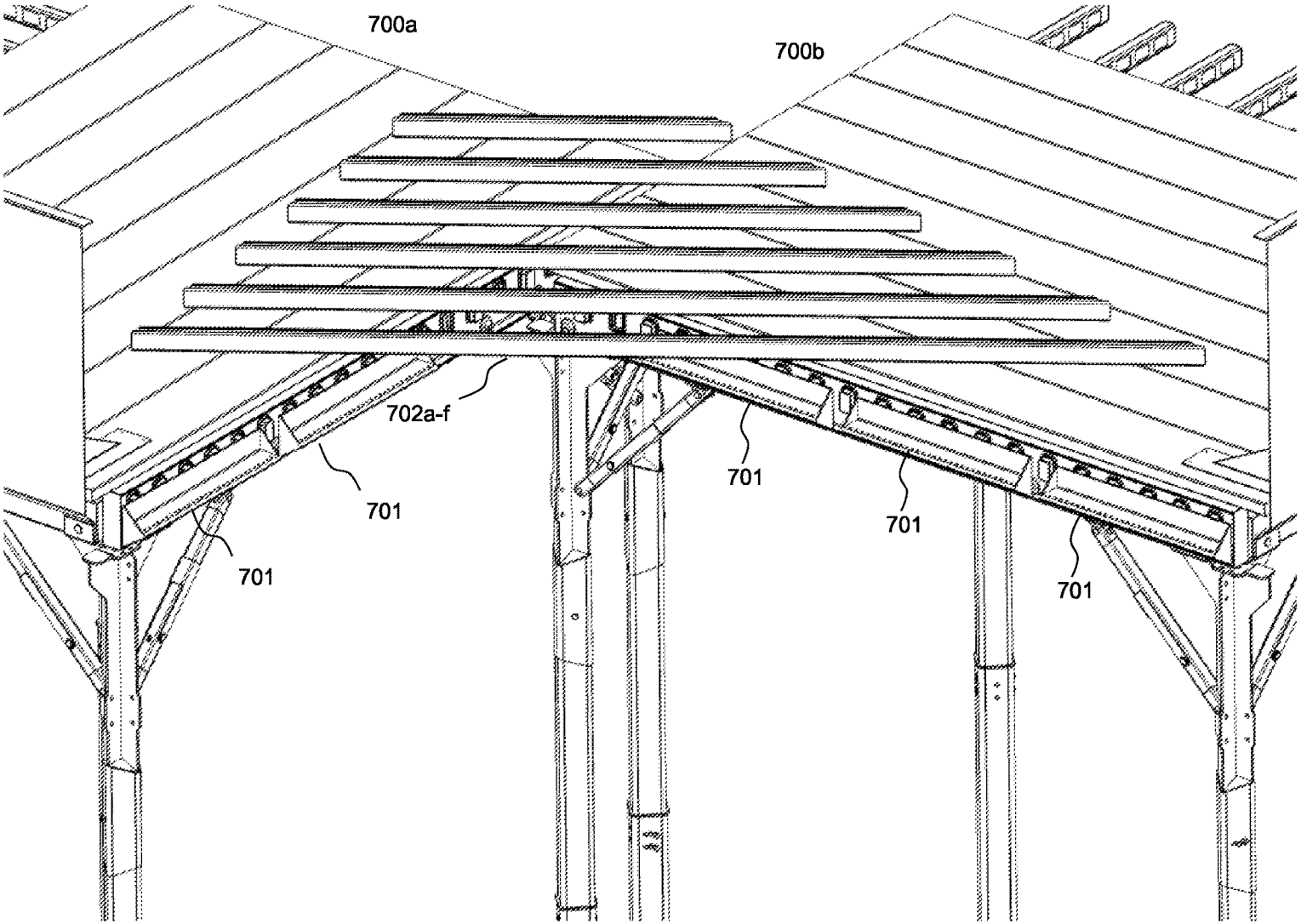
Figure 56C:
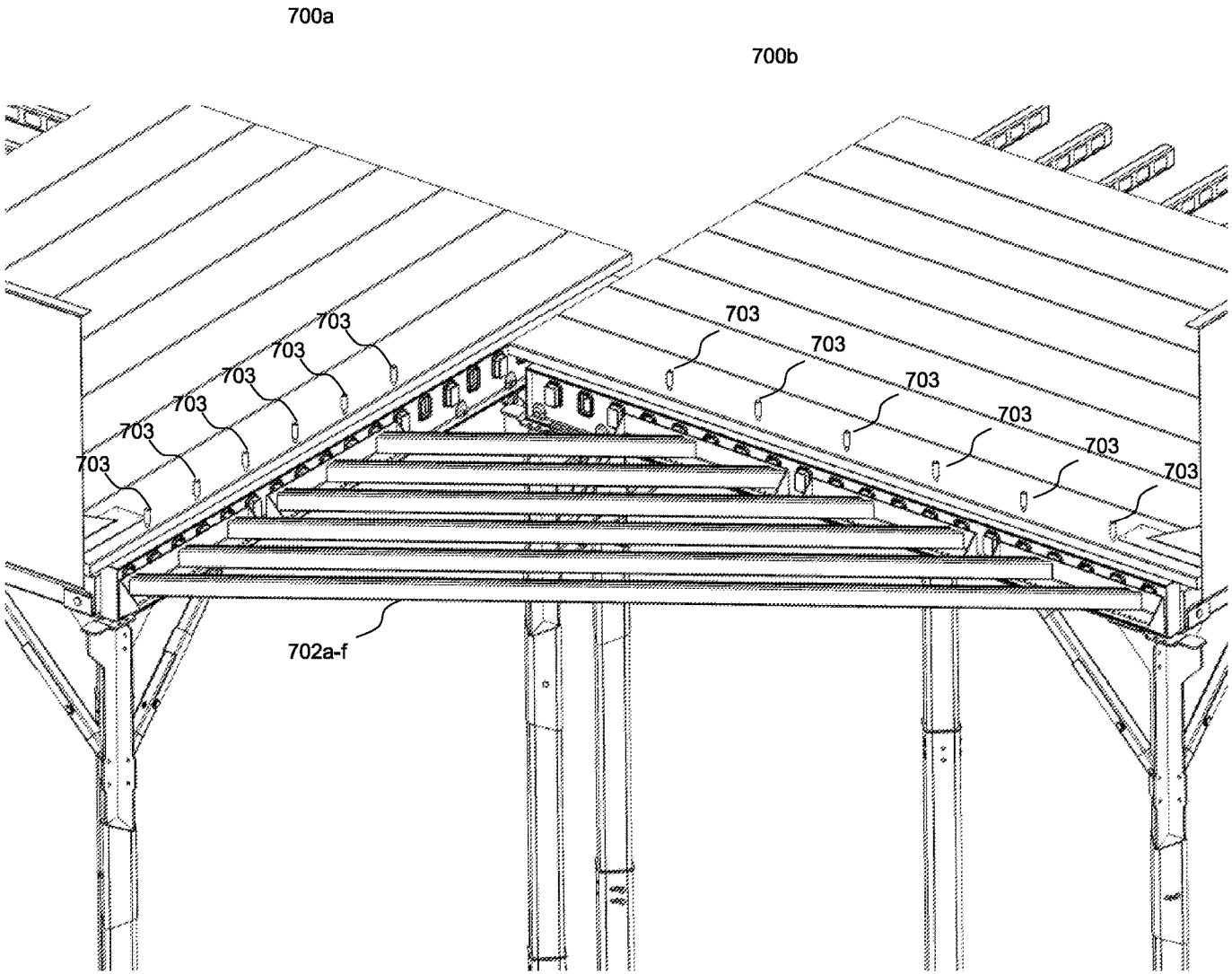
Figure 56D:
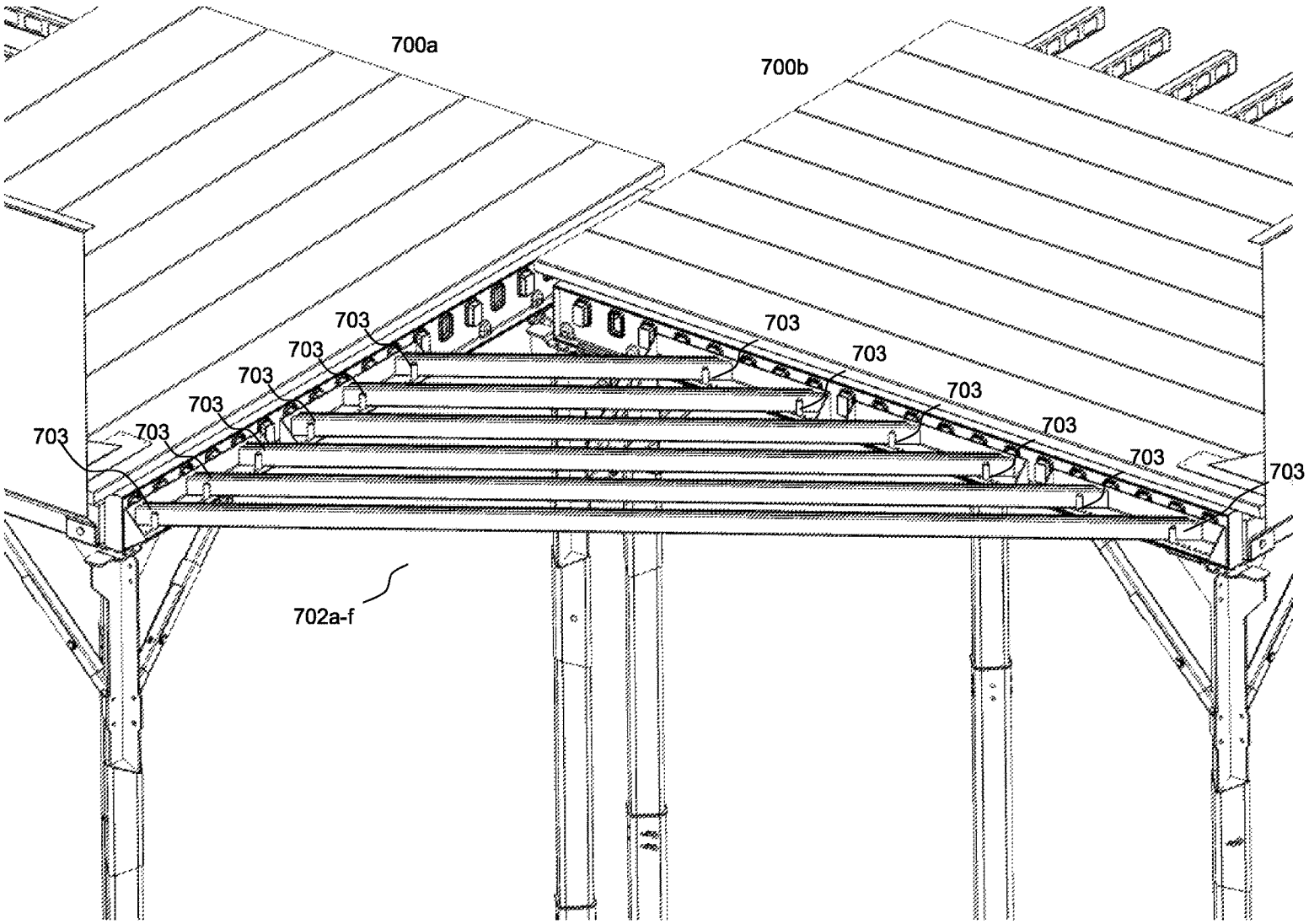

FIGS. 56A-56D show two alternate sidewalk shed sections being connected at a corner according to some embodiments of the present disclosure. In particular, in FIG. 56A, each shed section 700 (i.e., shed section 700*a* and shed section 700*b*) includes multiple corner junior brackets 701 that can facilitate a connection between them. In FIG. 56B, various cut junior beams 702*a-f* are placed such that each side rests on a junior corner bracket 701. In FIG. 56C, junior lock pins 703 are used to attach the junior beams 702 to the respective junior corner brackets 701. FIG. 56D shows the two shed sections 700*a* and 700*b* connected to each other using corner junior brackets 701.

Figure 57:
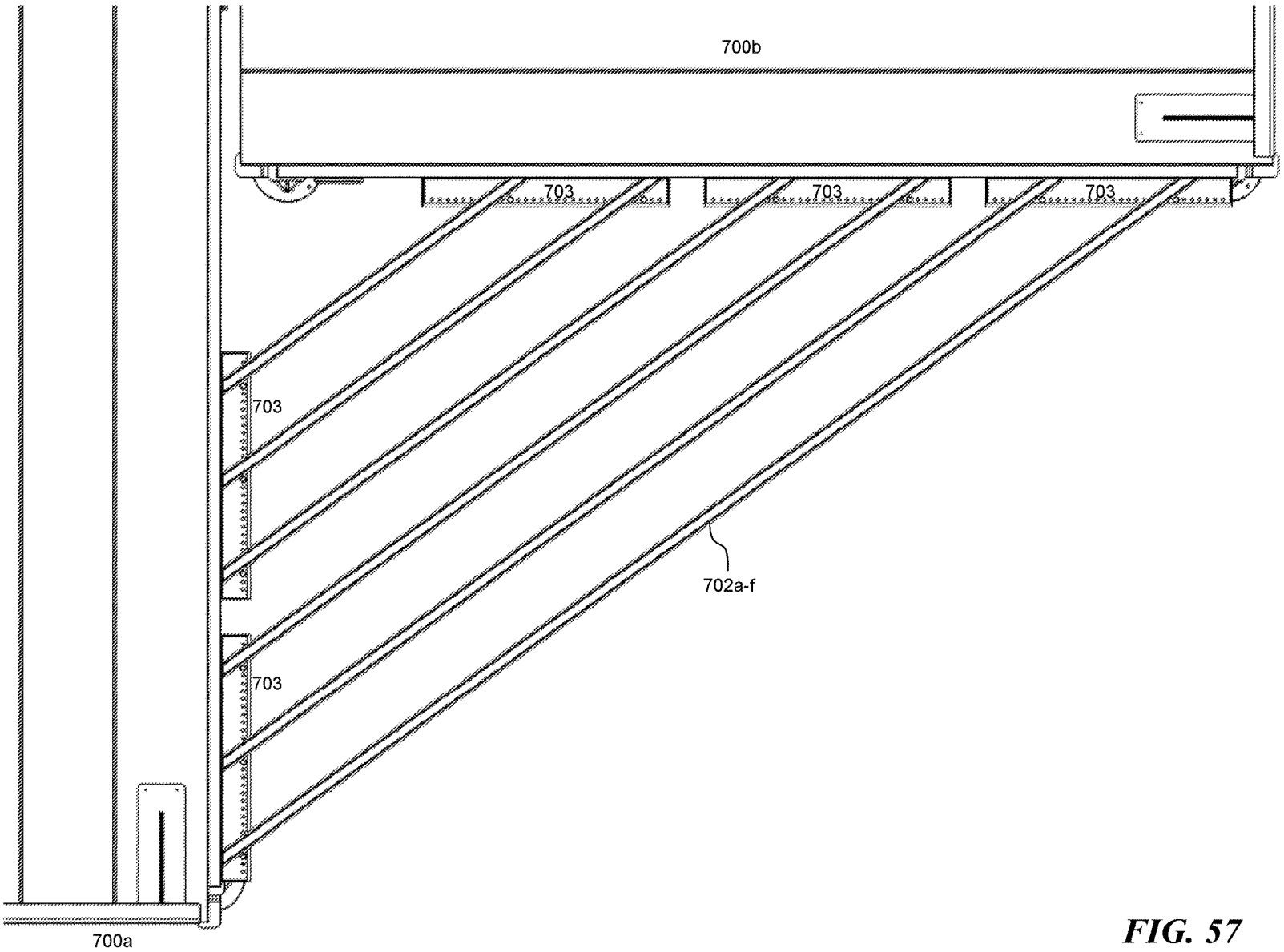
FIG. 57 shows a top view of two alternate sidewalk shed sections being connected at a corner according to some embodiments of the present disclosure.

FIG. 57 shows a top view of two alternate sidewalk shed sections 700*a-b* being connected at a corner according to some embodiments of the present disclosure.

Figure 58:
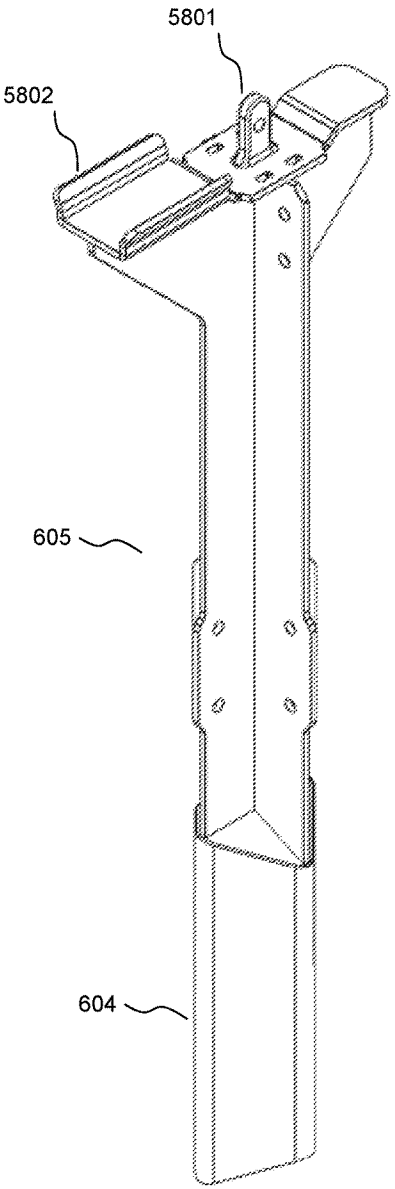
FIG. 58 shows the plus part of a vertical according to some embodiments of the present disclosure.

FIG. 58 shows the plus part 605 of a vertical according to some embodiments of the present disclosure. The plus part 605 can include a header plate 5802 (i.e., header plate 511) and rod header 5801 (i.e., rod header 612).

Figure 59:
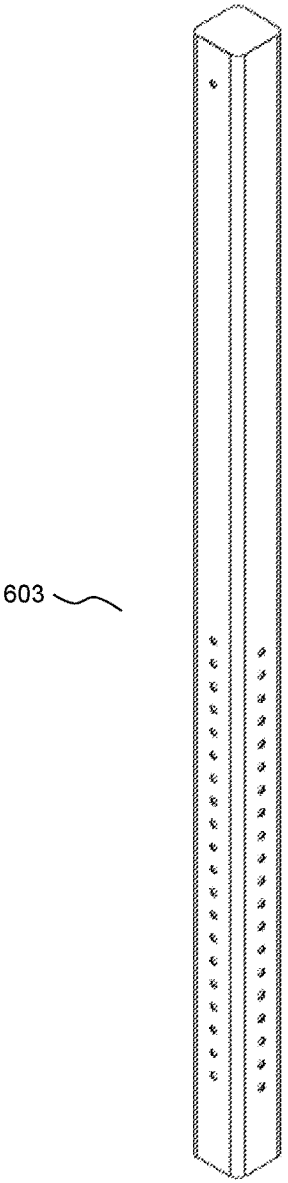
FIG. 59 shows a vertical rod that can be part of a vertical according to some embodiments of the present disclosure.

FIG. 59 shows a vertical rod 603 that can be part of a vertical according to some embodiments of the present disclosure. In some embodiments, the vertical rod 603 can connect to the bottom of center rod 604 to form the upper portion of a vertical. In addition, the vertical rod 603 can connect to the vertical leg 602, which is discussed in relation to FIG. 60.

Figure 60:
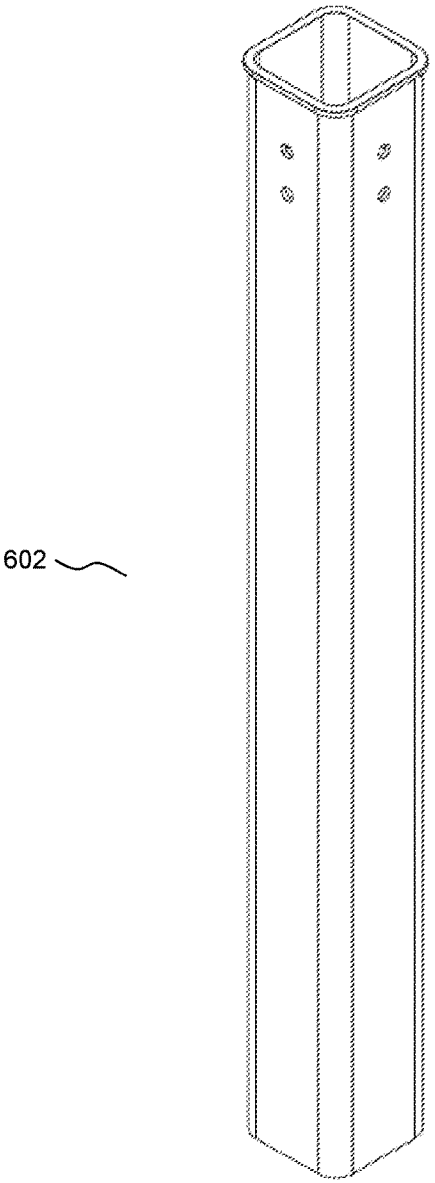
FIG. 60 shows a vertical leg that can be part of a vertical according to some embodiments of the present disclosure.

FIG. 60 shows a vertical leg 602 that can be part of a vertical according to some embodiments of the present disclosure. In some embodiments the vertical leg 602 can connect to the bottom of the vertical rod 603. In addition, the vertical leg 602 can connect to a base 601 (not shown).

Figure 61:
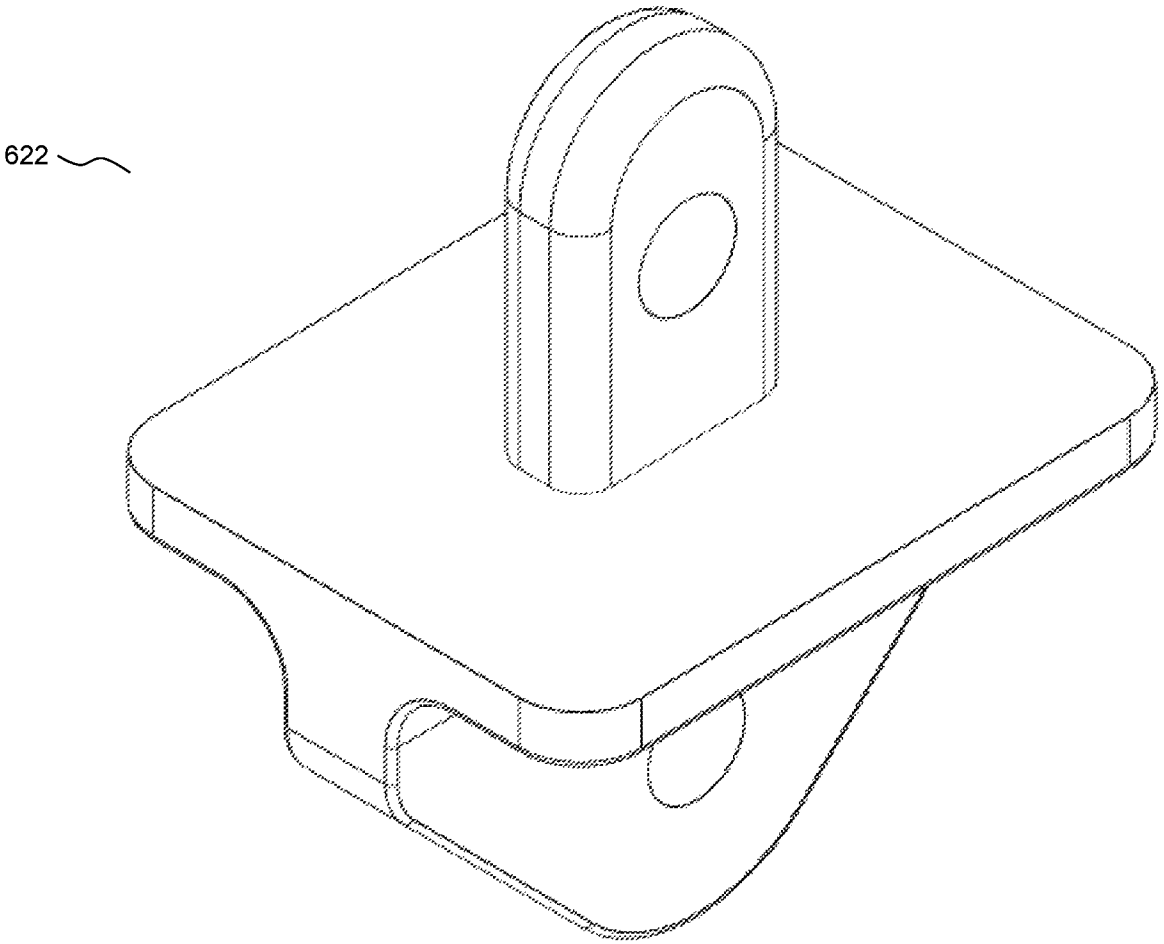
FIG. 61 shows a bracing connector according to some embodiments of the present disclosure.

FIG. 61 shows a bracing connector 622 according to some embodiments of the present disclosure, as shown in FIGS. 42C, 42E, and 45.

Figure 62A:
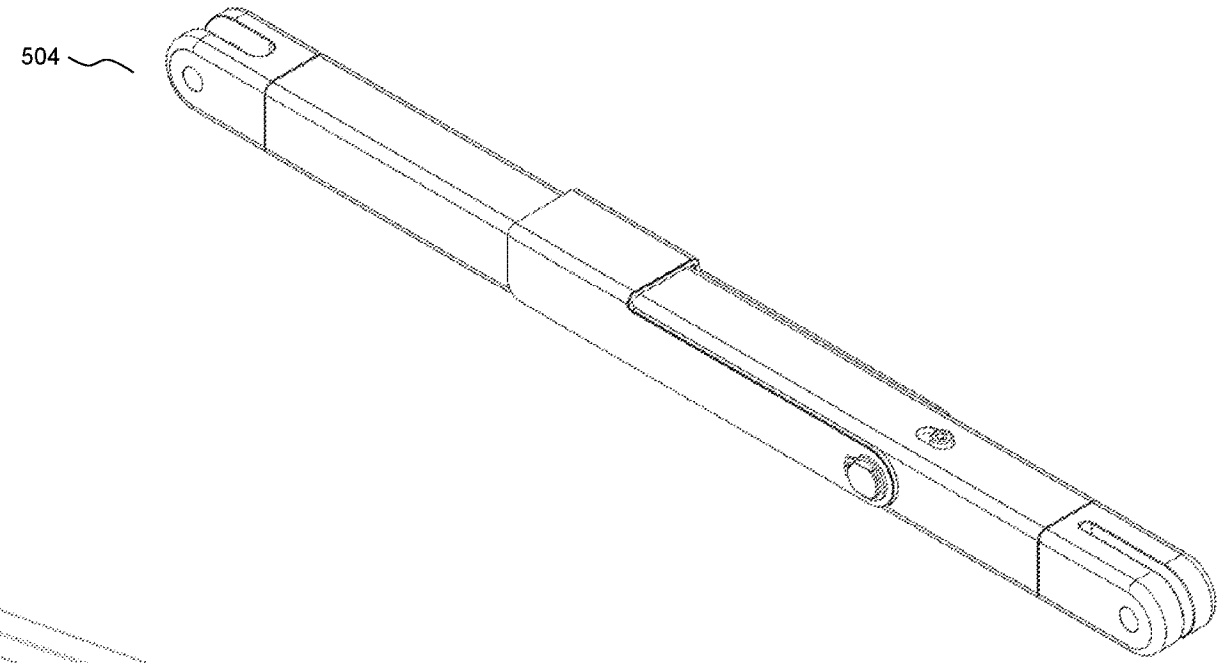
FIG. 62A shows a bracing according to some embodiments of the present disclosure.
Figure 62B:
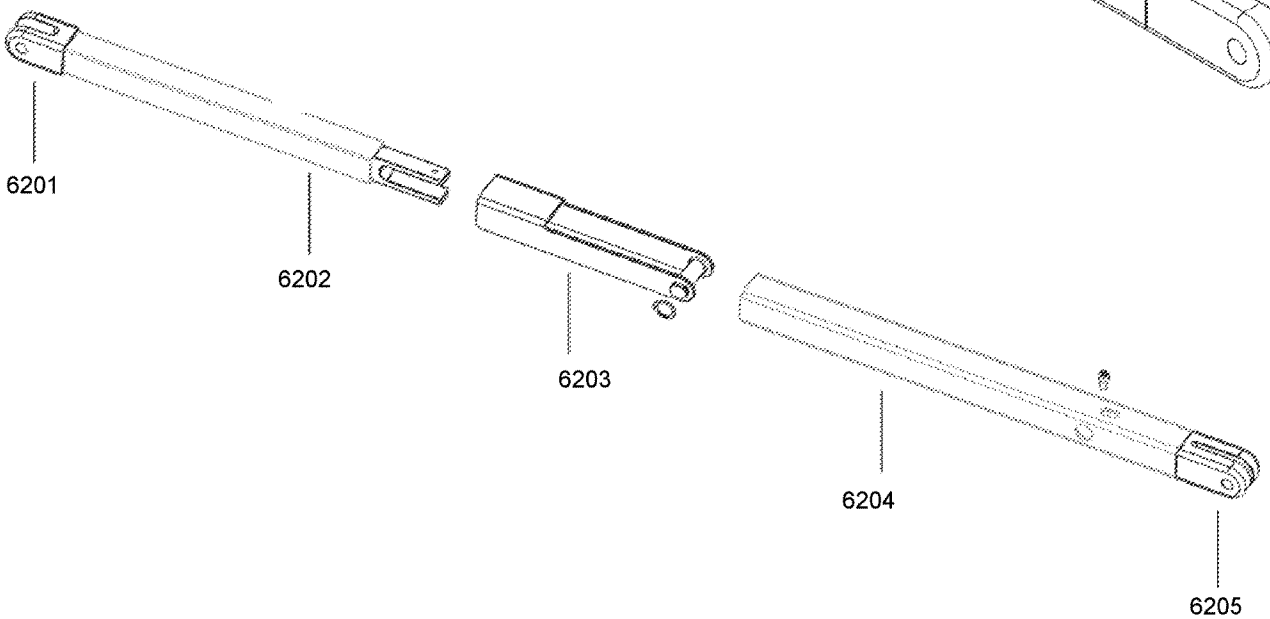
FIG. 62B shows an exploded view of a bracing according to some embodiments of the present disclosure.

FIG. 62A shows a bracing 504 according to some embodiments of the present disclosure. FIG. 62B shows an exploded view of a bracing 504 according to some embodiments of the present disclosure. The bracing 504 can include a brace big fork 6201, a brace extender 6202, an oval hinge lever 6203, a brace shaft 6204, and a brace small fork 6204.

Figure 63:
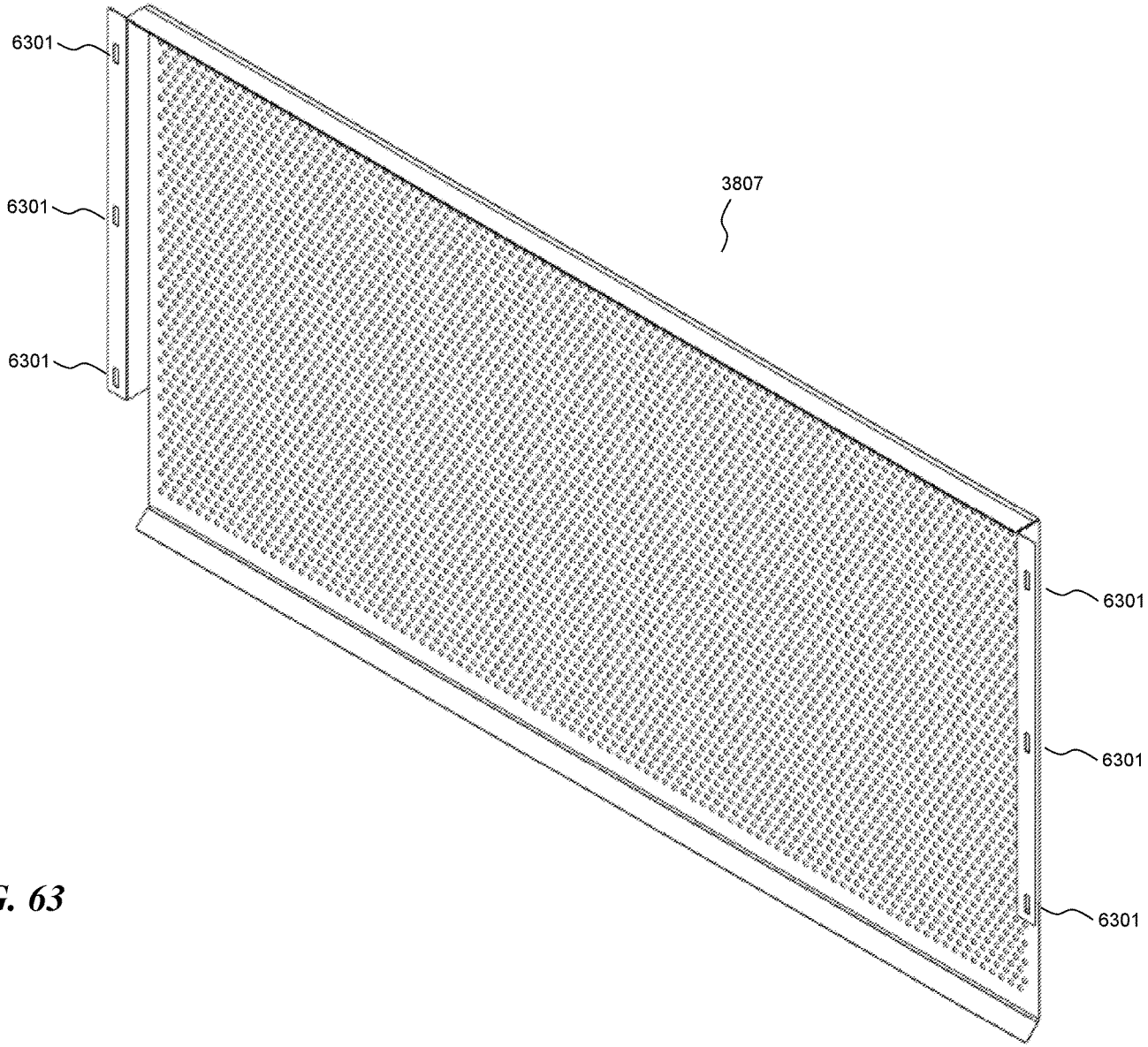
FIG. 63 shows another example parapet according to some embodiments of the present disclosure.

FIG. 63 shows another example parapet 3807 according to some embodiments of the present disclosure. In some embodiments, the parapet 3807 can include various slots 6301 that are configured to receive a latch from a parapet bar (see FIG. 64) and facilitate a connection therebetween.

Figure 64:
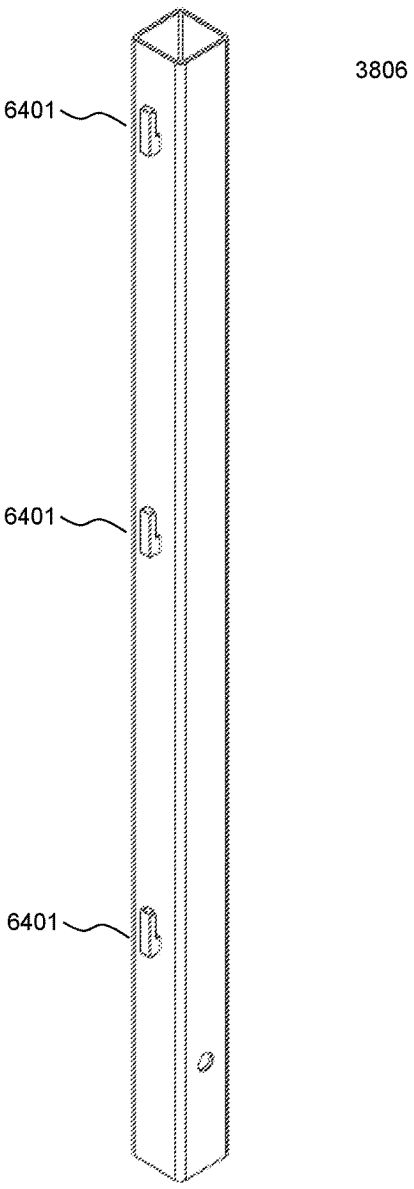
FIG. 64 shows another example parapet bar according to some embodiments of the present disclosure.

FIG. 64 shows another example parapet bar 3806 according to some embodiments of the present disclosure. In some embodiments, the parapet bar 3806 can includes various latches 6401 that are configured to align with and enter slots 6301 on a parapet 3807 to facilitate a connection. In addition, the parapet bar 3806 can be held by a parapet bar bracket, as discussed in relation to FIG. 65.

Figure 65:
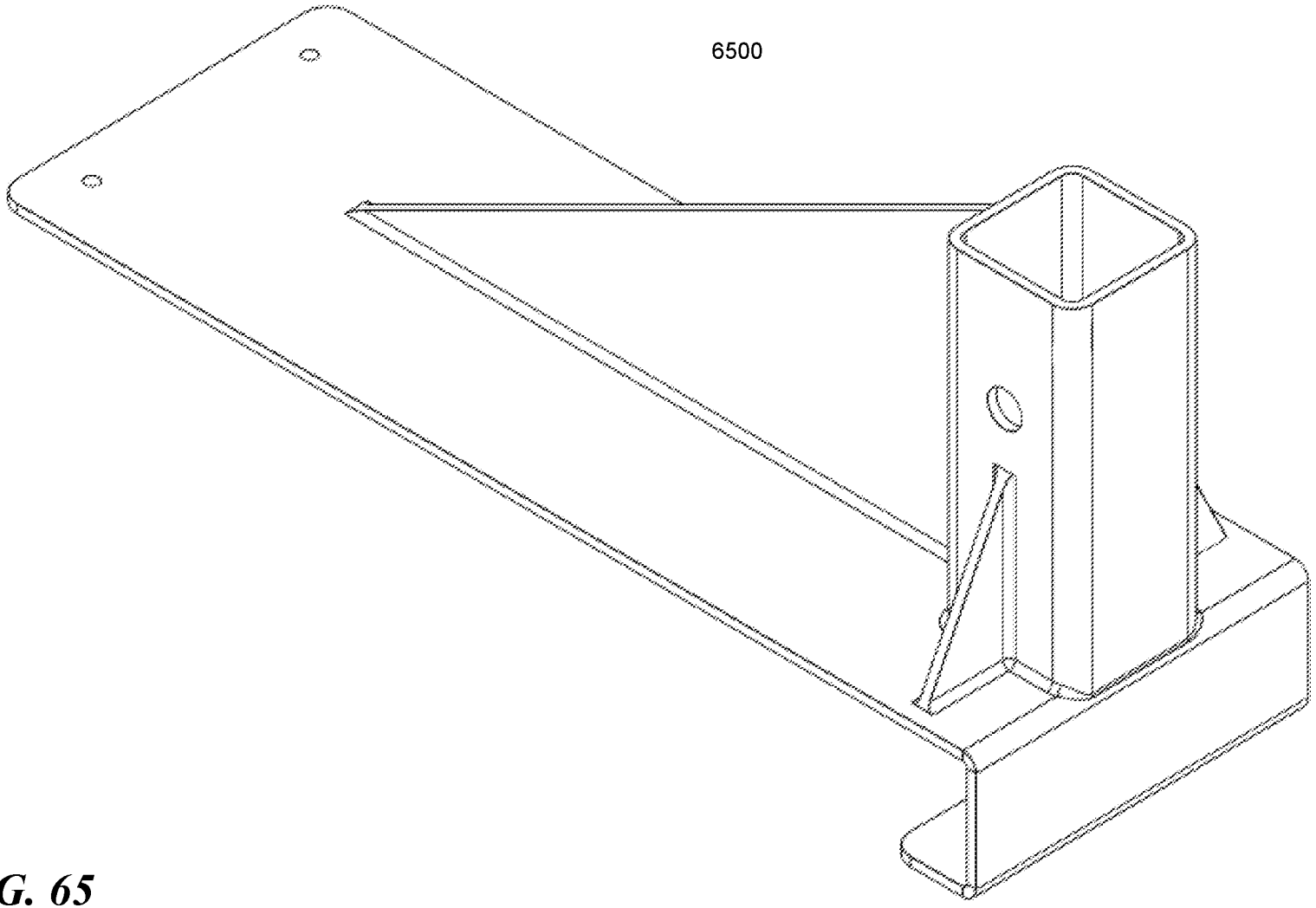
FIG. 65 shows a parapet bar bracket according to some embodiments of the present disclosure.

FIG. 65 shows a parapet bar bracket 6500 according to some embodiments of the present disclosure. The parapet bar bracket 6500 is configured to receive a parapet bar 3806 and can be mounted on a plank 526.

Figure 66:
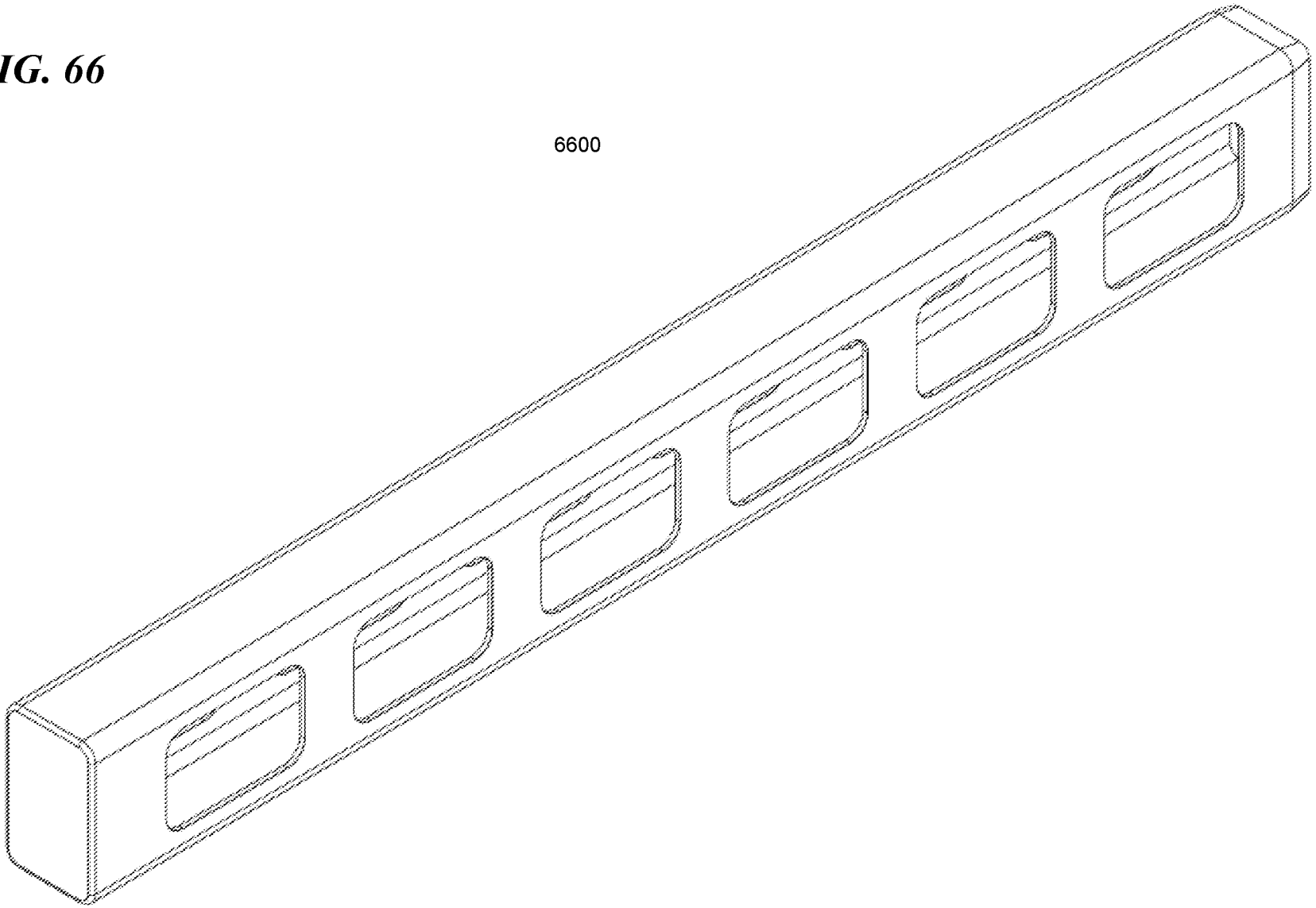
FIG. 66 shows a junior end cap according to some embodiments of the present disclosure.

FIG. 66 shows a junior end cap 6600 according to some embodiments of the present disclosure.

Figure 67:
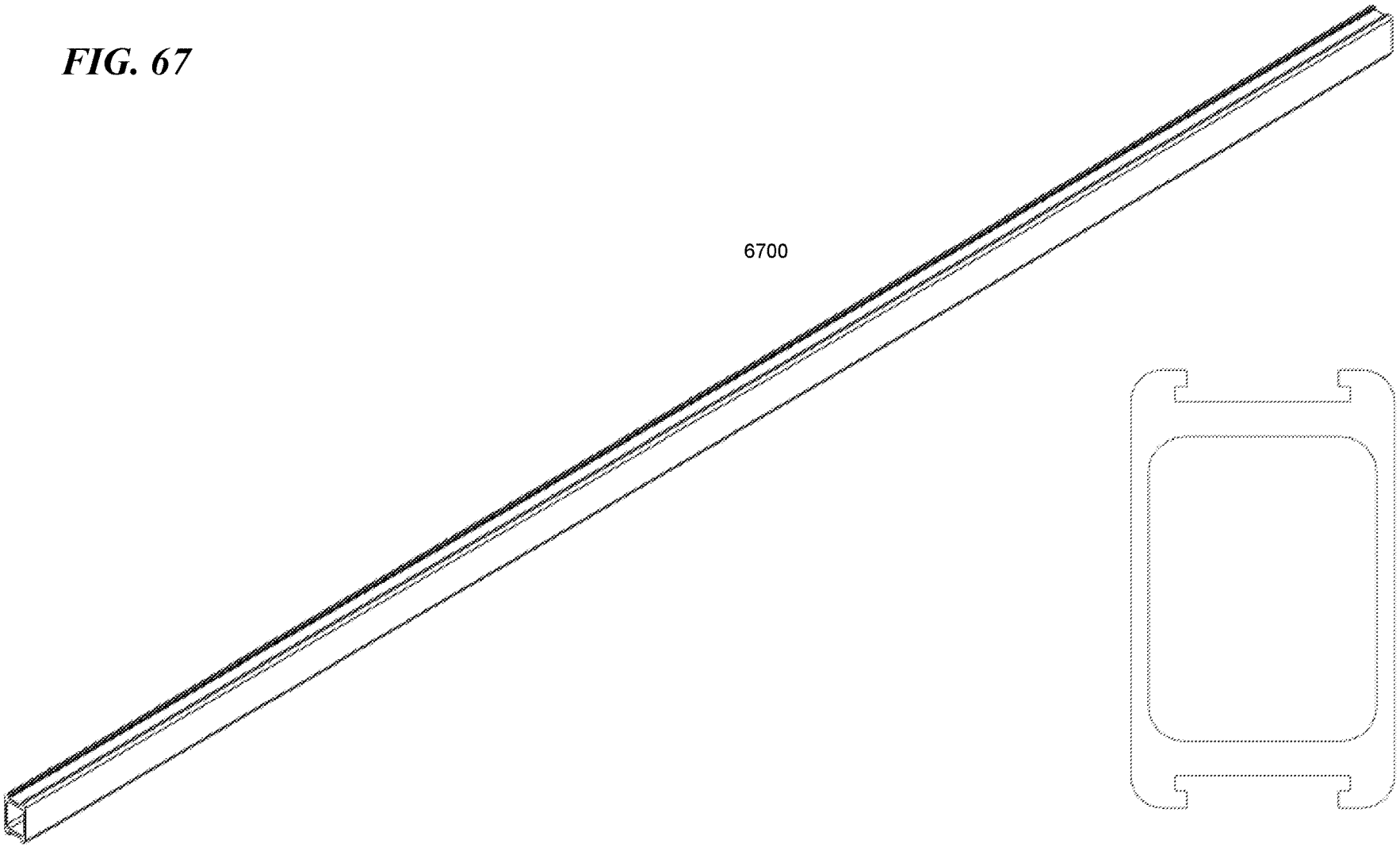
FIG. 67 shows a junior beam and a cross-sectional view of the junior beam according to some embodiments of the present disclosure.

FIG. 67 shows a junior beam 6700 (i.e., junior beam 524) and a cross-sectional view of the rail profile of the junior beam 6700 according to some embodiments of the present disclosure.

While various embodiments have been described above, it should be understood that they have been presented by way of example and not limitation. For example, a sidewalk shed section need not be constructed in the exact order described herein. It will be apparent to persons skilled in the relevant art(s) that various changes in form and detail may be made therein without departing from the spirit and scope. In fact, after reading the above description, it will be apparent to one skilled in the relevant art(s) how to implement alternative embodiments. For example, other steps may be provided, or steps may be eliminated, from the described flows, and other components may be added to, or removed from, the described systems. Accordingly, other implementations are within the scope of the following claims.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

The invention claimed is:

1. A sidewalk shed section comprising:

a first and second pair of leg sections, wherein at least a portion of each leg section is plus-shaped, and each leg section comprises:

a rod header located at a top end of the plus-shaped portion;

at least one hole located at a bottom end of the plus-shaped portion; and a bracket configuration;

a first header beam connected to each of the first pair of leg sections via a first and second header beam hole, each hole configured to receive the respective rod headers;

a second header beam connected to each of the second pair of leg sections via a third and fourth header beam hole, each hole configured to receive the respective rod headers;

a first senior beam connected to a first bracket configuration of the first pair of leg sections and a first bracket configuration of the second pair of leg sections;

a second senior beam connected to a second bracket configuration of the first pair of leg sections and a second bracket configuration of the second pair of leg sections;

a plurality of braces, each brace being connected to a plus-shaped portion of a leg section and one of the first senior beam, the second senior beam, the first header beam, or the second header beam;

a platform section supported by the first senior beam and the second senior beam; and a barrier supported by the first header beam and the second header beam.

2. The sidewalk shed section of claim 1, wherein each leg section further comprises a header plate, wherein the respective header beam rests on the header plate.

3. The sidewalk shed section of claim 1, wherein each leg section comprises:

a center rod;

a base connected to a bottom end of the center rod; and a plus part connected to the top end of the center rod, the plus part comprising the plus-shaped portion.

4. The sidewalk shed section of claim 3, wherein the base comprises a threaded rod and is configured to screw into the bottom end of the center rod.

5. The sidewalk shed section of claim 1, wherein each leg section is connected to two braces of the plurality of braces.

6. The sidewalk shed section of claim 5, wherein one of the two braces is connected to either the first header beam or the second header beam and another of the two braces is connected to either the first senior beam or the second senior beam.

7. The sidewalk shed section of claim 1, wherein each of the plurality of braces is connected via a bracing cap and pin.

8. The sidewalk shed section of claim 1 comprising a plurality of junior beams, each junior beam residing in a slot of the first header beam and a slot of the second header beam and spanning a width of the sidewalk shed section.

9. The sidewalk shed section of claim 8, wherein the platform section is further supported by the plurality of junior beams.

10. The sidewalk shed section of claim 9, wherein the platform section comprises:

a corrugated sheet configured to reside on the plurality of junior beams and the first and second senior beams; and one or more planks configured to reside on the corrugated sheet.

11. The sidewalk shed section of claim 10, wherein the barrier comprises:

a first parapet rod received by a first parapet bar bracket connected to a first plank of the one or more planks; and a second parapet rod received by a second parapet bar bracket connected to a second plank of the one or more planks.

12. The sidewalk shed section of claim 11, wherein the barrier comprises a parapet coupled to each of the first and second parapet rods.

13. The sidewalk shed section of claim 12, wherein the parapet is perforated.

14. The sidewalk shed section of claim 1, wherein the bracket configuration comprises a bracket and a bracket mirror, wherein the bracket and the bracket mirror are coupled to the plus-shaped portion.

15. The sidewalk shed section of claim 1, wherein each of the first header beam and the second header beam comprise a first plurality of holes located at a first end and a second plurality of holes located at a second end.

16. The sidewalk shed section of claim 1, wherein the sidewalk shed section is configured to be connected horizontally to a second sidewalk shed section.

17. The sidewalk shed section of claim 1, wherein the sidewalk shed section is configured to be connected vertically to a second sidewalk shed section.

* * * * *